US006856305B2

(12) United States Patent
Nagano

(10) Patent No.: US 6,856,305 B2
(45) Date of Patent: Feb. 15, 2005

(54) PLASMA DISPLAY PANEL AND PLASMA DISPLAY DEVICE

(75) Inventor: Shinichiro Nagano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 287 days.

(21) Appl. No.: 10/280,003

(22) Filed: Oct. 25, 2002

(65) Prior Publication Data

US 2003/0080682 A1 May 1, 2003

(30) Foreign Application Priority Data

Oct. 26, 2001 (JP) ..... P2001-329047
Mar. 26, 2002 (JP) ..... P2002-085686
Sep. 13, 2002 (JP) ..... P2002-268497

(51) Int. Cl.[7] ..... G09G 3/28; H01J 17/49
(52) U.S. Cl. ..... 345/60; 345/63; 313/582; 313/586
(58) Field of Search ..... 345/60, 62, 63, 345/72; 313/582, 584, 586, 588

(56) References Cited

U.S. PATENT DOCUMENTS 6,646,375 B1 * 11/2003 Nagano ..... 313/582

FOREIGN PATENT DOCUMENTS

| | | | | |
|---|---|---|---|---|
| JP | 09-102280 A | | 4/1997 | |
| JP | 1997-278487 | * | 4/1997 | ..... H01J/11/00 |
| JP | 09-237580 A | | 9/1997 | |
| JP | 10-149774 A | | 6/1998 | |
| JP | 10-233171 A | | 9/1998 | |
| JP | 10-255664 A | | 9/1998 | |
| JP | 10-333636 A | | 12/1998 | |
| JP | 11-149873 A | | 6/1999 | |
| JP | 2000-39866 A | | 2/2000 | |
| JP | 2000-100337 A | | 4/2000 | |
| JP | 2000-113828 A | | 4/2000 | |
| JP | 2000-156166 A | | 6/2000 | |
| JP | 2000-195431 A | | 7/2000 | |
| JP | 2000-311612 A | | 11/2000 | |
| JP | 2001-015034 A | | 1/2001 | |
| JP | 2001-147660 A | | 5/2001 | |
| JP | 2001-176400 A | | 6/2001 | |
| JP | 2001-1630361 A | | 6/2001 | |
| JP | 2001-183999 A | | 7/2001 | |
| JP | 2002-56775 A | | 2/2002 | |
| JP | 2002-83545 A | | 3/2002 | |

OTHER PUBLICATIONS

Kimio Amemiya, et al.; "High Luminous Efficiency and High Definition Coplanar AC–PDP with 'T'—Shaped Electrodes"; IDW '98; pp. 531–534.

Y. Hashimoto, et al., "High–Luminance and Highly Luminous–Efficient AC–PDP with Delta Cell Structure"; SDI 01 Digest; pp. 1328–1331.

(List continued on next page.)

*Primary Examiner*—Amare Mengistu
(74) *Attorney, Agent, or Firm*—Birch, Stewart, Kolasch & Birch, LLP.

(57) ABSTRACT

A discharge inert film (22) is made of an aggregate of fine particles not substantially containing any inorganic binder. Each of sustain discharge electrodes (XB, YB) includes a plurality of discharge gap adjoining portions (a), a bus portion (b) and a plurality of bridge-building portions (c). The bus portion (b) adjoins the electrode pair gap portion (NG), extending along a second direction (D2). Each of bridge-building portions (c) extends towards a discharge gap portion (DG). The bridge-building portions (c) are connected to the discharge gap adjoining portions (a), respectively, and these adjoining portions (a) adjoin the discharge gap portion (DG) and are arranged therealong. The film (22) is so disposed as not to cover the discharge gap adjoining portions (a). When a surface discharge is generated between the sustain discharge electrodes (X, Y) during a reset period, the potential difference between the electrodes (X, Y) is gradually increased.

20 Claims, 25 Drawing Sheets

51F

OTHER PUBLICATIONS

Y. Tanaka, et al.; "A New Progressive Driving Scheme for a PDP with 'Castle' Structure"; IDW'01; pp. 869–872.
H. Hirakawa, et al.; "An Advanced Progressisve Driving Method for PDP with Horizontal Barrier Ribs and Common Electrodes"; IDW'01; pp. 1757–1758.
T. Komaki, et al.; "High Luminance AC–PDPS with Waffle-Structured Barrier Ribs"; IDW'99; 587–590.
Jae–Young Lee, et al.; "A Study on the New Shaped Align–Free Sustain Electrodes Showing High Luminous Efficiency in AC PDPS"; IDW'00; p. 623–626.

* cited by examiner

PLASMA DISPLAY PANEL AND PLASMA DISPLAY DEVICE

BACKGROUND OF THE INVENTION

1. Field of the Invention

The present invention relates to a plasma display panel (also referred to as "PDP") and a plasma display device.

2. Description of the Background Art

FIG. 23 is a perspective view illustrating a PDP 51P including a discharge inert film, which is disclosed in Japanese Patent Application Laid Open Gazette No. 9-102280. The discharge inert film is also reffered to as a "discharge deactivation film", as a "discharge passivation film" or as a "discharge inhibiting film". The PDP 51P of FIG. 23 is a surface discharge type AC-PDP. The PDP 51P is broadly divided into a front substrate 51FP, a rear (or back) substrate 51R, and a barrier rib 7 and a phosphor 8 which are disposed between the front substrate 51FP and the rear substrate 51R.

The front substrate 51FP includes a front glass substrate 5, a plurality of sustain discharge electrodes X and Y, a dielectric layer 3, a cathode film 11 and a discharge inert film 21P. In more detail, a plurality of sustain discharge electrodes X and Y are alternately arranged on a main surface of the front glass substrate 5 along a first direction D1 and extend along a second direction D2 which intersects (herein, orthogonal to) the first direction D1. Adjacent two of the alternate sustain discharge electrodes X and Y make a pair, and a pair of two sustain discharge electrodes (hereinafter, referred to also as "sustain discharge electrode pair") X and Y are arranged with a discharge gap portion DG interposed therebetween. A portion between the adjacent pairs of sustain discharge electrodes X and Y is hereafter referred to as "adjoining sustain discharge electrode pair gap portion" (or "electrode pair gap portion") NG.

The pair of sustain discharge electrodes X and Y define a display line L extending along the second direction D2, and the display line L is schematically indicated by an alternate long and short dash line (or chain line) in FIG. 23, which is present between the pair of sustain discharge electrodes X and Y or in the discharge gap portion DG. In this case, the discharge gap portions DG extending along the second direction D2 correspond to the display lines L, respectively.

Each of the sustain discharge electrodes X and Y is constituted of a transparent electrode 1 and a bus electrode 2. Specifically, the transparent electrode 1 extends along the second direction D2. The transparent electrodes 1 of a pair of sustain discharge electrodes X and Y are arranged with the discharge gap portion DG interposed therebetween. The bus electrode 2 extends along the second direction D2 on each transparent electrode 1. The bus electrode 2 is disposed on a side farther away from the discharge gap portion DG. The bus electrode 2 is mainly made of a metal, serving to supply a voltage to the transparent electrode 1. In the sustain discharge electrodes X and Y, a portion of the transparent electrode 1 on which the bus electrode 2 is not present is referred to as "transparent portion" and a portion of the transparent electrode 1 on which the bus electrode 2 is present, in other words, a portion other than the transparent portion is referred to as "metal electrode portion".

The dielectric layer 3 and the cathode film 11 are formed on the main surface of the front glass substrate 5 in this order, covering the sustain discharge electrodes X and Y. The cathode film 11 is formed by vapor deposition of MgO.

In the PDP 51P, the discharge inert film 21P is formed on the cathode film 11. Specifically, the discharge inert film 21P has a plurality of strip-like patterns, being in a stripe shape. Each strip-like pattern of the discharge inert film 21P is disposed on adjacent two bus electrodes 2 (which are adjacent to each other but belong to different pairs of sustain discharge electrodes X and Y) provided between adjacent display lines L, and between the two bus electrodes 2 as (the main surface of the front substrate 51FP or the front glass substrate 5 is) two-dimensionally viewed. In other words, each strip-like pattern of the discharge inert film 21P is disposed on the metal electrode portions of the not-paired adjacent sustain discharge electrodes X and Y and the electrode pair gap portion NG between the metal electrode portions as two-dimensionally viewed.

Thus, since the discharge inert film 21P is formed on the cathode film 11, exposed surfaces 11S of the cathode film 11 and exposed surfaces 21SP of the discharge inert film 21P are disposed in an upper portion of the dielectric layer 3. In this case, each exposed surface 11S is formed in an area corresponding to the display line L due to the patterns of the discharge inert film 21P.

On the other hand, the rear substrate 51R includes a rear glass substrate 9, a plurality of address electrodes 6 (or W) and an overglaze layer 10. In more detail, a plurality of address electrodes 6 (or W) are arranged on a main surface of the rear glass substrate 9 along the second direction D2, extending along the first direction D1, i.e., a direction that (grade-separately or three-dimensionally) intersects the sustain discharge electrodes X and Y. The overglaze layer 10 is formed on the main surface of the rear glass substrate 9, covering the address electrodes 6.

Further, the barrier rib 7 is disposed on the overglaze layer 10. Specifically, the barrier rib 7 has a plurality of strip-like patterns, being in a stripe shape. Each strip-like pattern of the barrier rib 7 is disposed between adjacent two address electrodes 6 along the first direction D1 as (the main surface of the rear substrate 51R or the rear glass substrate 9 is) two-dimensionally viewed. On inner surfaces of a plurality of U-shaped trenches each constituted of the barrier rib 7 and the overglaze layer 10, the phosphors 8 are formed. In each U-shaped trench, the phosphor 8R, 8G or 8B which emits light of red, green or blue, respectively, is disposed.

The front substrate 51FP and the rear substrate 51R are layered in a third direction D3 which intersects (herein, orthogonal to) both the first direction D1 and the second direction D2 with a top of the barrier rib 7 and the discharge inert film 21P abutting on each other, and sealed at their rim. In this case, a plurality of discharge spaces 51S are formed in the PDP 51P, being sectioned mainly by the barrier ribs 7, more specifically, surrounded by the phosphors 8, the cathode film 11 and the discharge inert film 21P. The discharge space 51S is filled with a mixed gas such as Ne+Xe. The discharge space 51S is opposed to the address electrode 6, extending along the first direction D1.

In the PDP 51P, a grade-separated intersection between the sustain discharge electrode pair X and Y and the address electrode 6 (or W) or a grade-separated intersection between the discharge space 51S and the display line L, which is a crossing point as two-dimensionally viewed, corresponds to one discharge cell (hereinafter, also referred to simply as "cell"). In other words, a plurality of discharge cells are arranged on each display line L and a display area of the PDP 51P is formed of a plurality of discharge cells arranged in matrix on the whole.

The discharge inert film 21P is mainly made of a material having work function larger than MgO which is a material of the cathode film 11, in other words, emitting less secondary electrons than the cathode film 11, such as $A1_2O_3$ or $TiO_2$. Therefore, even if the sustain discharge electrodes X and Y are present below the discharge inert film 21P, a discharge is hard to generate above the discharge inert film 21P. On the other hand, the exposed surface 11S of the cathode film 11 which is made of MgO having better secondary electron emission characteristic than the discharge inert film 21P is exposed to the discharge space 51S above the discharge gap portion DG and the transparent portions of the sustain discharge electrodes X and Y Therefore, as shown in FIG. 23, a surface discharge 50 generated between the paired sustain discharge electrodes X and Y is limited in an area where no discharge inert film 21P is present. This produces the following effects (1), (2) and (3).

(1) Since a formation area or the size of the surface discharge 50 between the paired sustain discharge electrodes X and Y can be reduced by increasing the area of the exposed surfaces 21SP of the discharge inert film 21P, it is possible to suppress discharge currents. This allows reduction of load of an external circuit to drive the sustain discharge electrodes X and Y, and a circuit cost can be thereby lowered.

(2) If no discharge inert film 21P is present, the surface discharge 50 between the paired sustain discharge electrodes X and Y extends up to above the bus electrode 2. At such a time, part of visible lights emitted from the phosphor 8 by an ultraviolet ray in generation of surface discharge 50 is blocked by the bus electrode 2 and not used as a display light. On the other hand, in the PDP 51P, since the surface discharge 50 is distributed only above the transparent portion where no bus electrode 2 is present, it is possible to reduce the ratio of blocked visible lights from the phosphor 8 to be blocked. This increases luminous efficiency.

(3) The surface discharges 50 on adjacent display lines L are separated by (the strip-like patterns of) the discharge inert film 21P more certainly. Therefore, it is possible to suppress a wrong discharge between the adjacent display lines L even if the electrode pair gap portion NG is narrowed. This is advantageous in achieving densely formation of the display lines L and higher definition of a display.

The discharge inert film which is so disposed as to mainly cover an area corresponding to the area between the adjacent display lines is disclosed in Japanese Patent Application Laid Open Gazette Nos. 10-255664, 10-333636, 2000-39866, 2000-100337, 2000-156166, 2001-147660 and 2001-176400 besides the above-discussed Japanese Patent Application Laid Open Gazette No. 9-102280.

The discharge inert film 21P is patterned by a vapor deposition lift-off method which is disclosed in the above Japanese Patent Application Laid Open Gazette Nos. 9-102280 and 2000-39866. In the patterning of the vapor deposition lift-off method, a resist (having a shape of inverted pattern of the discharge inert film 21P) is formed on a surface of the cathode film 11 by photolithography, a discharge inert material is so vapor-deposited as to cover the resist and finally the resist is lifted off. The vapor deposition lift-off method, which is based on the photolithography, has excellent accuracy in size and shape of the discharge inert film 21P and patterning position of the discharge inert film 21P relative to the pattern of the sustain discharge electrodes X and Y. Therefore, the above effects (1), (2) and (3) can be produced certainly also in a quantitative respect. Since costly processes of photolithography, vapor deposition and lift-off are executed, however, the vapor deposition lift-off method itself disadvantageously requires high cost.

Further, as another method of patterning the discharge inert film, a thick film paste containing a discharge inert material such as $Al_2O_3$ is applied directly on the cathode film by a screen printing method or the like and fired (or burned).

The Japanese Patent Application Laid Open Gazette No. 2000-156166, for example, discloses a method in which a protection film having low ratio of secondary electron emission, or the discharge inert material, which covers a surface of MgO above the adjoining sustain discharge electrode pair gap portion and does not cover above the sustain discharge electrodes, is formed of a dielectric glass containing a specific material such as $Al_2O_3$ by screen printing and firing.

Next, a method of driving the PDP 51P will be discussed, referring to FIGS. 24 and 25. Some of the methods of driving the surface discharge type AC-PDP including the discharge inert film 21P formed on the cathode film 11 are disclosed in Japanese Patent Application Laid Open Gazette Nos. 10-333636, 2000-39866 and 2001-147660.

FIG. 24 is a conceptual diagram showing an exemplary field division of screen in displaying a color image of 256-level gray scale. In this case, one screen (main frame) is constituted of 8 subfields SF (the first subfield SF1 to the eighth subfield SF8), and each subfield SF consists of a reset period REP, a writing period AD and a discharge sustain period SU. The discharge sustain period SU of each subfield SF is ranked (weighted), and specifically, the length of the discharge sustain period SU in the (N+1)-th subfield is almost twice as long as that of the N-th subfield, where N is a natural number.

In a cell selected by application of a pulse-like voltage to its address electrode 6 during the writing period AD of each subfield, sustain discharges as much as the applied sustain pulses are generated during the discharge sustain period SU. Since the number of sustain pulses is almost proportional to the length of the discharge sustain period SU, the luminescence intensity of the cell selected during the writing period AD is almost doubled as the subfield SF advances by one. At this time, by combination of light emission and no light emission in the subfields SF1 to SF8 (in other words, selection and non-selection of the subfields SF1 to SF8), it is possible to control the luminescence intensity of $2^8$=256 levels. In other words, a display of 256-level gray scale can be achieved in one main frame.

FIG. 25 is a timing chart (for one subfield SF) used for explaining a method of driving the PDP 51P in the background art. In the driving method, the reset period REP consists of the first, second and third reset periods RE1, RE2P and RE3. In the first reset period RE1, a first priming pulse is given to all the discharge cells by applying a pulse P1 having a writing potential Vw to all the address electrodes W. In the subsequent second reset period RE2P, a second priming pulse is given to all the discharge cells by applying a pulse P2 having the writing potential Vw to all the address electrodes W and applying a pulse P3P having a potential Vxh to all the sustain discharge electrodes X. With the first and second priming pulses, priming discharges for stabilizing the following operation are generated between the paired sustain discharge electrodes X and Y in all the discharge cells. After that, in the third reset period RE3, wall charges are initialized in all the discharge cells by applying an erase pulse to the sustain discharge electrodes X and Y. FIG. 25 shows a case where a narrow erase pulse P4 is applied as the erase pulse to the sustain discharge electrodes X. Potentials Vxm and Vym of FIG. 25 are intermediate potentials and a potential Vyb is a scanbase potential.

Subsequently, in the writing period AD, n (n is a natural number) sustain discharge electrodes Y (Y1 to Yn) are sequentially switched to sequentially select (scan) the display lines L and an image signal indicating selection/non-selection of the corresponding cell is applied to each address electrode W in synchronization with this sequential selection (scan). Thus, a writing discharge is generated in the sustain discharge electrode pair X and Y of the selected cell and the wall charges are accumulated therein.

Next, in the discharge sustain period SU, a sustain pulse is alternatingly applied predetermined times to the sustain discharge electrodes X and Y. With this application, in the cell selected in the preceding writing period AD, a predetermined number of sustain discharges are generated by synergism of the sustain pulse and the wall charges. On the other hand, in the cell not selected in the writing period AD, which does not have sufficient wall charge which is needed to start the sustain discharge, no sustain discharge is generated. Thus, a desired image can be obtained.

The technique relevant to a PDP is shown in e.g., the following patent documents 1 to 21 and non-patent documents 1 to 5. Further, the patent document 3 corresponds to the patent document 2, the patent document 5 corresponds to the patent document 4, and the patent document 15 corresponds to the patent document 14.

(Patent Document 1) Japanese Patent Application Laid Open Gazette No. 9-102280, (Patent Document 2) Japanese Patent Application Laid Open Gazette No. 10-255664, (Patent Document 3) U.S. Pat. No. 6,137,226, (Patent Document 4) Japanese Patent Application Laid Open Gazette No. 10-333636, (Patent Document 5) U.S. Pat. No. 6,031,329, (Patent Document 6) Japanese Patent Application Laid Open Gazette No. 2000-39866, (Patent Document 7) Japanese Patent Application Laid Open Gazette No. 2001-147660, (Patent Document 8) Japanese Patent Application Laid Open Gazette No. 2002-56775, (Patent Document 9) Japanese Patent Application Laid Open Gazette No. 10-149774, (Patent Document 10) Japanese Patent Application Laid Open Gazette No. 2001-160361, (Patent Document 11) Japanese Patent Application Laid Open Gazette No. 2000-100337, (Patent Document 12) Japanese Patent Application Laid Open Gazette No. 2000-156166, (Patent Document 13) Japanese Patent Application Laid Open Gazette No. 2001-176400, (Patent Document 14) Japanese Patent Application Laid Open Gazette No. 2000-113828, (Patent Document 15) EP No. 993017 A1, (Patent Document 16) Japanese Patent Application Laid Open Gazette No. 9-237580, (Patent Document 17) Japanese Patent Application Laid Open Gazette No. 2000-195431, (Patent Document 18) Japanese Patent Application Laid Open Gazette No. 2000-311612, (Patent Document 19) Japanese Patent Application Laid Open Gazette No. 10-233171, (Patent Document 20) Japanese Patent Application Laid Open Gazette No. 2001-183999, (Patent Document 21) Japanese Patent Application Laid Open Gazette No. 2001-15034, (Patent Document 22) Japanese Patent Application Laid Open Gazette No. 11-149873, and (Patent Document 23) Japanese Patent Application Laid Open Gazette No. 2002-83545.

(Non-Patent Document 1) Kimio Amemiya, Toshihiro Komaki, Takashi Nishio, High Luminous Efficiency and High Definition Coplanar AC-PDP with "T"-shaped Electrodes, "Proceedings of the 5th International Display Workshops (IDW '98)". pp. 531–534.

(Non-Patent Document 2) Y. Hashimoto, Y. Seo, O. Toyoda, K. Betsui, T. Kosaka, and F. Namiki, High-Luminance and Highly Luminous-Efficient AC-PDP with DelTA Cell Structure, "Society for Information Display 2001 (SID 01) DIGEST", pp. 1328–1331.

(Non-Patent Document 3) Y. Tanaka, H. Honma, H. Hasegawa, N. Aibara, T. Nakamura, A new progressive driving scheme for a PDP with "CASTLE" structure, "Proceedings of The 21st International Display Research Conference in conjunction with The 8th International Display Workshops (Asia Display/IDW '01)", pp. 869–872.

(Non-Patent Document 4) H. Hirakawa, T. Shiizaki, H. Nakahara, Y. Kawanami, M. Tajima, An Advanced Progressive Driving Method for PDP with Horizontal Barrier Ribs and Common Electrodes. "Proceedings of The 21st International Display Research Conference in conjunction with The 8th International Display Workshops (Asia Display/IDW '01)", pp. 1757–1758.

(Non-Patent Document 5) T. Komaki, H. Taniguchi, K. Amemiya, High Luminance AC-PDPs with Waffle-structured Barrier Ribs, "Proceedings of the 6th International Display Workshops (IDW '99)", pp. 587–590.

(Non-Patent Document 6) Jae-Young Lee, Min-Nung Hur, Yun-Gi Kim, Jae-Hwa Ryu, Jung-Soo Cho, Chung-Hoo Park, A Study on the New Shaped Align-Free Sustain Electrodes Showing High Luminous Efficiency in AC PDPs, "Proceedings of The 7th International Display Workshops (IDW '00)", pp. 623–626.

As discussed above, in the Japanese Patent Application Laid Open Gazette No. 2000-156166 disclosed is the method of forming the discharge inert film of a dielectric glass containing a specific material such as $Al_2O_3$ by screen printing and firing. When the inventor of the present invention, however, tries to form a discharge inert film, as the discharge inert film 21P of the PDP 51P, of a dielectric glass whose main material is $TiO_2$ or $Al_2O_3$ by screen printing, with a thickness of several $\mu$m, it is found that the minimum sustain pulse voltage required for a sustain discharge between the paired sustain discharge electrodes X and Y (usually, about 150 V) becomes higher than usual by about 100 V and a practical driving is difficult. Moreover, even when the discharge inert film is formed by the same method in part of the adjoining sustain discharge electrode pair gap portion away from a formation area of the surface discharge between the sustain discharge electrodes X and Y by a predetermined distance without covering the upper portions of the sustain discharge electrodes X and Y, the same result is obtained.

It is further found from the examination by the inventor of the present invention that applying the driving method of FIG. 25 to the PDP 51P including the discharge inert film 21P formed by the above-discussed vapor deposition lift-off method causes a problem that sustain discharge is not generated well enough during the discharge sustain period SU even in the cell selected in the writing period AD.

SUMMARY OF THE INVENTION

It is an object of the present invention to provide a plasma display panel substrate and a PDP which can suppress a significant increase in the minimum sustain pulse voltage required for a sustain discharge.

It is another object of the present invention to provide a plasma display panel substrate and a PDP which can solve the problem caused in forming a discharge inert film by the screen printing method.

It is still another object of the present invention to provide a plasma display panel substrate and a PDP which can reduce a peak load of a driving device.

It is yet another object of the present invention to provide a plasma display panel substrate and a PDP which can increase luminous efficiency.

It is further object of the present invention to provide a PDP which can improve color balance of display.

It is yet still further object of the present invention to provide a plasma display device which can prevent extension of surface discharge generated on a plasma display panel substrate up to exposed surfaces of the discharge inert film.

According to a first aspect of the present invention, the plasma display panel includes a first substrate (a plasma display panel substrate), a second substrate opposed to the first substrate and a barrier rib disposed between the first substrate and the second substrate. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to areas between the plurality of display lines. The exposed surfaces of the discharge inert film and those of the cathode film are adjacent to one another as two-dimensionally viewed. The discharge inert film is made of an aggregate of fine particles which does not substantially contain any inorganic binder.

Since the discharge inert film is made of an aggregate of fine particles which does not substantially contain any inorganic binder, the discharge inert film can be so disposed as not to be bonded to the cathode film. This makes it possible to provide a plasma display panel (PDP) which does not remarkably increase the minimum sustain pulse voltage required for the sustain discharge generated between the first electrodes. Further, since the discharge inert film is made of an aggregate of fine particles which does not substantially contain any inorganic binder, a pressure exerted on a contact portion between the discharge inert film and the barrier rib is uniformized, to relieve a pinpoint pressure to be exerted. Therefore, the PDP using the present plasma display panel substrate can prevent any pixel defect from being caused by a breakage of the barrier rib. Furthermore, the discharge inert film which produces the above effect can be formed by the screen printing method at low cost and is hard to be peeled naturally.

According to a second aspect of the present invention, the plasma display panel includes a first substrate (a plasma display panel substrate), a second substrate opposed to the first substrate and a barrier rib disposed between the first substrate and the second substrate. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and at least one discharge gap adjoining portion. The bus portion extends along the second direction. The plurality of bridge-building portions extend from the bus portion towards at least one of the plurality of discharge gap portions which the bus portion adjoins. At least one discharge gap adjoining portion electrically is connected to the bus portion through at least one of the plurality of bridge-building portions and disposed adjacently to the at least one discharge gap portion. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to areas between the plurality of display lines. The exposed surfaces of the discharge inert film and those of the cathode film are adjacent to one another as two-dimensionally viewed. The discharge inert film is formed by printing and firing a paste-like material, and has a pattern edge at a position away from the at least one discharge gap adjoining portion by about 50 $\mu$m or more as two-dimensionally viewed.

Since the discharge inert film has a pattern edge at a position away from the discharge gap adjoining portion by about 50 $\mu$m or more as two-dimensionally viewed, it is possible to prevent the discharge inert film from covering the discharge gap adjoining portion. Therefore, even if misalignment of forming position or unevenness is caused to some degree in the pattern edge of the discharge inert film by the screen printing method, it is possible to provide a PDP in which the discharge at the discharge gap adjoining portion resists being affected by the above misalignment or the like. Since this can suppress increase and decrease in discharge current per discharge cell, it is possible to improve reproducibility and uniformity in a plane in terms of display performance. Further, since the inconsistencies in magnitude of the discharge current among the discharge cells can be reduced, it is possible to reduce the luminance unevenness corresponding to the inconsistencies in density of the meshed screen printing plate. Furthermore, by setting various conditions of printing so that the pattern edge of the discharge inert film should be away from the discharge gap adjoining portion by about 50 $\mu$m or more as two-dimensionally viewed, it is possible to manufacture a plasma display panel substrate with good yield (on average) which satisfies the above positional relation (the discharge gap adjoining portion is not covered with the discharge inert film) even if printing misalignment is caused.

According to a third aspect of the present invention, the plasma display panel includes a first substrate (a plasma display panel substrate), a second substrate opposed to the first substrate and a barrier rib disposed between the first substrate and the second substrate. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and at least one discharge gap adjoining portion. The bus portion extends along the second direction. The plurality of bridge-building portions extend from the bus portion towards at least one of the plurality of discharge gap portions which the bus portion adjoins. At least one discharge gap adjoining portion electrically is connected to the bus portion through at least one of the plurality of bridge-building portions and disposed adjacently to the at least one discharge gap portion. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to areas between the plurality of display lines. The exposed surfaces of the discharge inert film and those of the cathode film are adjacent to one another as two-dimensionally viewed. The discharge inert film has a pattern edge at a position where a distance from the at least one discharge gap adjoining portion is longer than that from the bus portion as two-dimensionally viewed.

The discharge inert film is formed so that the distance from the discharge gap adjoining portion should be longer than that from the bus portion as two-dimensionally viewed. When the conditions of the printing are so set as to satisfy such a positional relation as above, even if the print position is misaligned, the pattern of the discharge inert film does not extend to the discharge gap adjoining portion as two-dimensionally viewed, and if the bus portion is out of the pattern of the discharge inert film to some degree as two-dimensionally viewed, no discharge is generated at the bus portion. Therefore, it is possible to manufacture a plasma display panel substrate with good yield (on average).

According to a fourth aspect of the present invention, the plasma display panel includes a first substrate (a plasma display panel substrate), a second substrate opposed to the first substrate and a barrier rib disposed between the first substrate and the second substrate. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween. The exposed surfaces of the discharge inert film and those of the cathode film are adjacent to one another as two-dimensionally viewed. The discharge inert film has exposed surfaces in areas thereof corresponding to areas between the plurality of display lines and areas thereof which part the plurality of first electrodes along the first direction as two-dimensionally viewed.

In a PDP using the present plasma display panel substrate, it is possible to extend the surface discharge between the first electrodes from a portion near the discharge gap portion to that away therefrom step by step. Therefore, since a momentary peak current of discharge can be reduced, it is possible to reduce the peak load of the driving device in the PDP. As a result, the cost for the driving device can be lowered. Further, since a discharge (plasma) generated on the exposed surface of the cathode film extends as much as that in the case where no exposed surface of the discharge inert film is formed in an area that parts the first electrode in the first direction, the amount of ultraviolet rays momentarily generated is almost the same both in the cases where the exposed surfaces of the discharge inert film are formed and where no exposed surface is formed. In other words, since the efficiency of generation of ultraviolet rays with respect to energy thrown for discharge increases, it is possible to provide a PDP with high luminous efficiency. In the present plasma display panel substrate, the first electrode below a portion of the discharge inert film which is provided to part the first electrode is not parted. Therefore, the present plasma display panel substrate does not cause a remarkable increase in firing voltage.

According to a fifth aspect of the present invention, the plasma display panel includes first and second substrates opposed to each other and a barrier rib disposed between the first and second substrates. The first substrate includes a substrate and a plurality of first electrodes. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and a plurality of discharge gap adjoining portions. The bus portion extends along the second direction. The plurality of bridge-building portions extend from the bus portion towards at least one of the plurality of discharge gap portions which the bus portion adjoins. The plurality of discharge gap adjoining portions are electrically connected to the bus portion through the plurality of bridge-building portions and disposed adjacently to the at least one discharge gap portion. Areas between ones of the plurality of discharge gap adjoining portions which are arranged along the second direction are not opposed to the barrier rib as two-dimensionally viewed.

Though the areas between ones of the plurality of discharge gap adjoining portions which are arranged along the second direction are not opposed to the barrier rib as two-dimensionally viewed, the plasma generated in the discharge spaces above the discharge gap adjoining portions also extends to the above areas between discharge gap adjoining portions. Accordingly, the amount of ultraviolet rays emitted from the plasma can be increased relatively to the discharge current. Therefore, it is possible to improve the luminous efficiency.

According to a sixth aspect of the present invention, the plasma display panel includes first and second substrates opposed to each other. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to areas between the plurality of display lines. The exposed surfaces of the discharge inert film and those of the cathode film are adjacent to one another as two-dimensionally viewed. The plasma display panel further includes a plurality of discharge cells arranged on the plurality of display lines. The exposed surfaces of the discharge inert film and those of the cathode film are patterned so that the size of surface discharge generated on the first substrate in each of the plurality of discharge cells depends on the luminescent color of the each of plurality of discharge cells.

Since the exposed surfaces of the discharge inert film and those of the cathode film are patterned so that the size of surface discharge generated on the first substrate in each of the plurality of discharge cells depends on the luminescent color of each of plurality of discharge cells, the luminescence intensity can be controlled by luminescent colors. It is thereby possible to improve the color balance of display.

According to a seventh aspect of the present invention, the plasma display panel includes first and second substrates opposed to each other and a barrier rib disposed between the first and second substrates. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and a plurality of discharge gap adjoining portions. The bus portion extends along the second direction. The plurality of bridge-building portions extend from the bus portion towards at least one of the plurality of discharge gap portions which the bus portion adjoins. The plurality of discharge gap adjoining portions are electrically connected to the bus portion through the plurality of bridge-building portions and disposed adjacently to the at least one discharge gap portion. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to said bus portions. The exposed surfaces of the discharge inert film and those of the cathode film are adjacent to one another as two-dimensionally viewed. The barrier rib includes at least a plurality of first components extending along the first direction as two-dimensionally viewed. At least one of the plurality of discharge gap adjoining portions has such a shape as to make the size in the first direction of the discharge gap portion adjacent to the discharge gap adjoining portion wider at a portion of an area defined by adjacent ones of the plurality of first components of the barrier rib, which is near the first components, than at a center portion in the second direction of the area.

The strength of the electric field generated in the discharge space above the discharge gap portion can be made stronger at the central portion of the discharge cell away from the barrier rib than at a portion near the barrier rib. Since the surface discharge by the first electrode thereby extends from the central portion as a starting point and the portion near the barrier rib hardly ever become the starting point, the rate of loss in energy of plasma decreases. Moreover, since an extension area of plasma can be made larger at the portion near the barrier rib, relatively to the area of the first electrode which actually generates the surface discharge, the luminous efficiency is improved. Further, even if the bus portions are made closer to each other between adjacent the display lines, the discharge at the bus portion is suppressed by the discharge inert film and a wrong discharge can be prevented, to improve the luminous efficiency. Furthermore, since the bus portion and the discharge gap adjoining portion are provided away from each other with the bridge-building portions interposed therebetween, no discharge is generated at the bus portion even if the forming position of the discharge inert film or the barrier rib is misaligned to some degrees, and this is advantageous in widening of display area.

According to an eighth aspect of the present invention, the plasma display panel includes first and second substrates opposed to each other and a barrier rib disposed between the first and second substrates. The first substrate includes a substrate, a plurality of first electrodes, a dielectric layer and a cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and a plurality of discharge gap adjoining portions. The bus portion extends along the second direction. The plurality of bridge-building portions extend from the bus portion towards at least one of the plurality of discharge gap portions which the bus portion adjoins. The plurality of discharge gap adjoining portions are electrically connected to the bus portion through the plurality of bridge-building portions and disposed adjacently to the at least one discharge gap portion. The plurality of discharge gap adjoining portions each include a transparent electrode. The dielectric layer is disposed on the substrate, covering the plurality of first electrodes. The cathode film is opposed to the substrate with the dielectric layer interposed therebetween and has exposed surfaces in areas thereof corresponding to the discharge gap adjoining portions. The barrier rib includes at least a plurality of first components extending along the first direction and a plurality of second components extending along the second direction and opposed to the bus portions as two-dimensionally viewed. At least one of the plurality of discharge gap adjoining portions has such a shape as to make the size in the first direction of the discharge gap portion adjacent to the discharge gap adjoining portion wider at a portion of an area defined by adjacent ones of the plurality of first components of the barrier rib, which is near the first components, than at a center portion in the second direction of the area.

The strength of the electric field generated in the discharge space above the discharge gap portion can be made stronger at the central portion of the discharge cell away from the first component of the barrier rib than at a portion near the first component of the barrier rib. Since the surface discharge by the first electrode thereby extends from the central portion as a starting point and the portion near the first component of the barrier rib hardly ever become the starting point, the rate of loss in energy of plasma decreases. Moreover, since an extension area of plasma can be made larger at the portion near the first component of the barrier rib, relatively to the area of the first electrode which actually generates the surface discharge, the luminous efficiency is improved. Further, even if the bus portions are made closer to each other between adjacent the display lines, the discharge at the bus portion is suppressed by the second component of the barrier rib and a wrong discharge can be prevented, to improve the luminous efficiency. Furthermore, since the discharge gap adjoining portion includes the transparent electrode, it is possible to prevent the discharge gap adjoining portion from blocking light emission, and as a result, the luminous efficiency can be improved.

According to a ninth aspect of the present invention, the plasma display panel includes first and second substrates opposed to each other and a barrier rib disposed between the first and second substrates. The barrier rib includes at least a plurality of first components extending along the first direction. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. Each of the plurality of first electrodes includes a bus portion, a plurality of bridge-building portions and at least one discharge gap adjoining portion. The bus portion extends along the second direction. The plurality of bridge-building portions extend from the bus portion towards at least one of the plurality of discharge gap portions which the bus portion adjoins. The at least one discharge gap adjoining portion is electrically connected to the bus portion through at least one of the plurality of bridge-building portions and disposed adjacently to the at least one discharge gap portion. The dielectric layer is disposed on the substrate, covering the plurality of first electrodes. The cathode film is opposed to the substrate with the dielectric layer interposed therebetween. The discharge inert film is opposed to the substrate with the dielectric layer interposed therebetween and has exposed surfaces in areas thereof corresponding to the bus portions. The size of the bridge-building portions in the second direction is not larger than about twice a covering thickness of the dielectric layer and the cathode film which cover the bridge-building portions.

Since formation of the electric field in the discharge space opposed to the bridge-building portions with the covering thickness of the cathode film and the discharge inert film interposed therebetween becomes weaker, it is possible to suppress extension of discharge to the bridge-building portions and start of discharge at the bridge-building portions. This prevents extension of discharge to the bus portion through the bridge-building portions and the discharge is generated only at the discharge gap adjoining portion, and it is therefore possible to improve the luminous efficiency and response of addressing discharge (writing discharge). Further, since the discharge at the bridge-building portions can be suppressed, the precision prescribed on alignment between the first components of the barrier rib and the bridge-building portions is relieved. This is advantageous in widening of display area.

According to a tenth aspect of the present invention, the plasma display device includes the plasma display panel as defined in any one of the first to ninth aspects and a driving device for driving the plasma display panel. The second substrate includes a plurality of second electrodes extending along a direction intersecting the plurality of first electrodes. An opposite discharge between the each of the first electrodes and each of the second electrodes is generated at a portion of the first electrode near the discharge gap portion as two-dimensionally viewed in an addressing operation by the driving device.

Since the opposite discharge between the first electrode and the second electrode is generated at the portion near the discharge gap portion, it becomes easier to induce an addressing surface discharge (writing surface discharge) by the first electrode with the portion near the discharge gap portion as a starting point. Therefore, the response of addressing operation (writing operation) is improved.

According to an eleventh aspect of the present invention, the plasma display device includes a plasma display panel including first and second substrates opposed to each other and a driving device for driving the plasma display panel. The first substrate includes a substrate, a plurality of first electrodes, a dielectric layer, a cathode film and a discharge inert film whose secondary electron emission characteristic is lower than that of the cathode film. The plurality of first electrodes are arranged on the substrate along a first direction, extending along a second direction intersecting the first direction. The plurality of first electrodes define a plurality of display lines extending along the second direction. The plurality of gap portions provided between the plurality of first electrodes include at least a plurality of discharge gap portions corresponding to the plurality of display lines. The dielectric layer is disposed on the substrate, covering the plurality of first electrodes. The cathode film is opposed to the substrate with the dielectric layer interposed therebetween and has exposed surfaces in areas thereof corresponding to the plurality of display lines. The discharge inert film is opposed to the substrate with the dielectric layer interposed therebetween and has exposed surfaces in areas thereof corresponding to areas between the plurality of display lines. The exposed surfaces of the discharge inert film and those of the cathode film are adjacent to one another as two-dimensionally viewed. The driving device gives a predetermined potential difference across adjacent ones of the plurality of first electrodes during a reset period. The plasma display device has a constitution to suppress extension of a surface discharge to the exposed surfaces of the discharge inert film, the surface discharge is generated on the first substrate by supplying the predetermined potential difference during the reset period.

The predetermined potential difference is supplied between adjacent first electrodes during the reset period, while extension of the surface discharge generated on the first substrate to the exposed surface of the discharge inert film is suppressed. This prevents accumulation of wall charges with probability in the discharge inert film through the priming discharge, to stabilize initialization of the wall charges after the above supply of predetermined potential difference or the above generation of surface discharge. As a result, it is possible to ensure the cell selectivity during the writing period after the reset period and surely generate the sustain discharge in the selected discharge cell during the discharge sustain period after the writing period.

These and other objects, features, aspects and advantages of the present invention will become more apparent from the following detailed description of the present invention when taken in conjunction with the accompanying drawings.

DESCRIPTION OF THE PREFERRED EMBODIMENTS

The First Preferred Embodiment

As discussed above, when the inventor of the present invention tries to form a discharge inert film, as the discharge inert film 21P of the PDP 51P, of a dielectric glass whose main material is $TiO_2$ or $Al_2O_3$ by screen printing, with a thickness of several $\mu$m, it is found that the minimum sustain pulse voltage required for a sustain discharge between the paired sustain discharge electrodes X and Y becomes higher than usual and a practical driving is difficult.

Though detailed mechanism is uncertain since this is a phenomenon which never occurs in the discharge inert film 21P made of $TiO_2$2 or $Al_2O_3$, which is patterned by the vapor deposition lift-off method, this is thought to be caused by formation of a discharge inert film of a dielectric glass whose main material is $TiO_2$ or $Al_2O_3$ by screen printing to have a thickness of several $\mu$m.

Then, the first preferred embodiment is intended to provide a PDP which can solve such a problem and a plasma display device including the same.

Figure 1:
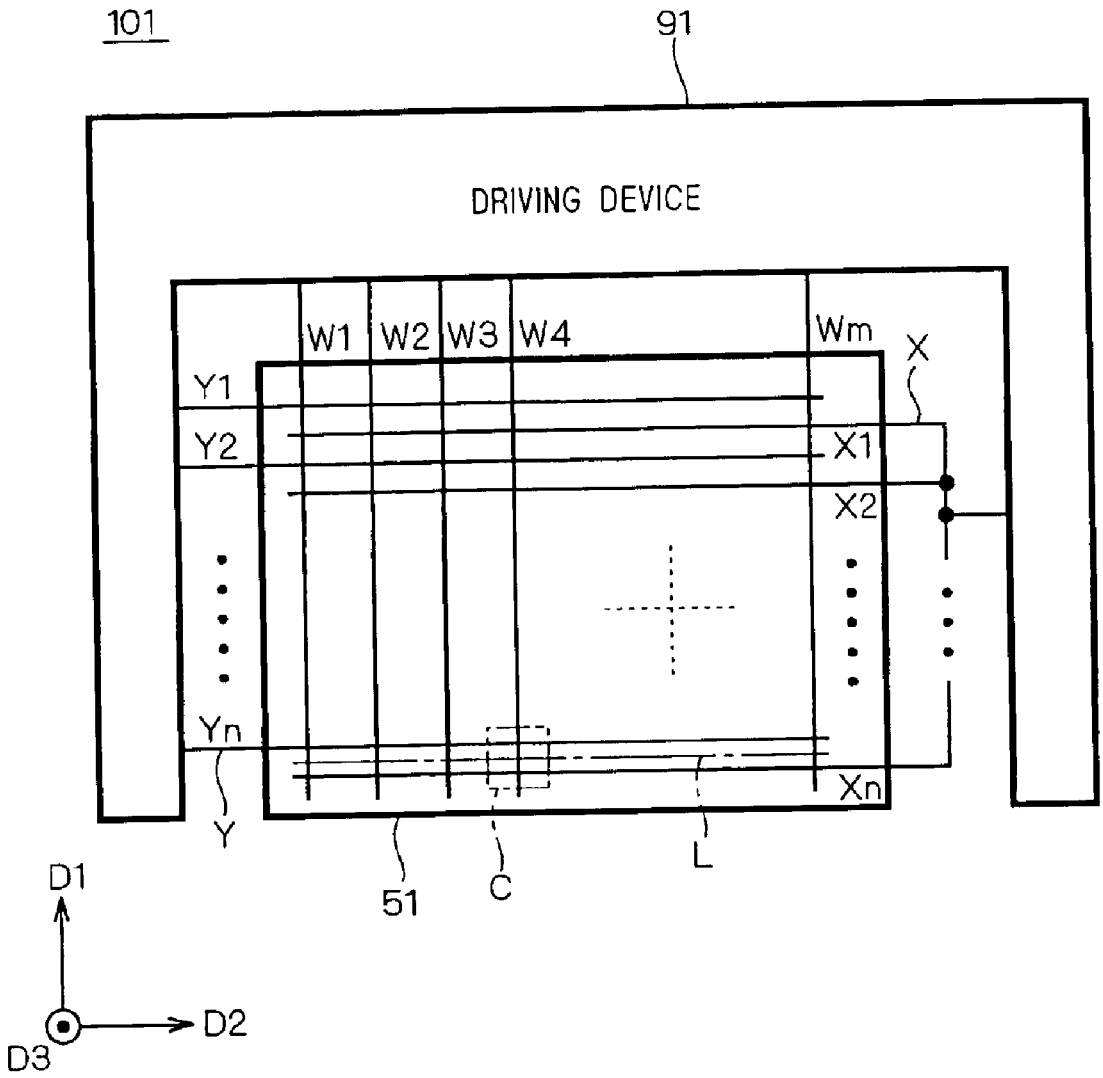
FIG. 1 is a block diagram illustrating a plasma display device in accordance with a first preferred embodiment of the present invention.

As shown in the block diagram of FIG. 1, a plasma display device 101 of the first preferred embodiment includes a PDP 51 and a driving device 91 for driving the PDP 51 by supplying electrodes X (X1 to Xn), Y (Y1 to Yn) and W (W1 to Wm) with predetermined potentials. In the plasma display device 101, all the sustain discharge electrodes X1 to Xn of the PDP 51 are connected to one another and then connected in common to the driving device 91.

Figure 2:
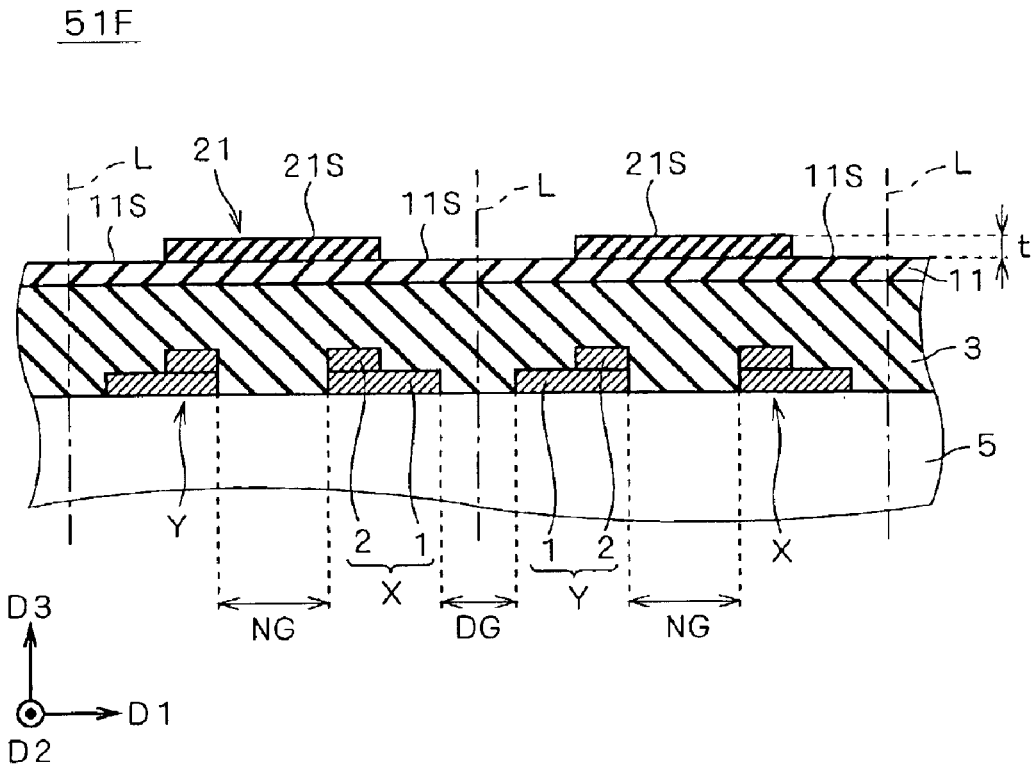
FIG. 2 is a cross section illustrating a first front substrate in accordance with the first preferred embodiment.
Figure 23:
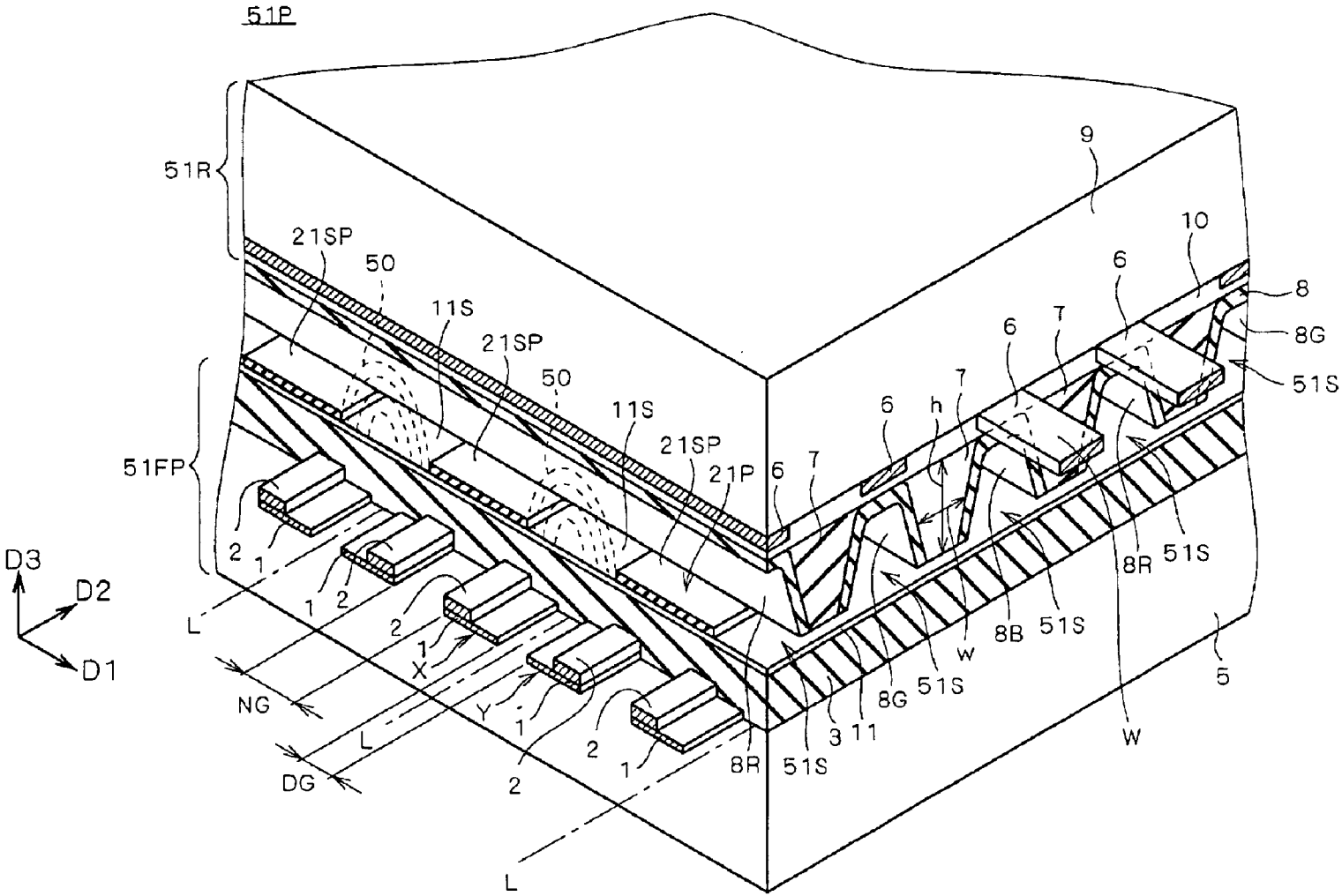
FIG. 23 (PRIOR ART)
FIG. 23 is a perspective view illustrating a PDP including a discharge inert film.
Figure 24:
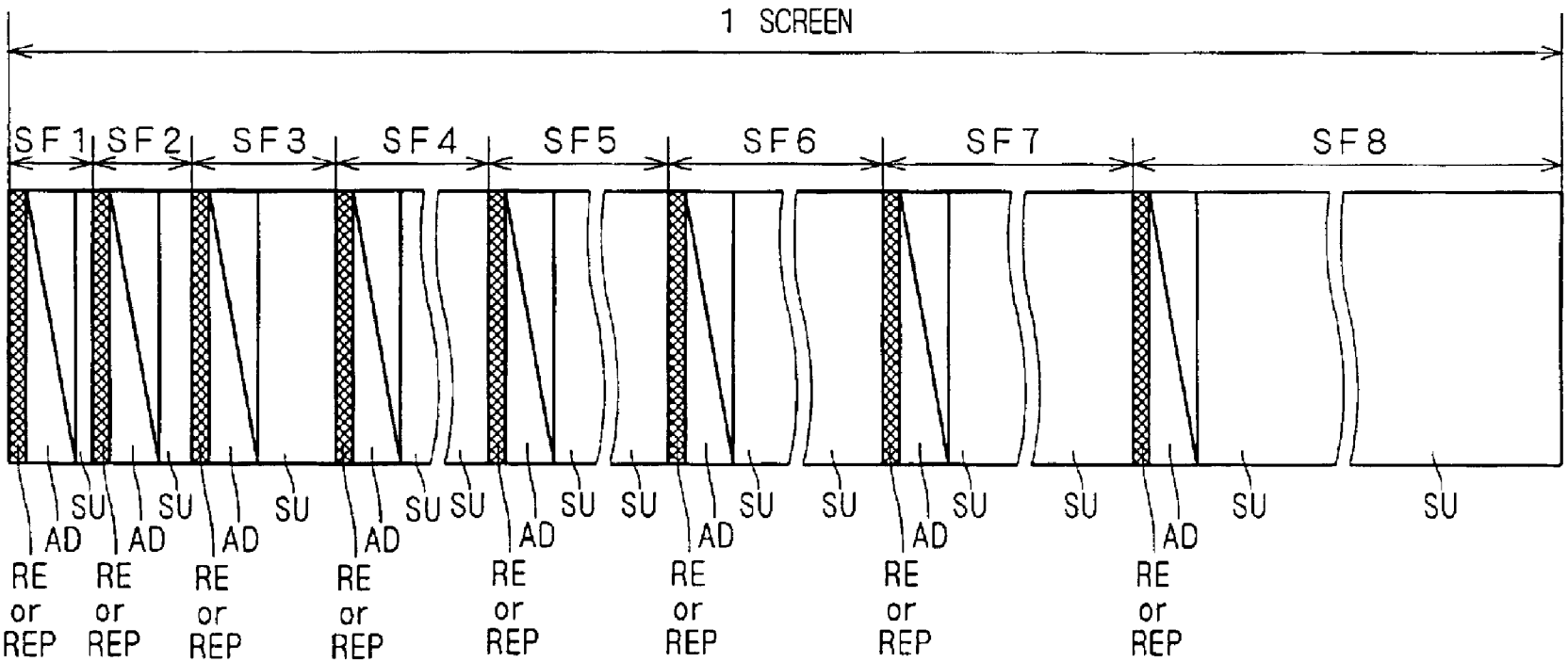
FIG. 24 is a view illustrating a subfield division of display screen.

The PDP 51 of the first preferred embodiment has a structure in which a front substrate (or plasma display panel substrate or first substrate) 51F of the first preferred embodiment shown in the cross section of FIG. 2 is provided instead of the front substrate 51FP of the PDP 51P shown in FIG. 23.

The front substrate 51F of the first preferred embodiment has basically the same structure as the front substrate 51FP of FIG. 23 except that a discharge inert film 21 of the first preferred embodiment is provided instead of the discharge inert film 21P. In other words, the front substrate 51F and the rear (or back) substrate (or second substrate) 51R having a plurality of address electrodes (or second electrodes) 6 (or W) are layered with the barrier rib 7 and the phosphor 8 interposed therebetween in the third direction D3 intersecting (herein, orthogonal to) both the first direction D1 and the second direction D2, and sealed at their rim. Further, the front substrate 51F and the rear substrate 51R are arranged so that the sustain discharge electrodes X and Y and the address electrodes 6 (grade-separately) intersect.

The front substrate 51F includes the front glass substrate (or substrate) 5, a plurality of sustain discharge electrodes (or a plurality of first electrodes) X and Y, the dielectric layer 3, the cathode film 11 and the discharge inert film 21.

In more detail, the sustain discharge electrodes X and Y are aligned on the front glass substrate 5 in the first direction D1 and extend along the second direction intersecting (herein, or orthogonal to) the first direction D1, to define a plurality of display lines L extending along the second direction D2. More specifically, two sustain discharge electrodes X and Y which are adjacent to each other with the discharge gap portion DG interposed therebetween and are paired define one display line L extending along the second direction D2. Like in FIG. 23, the display line L is schematically indicated by an alternate long and short dash line (or chain line) in FIG. 2, which is present between the pair of sustain discharge electrodes X and Y or in the discharge gap portion DG. In this case, the discharge gap portions DG extending along the second direction D2 correspond to the display lines L, respectively. Further, two sustain discharge electrodes X and Y which are not paired are disposed between adjacent display lines L with an adjoining sustain discharge electrode pair gap portion (or electrode pair gap portion) NG interposed therebetween. In other words, either the discharge gap portion DG or the adjoining sustain discharge electrode pair gap portion NG is provided between adjacent sustain discharge electrodes X and Y in the front substrate 51F.

Like in the front substrate 51FP of FIG. 23, each of the sustain discharge electrodes X and Y is constituted of the transparent electrode 1 and the bus electrode 2, and the bus electrode 2 is disposed on a position farther away from the discharge gap portion DG. In areas between adjacent transparent electrodes 1, the discharge gap portion DG and the electrode pair gap portion NG are defined.

In the PDP 51, a (grade-separated) intersection between the sustain discharge electrode pair X and Y and the address electrode 6 (or W) or an intersection between the discharge space 51S and the display line L corresponds to one discharge cell (hereinafter, also referred to simply as "cell") C (see FIG. 1). In other words, a plurality of discharge cells C are arranged on each display line L (conversely, a plurality of cells C arranged in the second direction D2 constitute one display line L) and a display area of the PDP 51 is formed of a plurality of discharge cells C arranged in matrix on the whole.

The dielectric layer 3 is entirely formed on the front glass substrate 5, covering the sustain discharge electrodes X and Y, and the cathode film 11 is opposed to the front glass substrate 5 with the dielectric layer 3 interposed therebetween, being entirely in contact with the dielectric layer 3. The discharge inert film 21 is opposed to the front glass substrate 5 with the dielectric layer 3 and the cathode film 11 interposed therebetween, being contact with the cathode film 11. The secondary electron emission characteristic of the discharge inert film 21 is lower than that of the cathode film 11.

The discharge inert film 21 of the front substrate 51 F has the same pattern as the discharge inert film 21P of FIG. 23. Specifically, the discharge inert film 21 has a plurality of strip-like patterns, being in a stripe shape. Each strip-like pattern of the discharge inert film 21 is disposed, as a main surface of the front substrate 51F or the front glass substrate 5 is two-dimensionally viewed, in an area corresponding to the area between two adjacent display lines L, or more specifically, on the electrode pair gap portion NG between not-paired two sustain discharge electrodes X and Y and on respective parts of the two sustain discharge electrodes X and Y which are contiguous to the electrode pair gap portion NG (herein, the whole parts of metal electrode portions where the bus electrodes 2 are disposed).

Since the discharge inert film 21 having such a pattern is formed on the cathode film 11, areas of the cathode film 11 which correspond to a plurality of display lines L, or more specifically, areas on the discharge gap portion DG and respective parts of the paired sustain discharge electrodes X and Y which are contiguous to the discharge gap portion DG (herein, the whole parts of transparent portions where the bus electrodes 2 are not disposed) are exposed as the front substrate 51F is two-dimensionally viewed.

In this case, as two-dimensionally viewed, an exposed surfaces 11S of the cathode film 11 and an exposed surfaces 21S of the discharge inert film 21 adjoin each other, and (at least a display area of) an exposed surface of the front substrate 51F on the side facing the rear substrate 51R is occupied by the exposed surfaces 11S and 21S.

Further, (the exposed surface 21S of) the discharge inert film 21 may be provided, e.g., only on the electrode pair gap portion NG or may be provided on the electrode pair gap portion NG and on parts of the metal electrode portions of the sustain discharge electrodes X and Y where the bus electrodes 2 are disposed, only if in the area corresponding to the area between two adjacent display lines L as the front substrate 51F is two-dimensionally viewed.

In particular, the discharge inert film 21 is made of an aggregate of fine particles not substantially containing glass component, i.e., inorganic binder. The discharge inert film of the present invention is markedly different in this point from the discharge inert film made of a dielectric glass, which is disclosed in the above-discussed Japanese Patent Application Laid Open Gazette No. 2000-156166.

In more detail, a thick film paste not substantially containing the inorganic binder is patterned on the cathode film 11 by screen printing and fired (or burned), to form the discharge inert film 21 in the PDP 51 and the front substrate 51F.

The thick film paste is generally made of (i) an organic component which remains as a film material after firing and (ii) an organic component which is burned in firing (or burning) process not to remain as a film material. The above inorganic component contained in, the thick film paste for the discharge inert film 21 contains at least one kind of fine particle of discharge inert material such as $Al_2O_3$, $TiO_2$ or $SiO_2$ as a main component, and on the other hand, the content of glass component such as PbO, ZnO or $B_2O_3$ is zero or few degree, if not zero, which can not substantially exert its fixative power as a binder after being fired. As a result, the discharge inert film 21 after being fired is substantially made of an aggregate of fine particles of above discharge inert material such as $Al_2O_3$, and has no strong binding among the fine particles or no strong cohesion to the underlying cathode film 11. The discharge inert film 21, figuratively speaking, has a condition similar to that of the phosphor 8. Specifically, a general phosphor of PDP, including the phosphor 8, is made of a fired thick film paste containing no inorganic binder and constituted of an aggregate of fine particles of fluorescent material, and the discharge inert film 21 has the same condition.

It is desirable that the firing temperature for the discharge inert film 21 should be low to such an extent as to avoid a situation where the dielectric layer 3 which is generally made of a low-melting glass can not resist a stress from the cathode film 11 to be remarkably deformed. In other words, it is desirable that the temperature should be set at such a degree as to avoid a situation where the dielectric layer 3 becomes so softened that such a marked crack is made on the cathode film 11 as to damage its appearance. Accordingly, the discharge inert film 21 has to be fired at a temperature lower than the softening point of the dielectric layer 3 made of a low-melting glass by about 50° C. or more. For example, assuming that the softening point of the dielectric layer 3 is 520° C., it is desirable that the firing temperature for the discharge inert film 21 should be 470° C. or lower, and that a paste which is a raw material of the discharge inert film 21 should be made of such an organic component as to be sufficiently burned at such a temperature.

Further, by examination of the minimum sustain pulse voltage of the PDP 51 including the discharge inert film 21 of the above film condition, it is found that the minimum sustain pulse voltage does not remarkably increase, unlike in the discharge inert film made of a dielectric glass containing inorganic binder.

Thus, according to the discharge inert film 21, it is possible to form a film which can produce the above-discussed effects (1), (2) and (3) by the screen printing method which is a low-cost method as compared with the vapor deposition lift-off method, and to provide the front substrate 51F and the PDP 51 for which a practical driving can be easily achieved.

The detailed mechanism is not certain on the experimental result that the minimum sustain pulse voltage remarkably increases in the discharge inert film made of a dielectric glass having a strong binding and a strong cohesion to the underlying layer and on the other hand, the minimum sustain pulse voltage does not remarkably increase in the discharge inert film 21 of the first preferred embodiment which is made of an aggregate of fine particles of discharge inert material and does not have the above strong binding and strong cohesion. It seems, however, that the circumstances to cause the inventor of the present invention to pay attention to the inorganic binder before the above evaluation are very helpful to a study on the above experimental result.

Formerly, the inventor of the present invention has made an experiment that a portion of the barrier rib 7 which is in contact with the cathode film 11 is made of sealing material whose main component is a glass component, i.e., inorganic binder in a typical AC surface discharge type PDP having the structure of the PDP 51 except the discharge inert film 21. The object of the experiment is to prevent the interference of discharges between discharge spaces which adjoin each other with the barrier rib 7 interposed therebetween and the loss in selectivity of the cell C by fixing the barrier rib 7 to the cathode film 11 in a sealing process (to paste the front glass substrate 5 and the rear glass substrate 9 together by softening a sealing material provided at their rim).

This experiment, however, ends in the evaluation that the above structure is hard to apply to a practical driving since the minimum sustain pulse voltage remarkably increases. Further, an experiment in which the discharge inert film is formed of a material containing an inorganic binder as discussed above also ends in the same result.

In a typical PDP having no discharge inert film 21, the barrier rib 7 and the cathode film 11 are in contact with each other. Though the barrier rib 7 generally contains a large amount of inorganic binders, the minimum sustain pulse voltage takes a generally-practical value in the typical PDP having no discharge inert film 21.

Then, the inventor of the present invention found, from comprehensive examination of these phenomena, that the above two experiments are common in that a glassy structure is fixed on a surface of the cathode film 11 and further that the barrier rib 7 containing the inorganic binder and the cathode film 11 are just in contact with each other in the typical PDP having no discharge inert film 21. In other words, it is found that the minimum sustain pulse voltage does not remarkably increase if a glassy structure is not fixed on but just in contact with the cathode film 11.

Thus, the inventor of the present invention has come to an idea that a remarkable increase in the minimum sustain pulse voltage should not be caused if the discharge inert film 21 is so made of a simple aggregate of fine particles of discharge inert material such as $Al_2O_3$, $TiO_2$ or $SiO_2$, not substantially containing any inorganic binder, as not to be fixed on the surface of the cathode film 11. If the discharge inert film 21 is formed as discussed above, such a cohesion as to cause natural film peeling is not practical. The inventor of the present invention, however, expected that the discharge inert film 21 does not cause the natural film peeling from well-known facts on phosphor. Specifically, though a phosphor is an aggregate of fine particles of fluorescent material, not containing any inorganic binder, and the firing temperature for the phosphor is generally low to such an extent that the inorganic binder component contained in the underlying barrier rib 7 and the overglaze layer 10 can not exert a fixative action, the phosphor in a PDP does not cause the natural film peeling.

The experiment on these studies ended in the result that the discharge inert film 21 can be formed without causing the natural film peeling and the minimum sustain pulse voltage does not remarkably increase. Therefore, according to the discharge inert film 21, as discussed above, it is possible to form a film which can produce the above-discussed effects (1), (2) and (3) by the screen printing method at low cost, and moreover provide the front substrate 51F and the PDP 51 for which a practical driving can be easily achieved.

Since the discharge inert film 21 is made of an aggregate of fine particles of discharge inert material, not substantially containing any inorganic binder, a film flaw or deformation of surface shape are sometimes caused by a pressure from the barrier rib 7. The inventor of the present invention confirms, however, that such a film flaw or the like is caused only at a portion of the discharge inert film 21 which is in contact with the barrier rib 7 but not caused at a portion of the discharge inert film 21 which is exposed to the discharge space 51S. Therefore, no pixel defect is caused by the film flaw or the like, and the effects (1), (2) and (3) which are expected for the discharge inert film 21 are not lost.

It is found, in fact, that deformation in surface shape of the discharge inert film 21 as discussed above uniformizes the pressure exerted on a contact portion between the barrier rib 7 and the discharge inert film 21. For this reason, even if the barrier rib 7 or the discharge inert film 21 before being sealed have a slightly projected shape in their surfaces, it is possible to relieve a pinpoint pressure exerted on the slightly-projected portions. Therefore, according to the discharge inert film 21, it is possible to produce a side effect of preventing the pixel defect due to breakages of the barrier rib 7.

As to the barrier rib 7, in general, as the height h (see FIG. 23) becomes higher and the average pattern width w (see FIG. 23) becomes narrower, the probability of causing a breakage by a pressure generated by the contact with the front substrate 51F becomes higher.

The height h of the barrier rib refers to a size in the third direction D3 (a direction in which the front substrate 51F and the rear substrate 51R are layered). The average pattern width w refers to an average of pattern widths (sizes in the second direction D2 orthogonal to both the direction in which the substrates are layered and a direction in which the pattern of the barrier rib 7 extends in FIG. 23) in the third direction D3. In the case of FIG. 23, for example, since the section of the barrier rib 7 (the section orthogonal to the first direction D1, i.e., the extension direction) is substantially trapezoid, the pattern width depends on a position in the height direction (i.e., the third direction D3). Then, an average of the pattern widths which depend on the positions in the height direction is referred to as an average pattern width w. In FIG. 23, for convenience of illustration, a sign "w" is given near the center of the height of the barrier rib 7.

On such a breakage of the barrier rib 7, the inventor of the present invention made an experiment by using an PDP having a structure where the discharge inert film 21P is removed from the structure shown in FIG. 23 and the barrier rib 7 is in direct contact with the cathode film 11 (which harder than the discharge inert film 21P). In the PDP used in this experiment, the array pitch of the barrier rib 7 in the second direction D2 is 396 $\mu$m, and the screen size is 46 inches having a ratio of 16:9. From this experiment, it is found that the pixel defect due to the rib breakage is hardly caused in practical terms, even in the manufacturing process, when the average pattern width w is 75 $\mu$m and the height h is 140 $\mu$m. Further it is found that 5 to 10 pixel defects are caused in the screen due to the rib breakage when the average pattern width w is 75 $\mu$m and the height h is 160 $\mu$m. Further, in an experiment made by using a PDP which has a barrier rib 7 having the same screen size and the array pitch of 264 $\mu$m in the second direction D2, when the average pattern width w is 60 $\mu$m and the height h is 140 $\mu$m, about 50 pixel defects are found in the screen. From these experimental results, it is found that it is difficult to suppress the pixel defect due to the rib breakage when a relation $h/w \geqq 2$ is almost satisfied in the structure where the barrier rib 7 is in direct contact with the hard-type cathode film 11.

Figure 3:
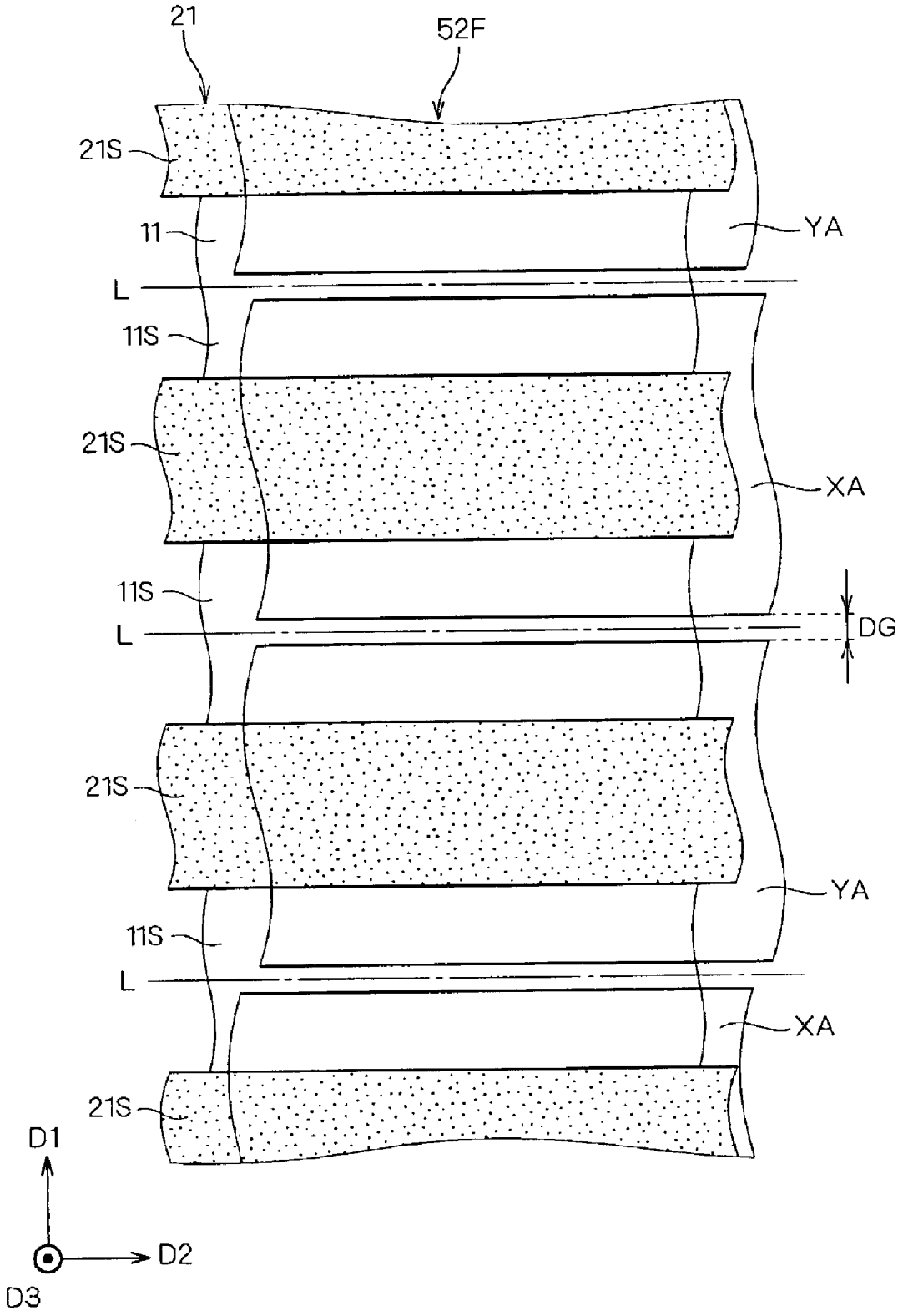
FIG. 3 is a plan view illustrating a second front substrate in accordance with the first preferred embodiment.

Though the luminance and the luminous efficiency can be improved as the height h becomes higher (see, e.g., the document "Proceedings of Asia Display/IDW '01", pp. 781–784, FIG. 3) and/or the pattern width w becomes narrower, in other words, the pattern interval between adjacent barrier ribs 7 becomes wider (see, e.g., "Proceedings of IDW '99", pp. 599–602), it is difficult to both suppress the pixel defect and improve the luminance and the luminous efficiency in the PDP having the structure used in this experiment.

In contrast to this, an experiment shows that if the discharge inert film 21 is used, even when the barrier rib 7 whose array pitch in the second direction D2 is 264 $\mu$m, average pattern width w is 60 $\mu$m and height h is 140 $\mu$m is used, the pixel defect due to the rib breakage is hardly caused in practical terms. In other words, using the discharge inert film 21 makes it possible to both suppress the pixel defect and improve the luminance and the luminous efficiency at the same time.

Though the discharge spaces of the discharge cells C are continuous to one another between the adjacent display lines L (i.e., in the first direction D1) in the stripe-shaped barrier ribs 7, even when the discharge space extends due to an increase of height h and/or a decrease of pattern width w, the discharge inert film 21 efficiently suppress interference of discharges among the discharge cells C.

As discussed above, as the barrier rib 7 becomes higher, the luminance and the luminous efficiency can be improved. Other than the stripe-shaped barrier rib 7 (see FIG. 23), there is a grating barrier rib (see, e.g., FIG. 21 as discussed later and "Proceedings of IDW '99", pp. 587–590) and the height h is more easily made higher in the stripe-shaped barrier rib 7 for the following reason.

First, since the grating barrier rib includes a component extending along the first direction D1 (see the first component 7B1 of FIG. 21) and a component extending along the second direction D2 (see the second component 7B2 of FIG. 21), both components affect each other in shape at a portion where both components intersect when the barrier rib is formed (by, e.g., the sandblasting method or a method using photosensitive rib material). Therefore, it becomes hard to control the shape as the grating barrier rib becomes higher.

Further, since the grating barrier rib so sections a space as to surround the discharge cell C, the air in the space has difficulty in escaping and the air is sometimes blocked when the phosphor 8 is applied to the space. In such a case, the phosphor 8 can not be appropriately applied, and this problem is more easily caused as the barrier rib becomes higher.

Furthermore, as discussed in the following (a) to (d), there are few method of forming the grating barrier rib, which is more suited to increase the height h than the sandblasting method or the method using photosensitive rib material.

(a) In a pattern layer printing method, though it is necessary to shift a screen printing plate in the first direction D1 every time when a layer is printed in order to average overlaps of screen mesh, it is impossible to shift the screen printing plate in the grating barrier rib which has the component extending along the second direction D2.

(b) In a pattern pressing method, the grating barrier rib has difficulty in removal since there is no direction of escaping in removal and a simultaneous removal is required with respect to the substrate surface. On the other hand, in the case of stripe-shaped barrier rib, the removal can be performed like turn-over since it is possible to escape in an extension direction of the barrier rib (pattern).

(c) In a method where a rib material is buried in a pattern groove of DFR (dry film photoresist) formed on the substrate, a DFR pattern is formed like an isolated island at a portion of each discharge cell C in the grating barrier rib. Therefore, a DFR removal is difficult because triggers for removal as much as the cells are needed.

(d) A method where rib materials applied evenly on the substrate are swept by probes corresponding to the spaces between the patterns of the barrier ribs is suited to the stripe-shaped barrier rib but can not be used for the grating barrier rib.

In contrast, the stripe-shaped barrier rib 7 does not have the above problems and limitations specific to the grating barrier rib and allows relatively easy increase of the height h. Therefore, it is practically impossible to set the height h≧150 μm in the grating barrier rib because of the above problems and limitation of its manufacturing methods, but it is possible to set the height h in a range from 150 to 500 μm in the stripe-shaped barrier rib 7. In other words, the stripe-shaped barrier rib formed higher by using the discharge inert film 21 can markedly improve the luminance and the luminous efficiency.

Further, since a pattern of the grating barrier rib is so present as to surround each discharge cell C, the rate of energy loss caused by collision of plasma particles generated by the discharge against the phosphor 8 on side surfaces of the barrier rib is higher than that in the stripe-shaped barrier rib. Therefore, the luminous efficiency of the grating barrier rib is relatively lower.

Thus, using the discharge inert film 21 allows use of the stripe-shaped barrier rib 7. Further, according to the discharge inert film 21, it is possible to suppress the pixel defect due to the break of the barrier rib even when the barrier rib 7 becomes narrower and/or higher to satisfy the relation h/w≧2. For these reasons, the discharge inert film 21 is extremely effective in improving the luminance and the luminous efficiency.

For improvement of the luminous efficiency of a display, it is preferable that a visible light emitted from the phosphor 8 should not be blocked by the discharge inert film 21. Therefore, it is desirable that the discharge inert film 21 should be transparent. As the average diameter of particles of a discharge inert material forming the discharge inert film 21 becomes smaller, the discharge inert film 21 becomes more transparent. Since the transparency increases as the average diameter decreases to almost a visible-light wave range (0.4 to 0.8 μm) or less, it is appropriate that the average diameter of particles of the discharge inert material should be about 1 μm or smaller, more preferably 0.1 μm level or smaller.

Further, when the cathode film 11 below the discharge inert film 21 is microscopically exposed, a discharge is generated also on the discharge inert film 21, and therefore the above-discussed effects (1), (2) and (3) can not be produced in some cases. For this reason, in order to avoid the discharge on the discharge inert film 21, it is desirable to set the thickness t of the discharge inert film 21 (see FIG. 2) should be almost as much as the average diameter of particles of the discharge inert material or more. On the other hand, when the discharge inert film 21 is too thick, the clearance between the barrier rib 7 and the cathode film 11 becomes large near the discharge gap portion DG and the discharges in the discharge spaces adjoining each other with the barrier rib 7 interposed therebetween interfere with each other, and as a result, the selectivity of the cell C is sometimes lost. For avoiding the loss in the selectivity of the cell C, it is desirable that the film thickness t of the discharge inert film 21 should be 10 μm level or less, more preferably 5 μm or less.

Though the PDP 51 has a structure in which the discharge inert film 21 of the first preferred embodiment is applied to the structure of the PDP 51P of FIG. 23 (i.e., the PDP disclosed in the Japanese Patent Application Laid Open Gazette No. 9-102280), the discharge inert film 21 may be also applied to a PDP having another structure, to produce the same effect as in the PDP 51. For example, the discharge inert film 21 may be applied to a second front substrate 52F of the first preferred embodiment shown in the plan view (layout view) of FIG. 3.

As shown in FIG. 3, each of sustain discharge electrodes XA and YA of the front substrate 52F corresponds to a structure where two sustain discharge electrodes X and Y of the above front substrate 51F which adjoin each other with the electrode pair gap portion NG interposed therebetween and are not paired are united. The width (size in the first direction D1) of the sustain discharge electrode XA or YA is appropriately set. Since no electrode pair gap portion NG exists in the front substrate 52F, only the discharge gap portion DG is provided between the sustain discharge electrodes XA and YA. Therefore, each of the sustain discharge electrodes XA and YA defines both adjoining display lines L. Conversely, one sustain discharge electrode XA or YA is disposed between the adjoining display lines L in the front substrate 52F, and the adjoining display lines L share one sustain discharge electrode XA or YA.

Other constituents of the front substrate 52F (not shown in FIG. 3) are the same as those of the front substrate 51F, and the front substrate 52F may be applied to the PDP 51 instead of the front substrate 51F and the PDP 51 using the front substrate 52F may be applied to the plasma display device 101. This applies to a front substrate 53F (see FIG. 4) and the like as discussed later.

The discharge inert film 21 of the first preferred embodiment may be applied to a PDP having other structure where adjoining display lines share one sustain discharge electrode (see the Japanese Patent Application Laid Open Gazette Nos. 10-255664, 10-333636, 2000-39866 and 2001-147660).

The Second Preferred Embodiment

In the first preferred embodiment discussed is the case where the discharge inert film 21 is so directly patterned by screen printing as to cover part of the sustain discharge electrodes X and Y near the adjoining sustain discharge electrode pair gap portion NG as the front substrate 51F is two-dimensionally viewed. In this case, the area of a portion where the surface discharge 50 is actually generated on the sustain discharge electrodes X and Y in one discharge cell C (see FIG. 23) is almost proportional to the distance or size from a pattern edge on the side of the discharge gap portion of the sustain discharge electrodes X and Y to a pattern edge of the discharge inert film 21. Therefore, a forming position of the pattern edge of the discharge inert film 21 greatly influences a discharge current.

In the case where the discharge inert film 21 is directly patterned by screen printing, the accuracy in forming position of the pattern edge is affected by extension and contraction of the screen printing plate and a droop, a blur or the like of the thick film paste caused through the processes of printing, drying and firing. At this time, even if the screen printing plate, the thick film paste and the condition of printing, drying and firing are improved without any consideration of productivity, the accuracy in forming position of the pattern edge of the discharge inert film 21 can be only expected to be ±50 μm since the front glass substrate 5 has a large area. In consideration of productivity, the accuracy can be only expected to be ±100 μm.

On the other hand, the pattern width of each sustain discharge electrode X or Y. i.e., the distance or size from the pattern edge on the side of the discharge gap portion DG to that on the side of the adjoining sustain discharge electrode pair gap portion NG is only 100 to 500 μm in general.

In consideration of these facts, it is difficult in some cases to ensure the forming position of the pattern edge with sufficient accuracy in the discharge inert film 21 of the first preferred embodiment. For this reason, there is a need to allow for increase or decrease of 10 to 100%, normally 20 to 50%, in discharge current per one discharge cell in the PDP 51 of the first preferred embodiment, and this can not be accepted in some cases from the viewpoints of reproducibility of product performance or uniformity in the plane on display.

Further, in some cases, there is noticeable luminance unevenness, specifically, luminance unevenness in mesh or luminance unevenness like moire, due to use of the screen printing plate for forming the discharge inert film 21 by the screen printing method. From detailed examination, it is found that the unevenness of the pattern edge in the discharge inert film 21 reflects local unevenness in density of mesh inherent in the screen printing plate and the unevenness causes unevenness in magnitude of the discharge current per cell, to consequently cause the luminance unevenness.

Then, in the second preferred embodiment discussed will be a front substrate and a PDP which can reduce effects on the discharge current flowing in the whole panel, the distribution of discharge current in panel plane and unevenness in magnitude of the discharge current per cell even if the accuracy in forming position of the pattern edge and evenness of the discharge inert film 21 is low as discussed above.

Figure 4:
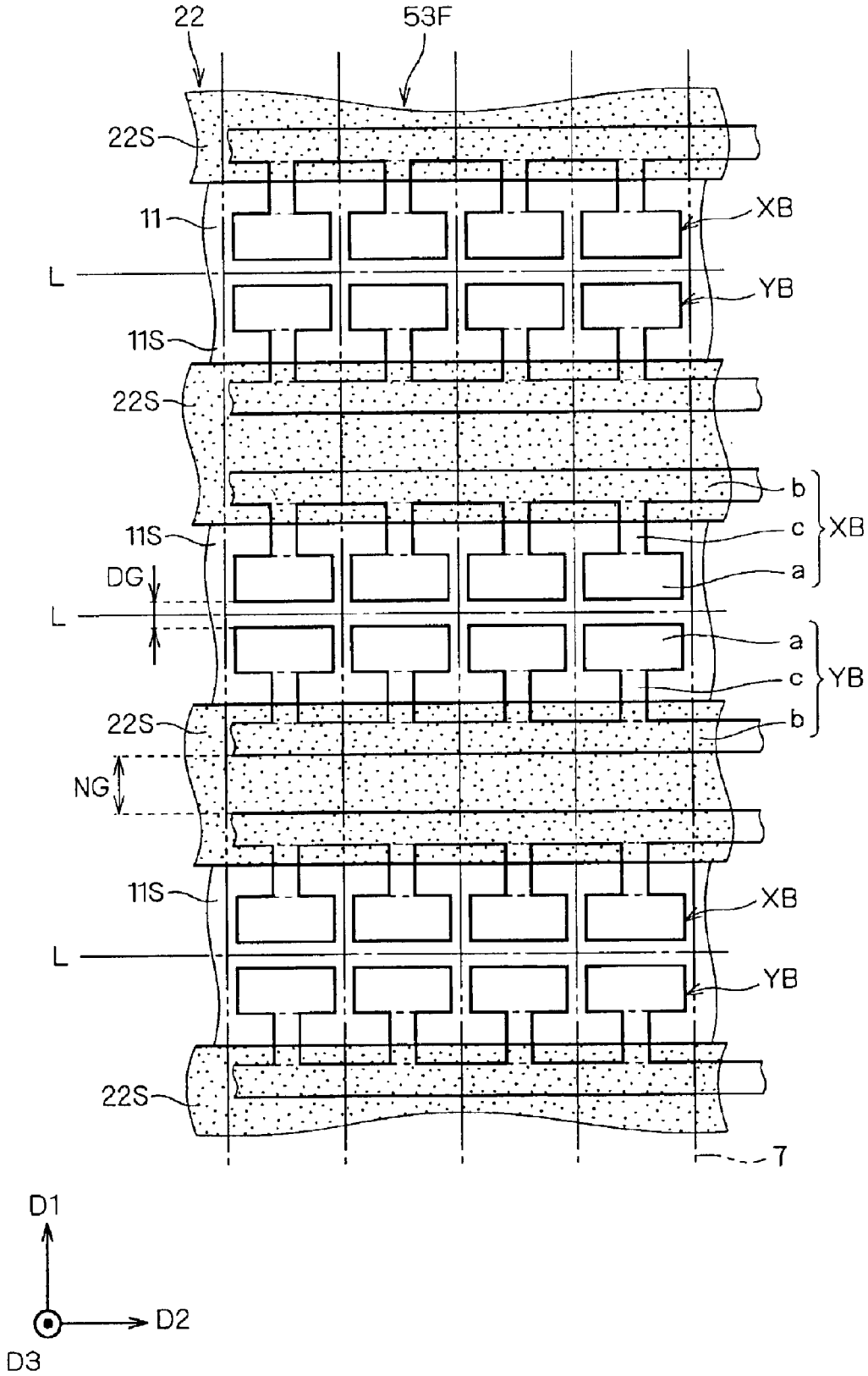
FIG. 4 is a plan view illustrating a first front substrate and a PDP including the front substrate in accordance with a second preferred embodiment of the present invention.

FIG. 4 is a plan view (layout view) illustrating a first front substrate 53F and a PDP 51 including the front substrate 53F in accordance with the second preferred embodiment. FIG. 4 mainly shows sustain discharge electrodes XB and YB, a discharge inert film 22 and the cathode film 11 of the front substrate 53F, and schematically illustrates (the top of) the barrier rib 7 in the PDP 51 using the front substrate 53F by the two-dot chain line (or chain double-dashed line). Such an illustration is used in the plan views of FIG. 6 and the like.

A constitution of the front substrate 53F is the same as that of the earlier-discussed front substrate 51F except for the sustain discharge electrodes XB and YB and the discharge inert film 22. The sustain discharge electrodes XB and YB are arranged on the front glass substrate 5 (see FIG. 2) in the first direction D1 and extend along the second direction D2, to define a plurality of display lines L extending along the second direction D2, like the sustain discharge electrodes X and Y shown in FIG. 2. Two sustain discharge electrodes XB and YB (not paired) are disposed between adjacent display lines L.

In particular, each of the sustain discharge electrodes XB and YB includes a plurality of discharge gap adjoining portions a, a bus portion b and a plurality of bridge-building portions c. A border line between the discharge gap adjoining portion a and the bridge-building portion c and that between the bridge-building portion c and the bus portion b are indicated by broken lines. In more detail, the bus portion b adjoins the adjoining sustain discharge electrode pair gap portion NG and extends along the second direction D2. A plurality of bridge-building portions c extend from the bus portion b towards the discharge gap portion DG which adjoins the bus portion b (herein, extend along the first direction D1). A plurality of bridge-building portions c are connected to a plurality of discharge gap adjoining portions a, respectively, and these discharge gap adjoining portions a adjoin the discharge gap portion DG and are aligned in the second direction D2 (in other words, along the discharge gap portion DG). Each discharge gap adjoining portion a is thereby electrically connected to the bus portion b through the corresponding bridge-building portion c. In each of the sustain discharge electrodes XB and YB, each discharge gap adjoining portion a and the corresponding bridge-building portion c are connected in T shape (the discharge gap adjoining portion a corresponds to a head of T and the bridge-building portion c corresponds to a foot of T, and the pattern width of the bridge-building portion c in the second direction D2 is narrower than that of the discharge gap adjoining portion a).

Like in the front substrate 5 IF, the sustain discharge electrodes XB and YB are also covered with the dielectric layer 3 and the cathode film 11 (see FIG. 2) in the front substrate 53F.

The discharge inert film 22 of the front substrate 53F is disposed on the cathode film 11, like the discharge inert film 21 of the earlier-discussed front substrate 51F, and has a stripe shape consisting of a plurality of strip-like patterns. Each strip-like pattern or an exposed surface 22S of the discharge inert film 22 is disposed in an area corresponding to the area between two display lines L as the front substrate 53F is two-dimensionally viewed, not covering the discharge gap adjoining portions a of the sustain discharge electrodes XB and YB. In this case, the pattern edges of the discharge inert film 22 are opposed to the bridge-building portions c of the sustain discharge electrodes XB and YB. The discharge inert film 22 may be patterned by the screen printing method like the discharge inert film 21, or may be formed by the vapor deposition lift-off method or the like.

In the PDP 51 using the front substrate 53F, the front substrate 53F and the rear substrate 53R are disposed so that a gap between the discharge gap adjoining portions a should be opposed to the barrier rib 7 and each bridge-building portion c should be disposed between the strip-like patterns of the barrier rib 7 and opposed to the discharge space 51S.

Though the PDP including the sustain discharge electrodes, the discharge inert film and the barrier rib which have the above-discussed shape and layout is disclosed in the Japanese Patent Application Laid Open Gazette No. 2001-176400, there is a great difference as discussed below between the PDP 51 of the second preferred embodiment and the PDP disclosed in the above gazette.

First, in the front substrate 53F of the second preferred embodiment, the pattern edge of the stripe-shaped discharge inert film 22 after being fired is away from the discharge gap adjoining portion a (a pattern edge thereof on the side of the discharge inert film 22) by almost 50 $\mu$m or more, more preferably by 100 $\mu$m or more. Such a disposition is possible depending on the conditions (e.g., pattern design of the screen printing plate) of the screen printing method and the like. Specifically, by designing so that the pattern edge of the discharge inert film 22 is positioned away from the discharge gap adjoining portion a by almost 50 $\mu$m or more, more preferably by 100 $\mu$m or more as two-dimensionally viewed, it becomes possible to manufacture the front substrate 53F which satisfies the above-discussed positional relation with good yield (on average) even when there arises misalignment in printing position. In the discharge inert film 22 formed under such a condition, the pattern edge of average discharge inert film 22 in the substrate surface is formed on a position away from the discharge gap adjoining portion a by almost 50 $\mu$m or more, more preferably by 100 $\mu$m or more as two-dimensionally viewed. Therefore, a portion which corresponds to this exists in at least part of the substrate surface.

Since such a position setting keeps the discharge inert film 22 from covering the discharge gap adjoining portion a even when the pattern edge of the discharge inert film 22 is out of the desired position by 50 to 100 $\mu$m, it is possible to prevent the discharge at the discharge gap adjoining portion a from being affected by the misalignment of forming position or unevenness of the discharge inert film 22.

On the other hand, a portion of the bridge-building portion c at which the discharge is generated is defined by the forming position of the pattern edge of the discharge inert film 22 and affected by the unevenness of the pattern edge. Since the pattern width of the bridge-building portion c, however, in a direction parallel to the extension direction of the pattern edge of the discharge inert film 22 (i.e., the second direction D2) is narrower than that of the discharge gap adjoining portion a, the area of the bridge-building portion c in which the discharge is generated is sufficiently smaller than that of the discharge gap adjoining portion a. Further, since an electric field generated in the discharge space 51S by a voltage applied to the sustain discharge electrodes X and Y becomes weaker above the bridge-building portion c as the bridge-building portion c becomes narrower along a crossing direction (i.e., the first direction D1) (in other words, the pattern width in the second direction D2 becomes smaller), the discharge current density at the bridge-building portion c can be made smaller than that at the discharge gap adjoining portion a or substantially zero. In this case, since the pattern edge of the discharge inert film 22 intersects only the bridge-building portions c of the sustain discharge electrodes X and Y whose pattern width is narrower, it is possible to make the intersection smaller than that in the PDP 51P as the pattern width of the bridge-building portion c is made narrower.

Thus, according to the front substrate 53F, since the increase and decrease in discharge current per discharge cell can be controlled even when the pattern edge of the discharge inert film 22 is out of the desired position by 50 to 100 $\mu$m, it is possible to improve the reproducibility or uniformity in the plane on display performance. Further, since the unevenness in magnitude of the discharge current per cell due to the unevenness of the pattern edge of the discharge inert film 22 can be suppressed, it is possible to suppress luminance unevenness corresponding to the unevenness in density of mesh of the screen printing plate used for forming the discharge inert film 22.

Since most of the light emitted from a portion of the phosphor 8 which is opposed to the bus portion b is blocked by the bus portion b, it is desirable, from the viewpoint of efficiency of taking the visible light (or luminous efficiency), that no discharge should be generated on the bus portion b. In order not to generate the discharge on the bus portion b, it is necessary to prevent the bus portion b from getting out of an existence area of the discharge inert film 22 even when the pattern edge of the discharge inert film 22 is out of the desired position by 50 to 100 $\mu$m.

It is possible, however, to prevent the discharge from being generated on the bus portion b when the amount of sticking-out is as small as 50 $\mu$m even if part of the bus portion b sticks out of the discharge inert film 22. Japanese Patent Application Laid Open Gazette No. 2000-113828, for example, discloses a PDP which includes sustain discharge electrodes each having discharge gap adjoining portions, a bus portion and bridge-building portions and no discharge inert film, and the gazette shows that it is possible to localize the surface discharge between the sustain discharge electrodes near a discharge gap portion. Such a localization of discharge is mainly caused by that (I) it is difficult to extend the discharge generated at the discharge gap adjoining portion a to the bus portion b since the discharge current density becomes smaller while the discharge extends to the bridge-building portion c as discussed above and that (II) it is difficult to generate an electric field required for generation of the discharge near the bridge-building portion c in the discharge space 51S above the bus portion b.

For these reasons, the pattern edge of the discharge inert film 22 is disposed at a portion nearer the bus portion b than the discharge gap adjoining portion a as the front substrate 53F is two-dimensionally viewed. In other words, as two-dimensionally viewed, the distance between the pattern edges of the discharge inert film 22 and the discharge gap adjoining portion a is set longer than that between the pattern edges of the discharge inert film 22 and the bus portion b. Such a positional relation is possible depending on setting of the conditions of the screen printing (e.g., pattern design of the screen printing plate) and the like. Specifically, a pattern is designed so that the pattern edge of the discharge inert film 22 should be nearer the bus portion b than the discharge gap adjoining portion a as two-dimensionally viewed. With such a condition, even if there arises misalignment in printing position, it is possible to manufacture the front substrate 53F with good yield (on average), in which the pattern of the discharge inert film 22 does not extend up to the discharge gap adjoining portion a as two-dimensionally viewed and no discharge is generated at the bus portion b even if the bus portion b is out of the pattern of the discharge inert film 22 to some degree as two-dimensionally viewed. In the discharge inert film 22 formed under such a condition, the average pattern edge of discharge inert film 22 in the substrate surface is formed at a position nearer the bus portion b than the discharge gap adjoining portion a as two-dimensionally viewed. Therefore, a portion which corresponds to this exists in at least part of the substrate surface.

Further, in order to prevent the surface discharge from being generated between the bus portions in the above PDP (which includes sustain discharge electrodes each having the discharge gap adjoining portions, the bus portion and the bridge-building portions and no discharge inert film) disclosed in the Japanese Patent Application Laid Open Gazette No. 2000-113828, it is necessary to sufficiently weaken the electric field in the discharge space above the whole bus portion. Though such an electric field is obtained by setting an alternating voltage to be applied between the sustain discharge electrodes for sustain discharge considerably low, in this case, a normal sustain discharge at the discharge gap adjoining portion becomes unstable. Alternatively, though the above weak electric field is obtained by setting the pattern width of the bus portion in a direction orthogonal to the extension direction of the sustain discharge electrode considerably narrow, voltage loss and power consumption caused by the discharge current flowing in the bus portion becomes large since the line resistance of the bus portion rises.

In contrast to this, by so providing the discharge inert film 22 as to cover the bus portion b as the front substrate 53F is two-dimensionally viewed (which can be disposed by a simple process, i.e., the screen printing method), it is possible to suppress extension of the sustain discharge to the bus portion b due to the action of the discharge inert film 22, even though the above alternating voltage for sustain discharge is not lowered too much and the above pattern width of the bus portion is not narrowed too much.

In the sustain discharge electrodes XB and YB, the transparent portion (a portion of the transparent electrode, on which no bus electrode is formed) may not be provided. In this case, it is possible to reduce a cost since there is no need to form any transparent electrode.

Without the transparent electrode, however, sufficient efficiency of taking emitted light can not be obtained since the visible light from the phosphor 8 is blocked by the sustain discharge electrodes XB and YB at a large rate. Therefore, it is more advantageous in terms of luminous efficiency that the whole or most of the discharge gap adjoining portion a where the luminescence intensity of the phosphor 8 is high is formed of the transparent portion or the transparent electrode. Further, it is more advantageous that the whole or most of the bridge-building portion c is formed of the transparent portion. In this case, since the luminescence intensity is higher at a portion nearer the discharge gap adjoining portion a, it is preferable that at least a portion of the bridge-building portion c near the discharge gap adjoining portion a should be formed of the transparent portion.

On the other hand, since the bus portion b serves to flow the discharge current, the bus portion b needs to have a structure including at least the bus electrode which has better conductivity than the transparent electrode. In other words, the bus electrode needs to be formed continuously along the extension direction of the sustain discharge electrodes XB and YB (i.e., the second direction D2) on at least part of each sustain discharge electrode XB or YB (preferably, on a side farther away from the discharge gap portion DG).

In this case, the bus electrode may be provided on the whole of the transparent electrode of the bus portion b (in other words, the bus portion b may be formed only of metal electrode portion) with emphasis on conductivity (to reduce the line resistance of the sustain discharge electrodes XB and YB), or the whole bus portion b may be formed only of the bus electrode. Even using such a bus portion b, the loss of the visible light from the phosphor 8 by the whole bus portion b is reduced to small. This is because the light emitted from the phosphor 8 is weak (the luminescence intensity is weak) near the bus portion b and the bus portion b only blocks such a weak light emitted from the phosphor 8 since the bus portion b is away from the discharge gap adjoining portion a where the whole or most of surface discharge 50 is generated. Therefore, it is possible to suppress the loss in efficiency of taking the emitted light also in the case where the bus electrode is applied to the whole bus portion b. Further, since the luminescence intensity of the phosphor 8 is weak near the bus portion b, reducing an extraneous light reflected on the phosphor 8 (light which externally enters and is reflected on the phosphor 8) by the bus portion b formed only of metal electrode portion can sometimes improve the display contrast in daylight room conditions more than taking the above weak emitted light with the transparent portion provided on the bus portion b.

Figure 5:
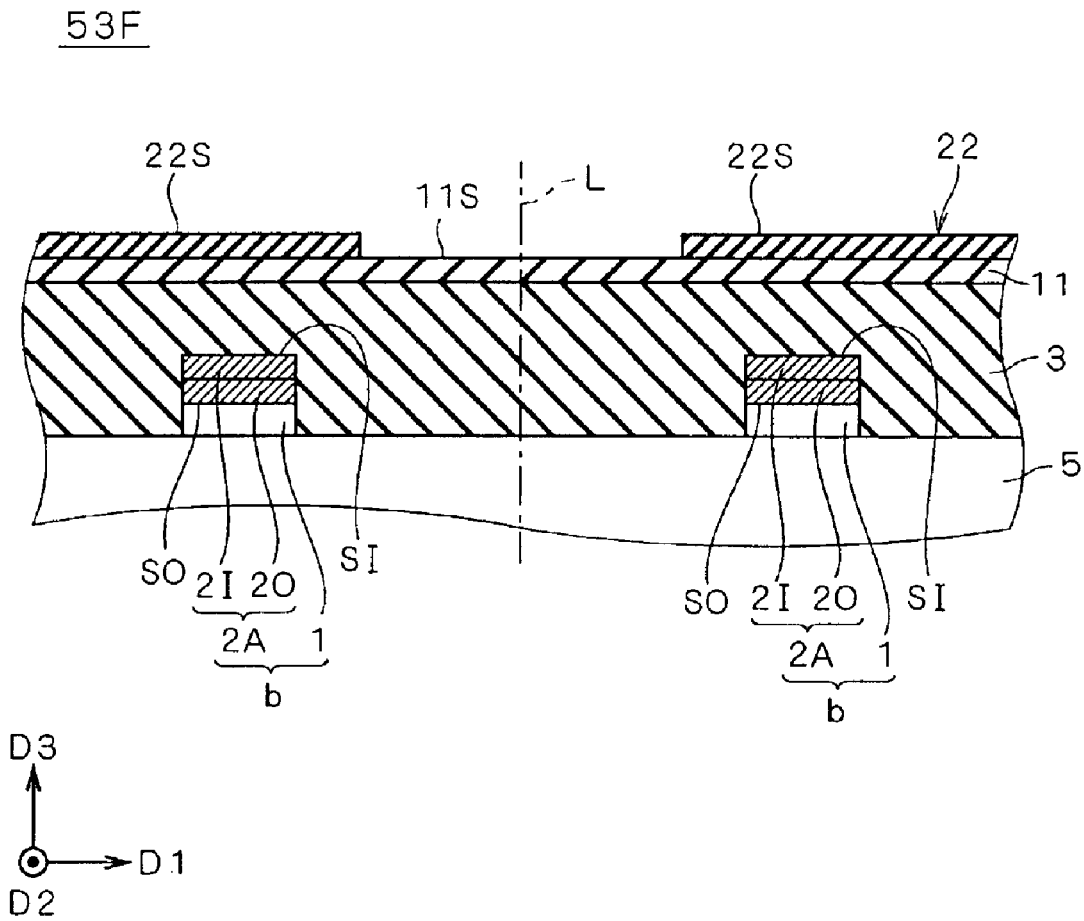
FIG. 5 is a cross section illustrating the first front substrate in accordance with the second preferred embodiment.

Furthermore, a bus electrode 2A of multilayer structure (herein, double-layer structure) may be adopted, like in the bus portion b shown in the cross section of FIG. 5. In more detail, the bus electrode 2A includes an outer layer 2O disposed on the transparent electrode 1 and an inner layer 2I opposed to the front glass substrate 5 with the outer layer 2O interposed therebetween. In particular, the outer layer 2O is higher in visible light absorptivity than the inner layer 2I, and the inner layer 2I is higher in visible light reflectance than the outer layer 2O. The outer layer 2O and the inner layer 2I can be formed by, e.g., changing the content of black pigment. Alternatively, there may be a case where the outer layer 2O is formed of a paste containing the black pigment and the inner layer 2I is formed of a paste for silver electrode. In this case, the bus electrode 2A has an outward surface SO opposed to he front glass substrate 5 and an inward surface SI opposed to the front glass substrate 5 with the outward surface SO interposed therebetween, and the outward surface SO is higher in visible light absorptivity than the inward surface SI and the inward surface SI is higher in visible light reflectance than the outer layer SO. Though FIG. 5 shows a case where the bus portion b includes the transparent electrode 1, the transparent electrode 1 may be omitted as discussed above.

According to such a bus electrode 2A, the display contrast in daylight room conditions can be improved by reducing the amount of reflected extraneous light by the outward surface SO, and moreover more emitted light can be taken as a display light by secondary reflection of the light emitted from the phosphor 8 by the inward surface SI in the discharge cell C. Therefore, it is possible to enhance the luminous efficiency.

The discussion on positional relation in layout between the sustain discharge electrodes XB and YB and the discharge inert film 22, that on the transparent electrode and the bus electrode in the sustain discharge electrodes XB and YB and that on the visible light reflectance and the visible light absorptivity of the bus electrode can be applied to various front substrates (including a front substrate 54F discussed later) each of which includes the sustain discharge electrodes each having the discharge gap adjoining portions, the bus portion and the bridge-building portions and the discharge inert film and PDPs adopting these front substrates, and the same effects can be produced therein. Then, a variation of the second preferred embodiment will be discussed.

Figure 6:
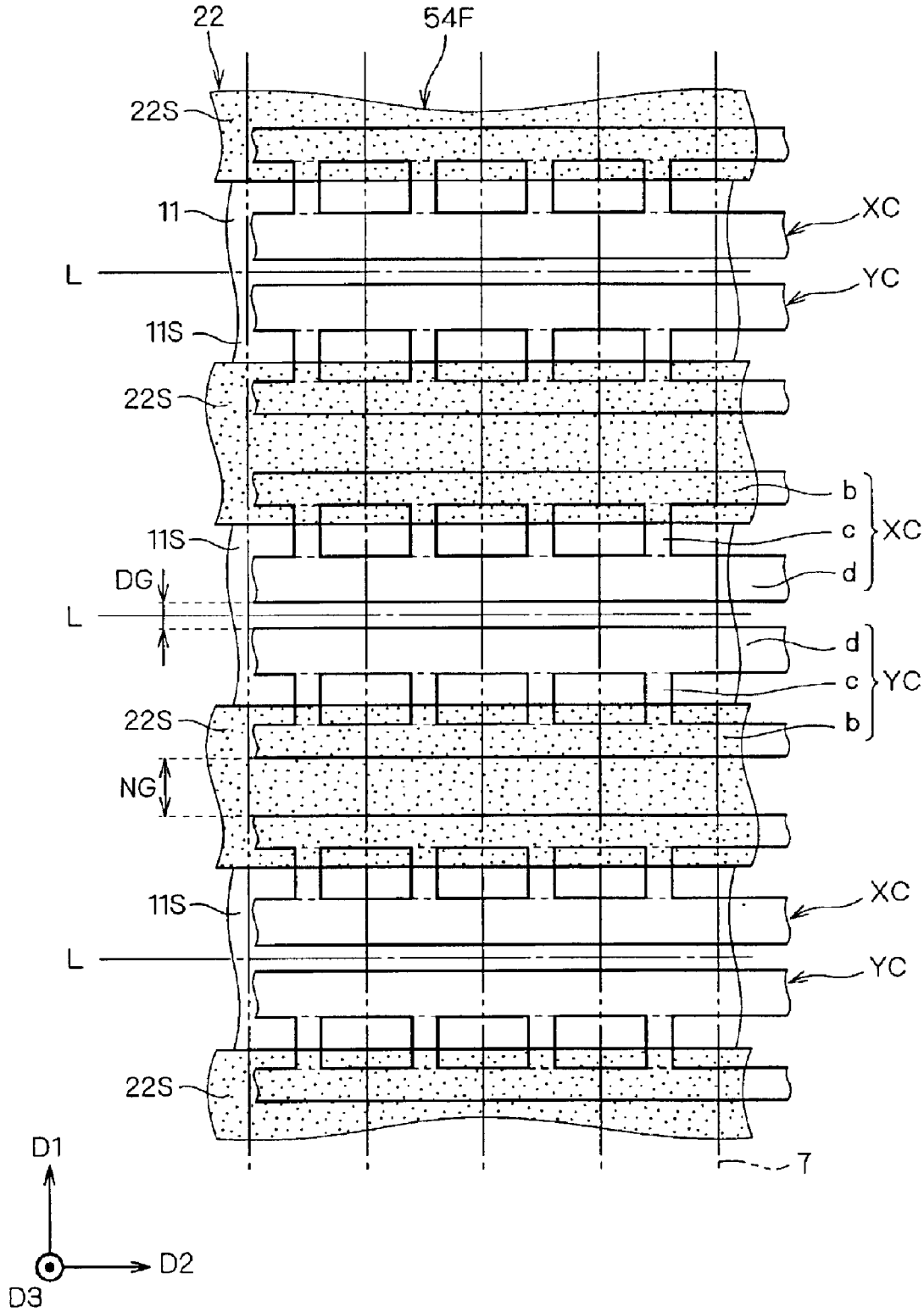
FIG. 6 is a plan view illustrating a second front substrate and a PDP including the front substrate in accordance with the second preferred embodiment.

FIG. 6 is a plan view illustrating a second front substrate 54F and a PDP 51 including the front substrate 54F in accordance with the second preferred embodiment. Sustain discharge electrodes XC and YC of the front substrate 54F each have a plane pattern in which a plurality of discharge gap adjoining portions a belonging to each bus portion b are united in one (become continuous) in the sustain discharge electrode XB or YB of FIG. 4. Specifically, in each sustain discharge electrode XC or YC, one discharge gap adjoining portion d which corresponds to a pattern where a plurality of discharge gap adjoining portions a are united in one is connected in common to all the bridge-building portions c adjoining in the second direction D2. Further, other constituents of the front substrate 54F are the same as those of the front substrate 53F of FIG. 4.

In the PDP 51 using the front substrate 54F instead of the front substrate 51F, each bridge-building portion c is disposed between the strip-like patterns of the barrier rib 7, like in the front substrate 53F of FIG. 4.

According to the front substrate 54F, even if there arises misalignment in the relative positions of the sustain discharge electrodes XC and YC and the barrier rib 7 in the extension direction of the sustain discharge electrodes XC and YC (i.e., the second direction D2), the area and shape of a portion of the discharge gap adjoining portion d which is opposed to each discharge space 51S (i.e., a main portion where a surface discharge is generated in each cell) are not affected by this displacement. Therefore, it is possible to achieve a stable display performance both in each discharge space 51S and the whole pane.

The discharge gap adjoining portion d extends along the second direction D2 and formed across a plurality of discharge cells C aligned in the second direction D2 with the barrier ribs 7 interposed therebetween. For this reason, as compared with the structure using the discharge gap adjoining portion a provided for each discharge cell C as shown in FIG. 4, the adjacent discharge cells C sometimes interfere each other to lower the selectivity thereof in the PDP having the discharge gap adjoining portion d. Japanese Patent Application Laid Open Gazette Nos. 2000-195431 and 2000-311612, for example, disclose a technique to suppress discharge on the bus portion b by sufficiently thickening the thickness of the dielectric layer covering the sustain discharge electrodes at a portion that covers the bus portion than at a portion that covers the discharge gap portion and the discharge gap adjoining portion. In this case, it is thought that the difference in covering thickness of the dielectric layer should be practically 10 μm or more, and a clearance of 10 μm level or more is necessarily formed between the barrier rib and the cathode film above the discharge gap portion and the discharge gap adjoining portion. In other words, through the clearance, the discharges of adjacent discharge cells may interfere each other. Therefore, when the dielectric layer has such a thickness distribution, in consideration of suppression of the interference of discharges through the clearance, it is difficult to use the discharge gap adjoining portion formed across a plurality of discharge cells aligned with the barrier ribs interposed therebetween, and there is a need to use the discharge gap adjoining portion provided for each discharge cell.

In contrast to this, by using the discharge inert film 22, instead of making such a thickness distribution in the dielectric layer 3, it becomes possible to use the discharge gap adjoining portion d formed across a plurality of discharge cells C aligned with the barrier ribs 7 interposed therebetween. This is because the discharge inert film 22 can suppress the discharge with low secondary electron emission characteristic and this allows the above clearance to be further narrowed by setting the thickness of the discharge inert film 22 to 10 μm level or less, more preferably 5 μm level or less as discussed in the first preferred embodiment (this thickness can sufficiently produce the effect of suppressing the discharge). Since the discharge gap adjoining portion d is continuous across a plurality of bridge-building portions c (connected to a plurality of bridge-building portions c), if one bridge-building portion c is broken and the other bridge-building portions c are not broken, it is sufficiently possible to feed a current to the discharge gap adjoining portion d adjoining the broken bridge-building portion c. This is advantageous in achieving a good manufacturing yield.

Figure 7:
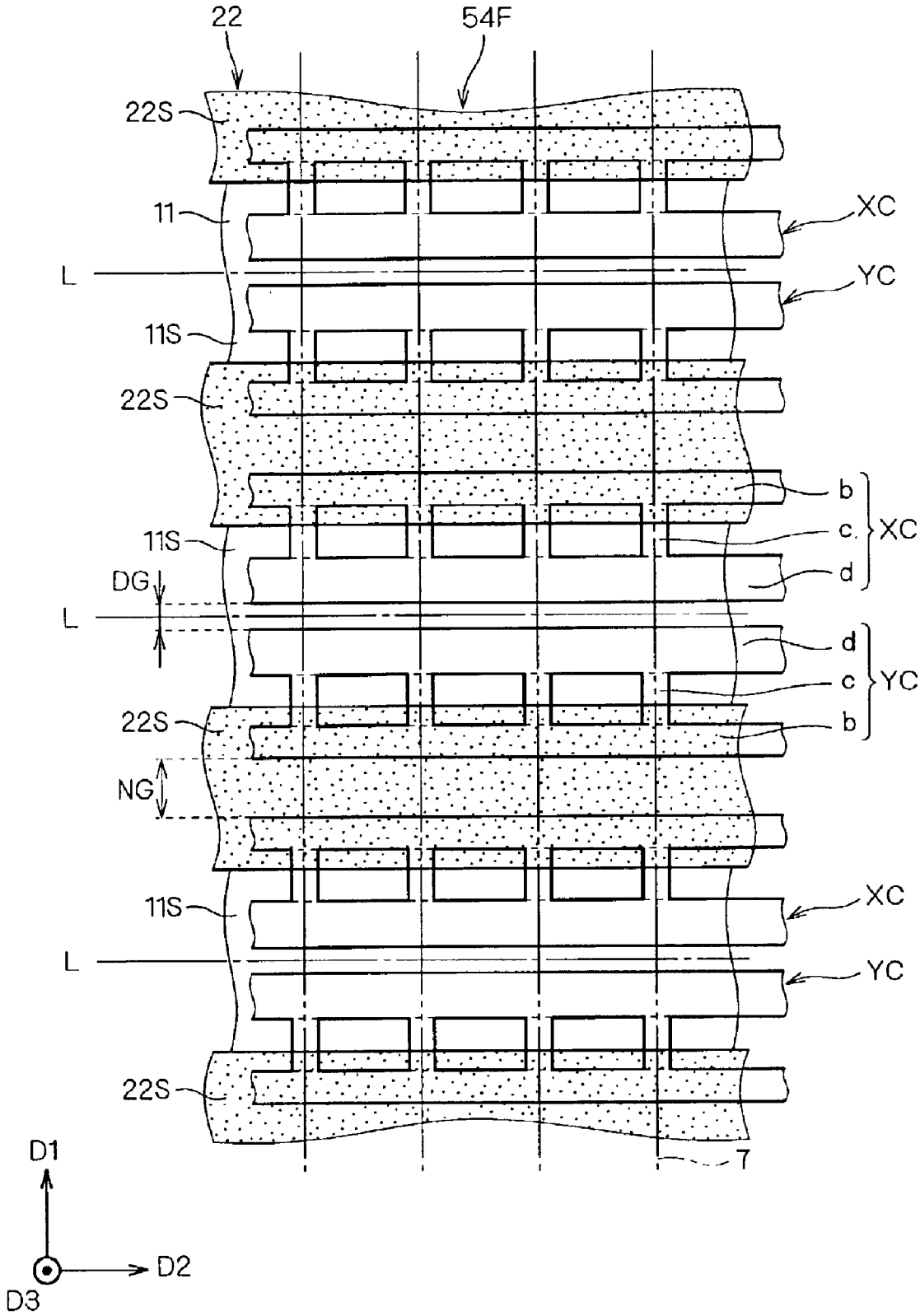
FIG. 7 is a plan view illustrating another PDP including the second front substrate in accordance with the second preferred embodiment.

As shown in FIG. 7, the front substrate 54F and the rear substrate 51R (see FIG. 23), i.e., the PDP 51 may be formed so that strip-like patterns of the barrier rib 7 and the bridge-building portions c of the sustain discharge electrodes XC and YC should be opposed to each other.

Since part or the whole of each bridge-building portion c is not opposed to the discharge space 51S in this PDP 51, the discharge at the bridge-building portion c becomes weaker or zero as compared with that in the case of FIG. 6 where the bridge-building portion c and the discharge space 51S are opposed to each other. For this reason, the discharge at each discharge gap adjoining portion d further or all influences the discharge characteristic of each discharge cell C. Therefore, it is possible to further relieve or solve the above-discussed problems due to the misalignment in forming position or the unevenness of the pattern edge of the discharge inert film 22.

Figure 8:
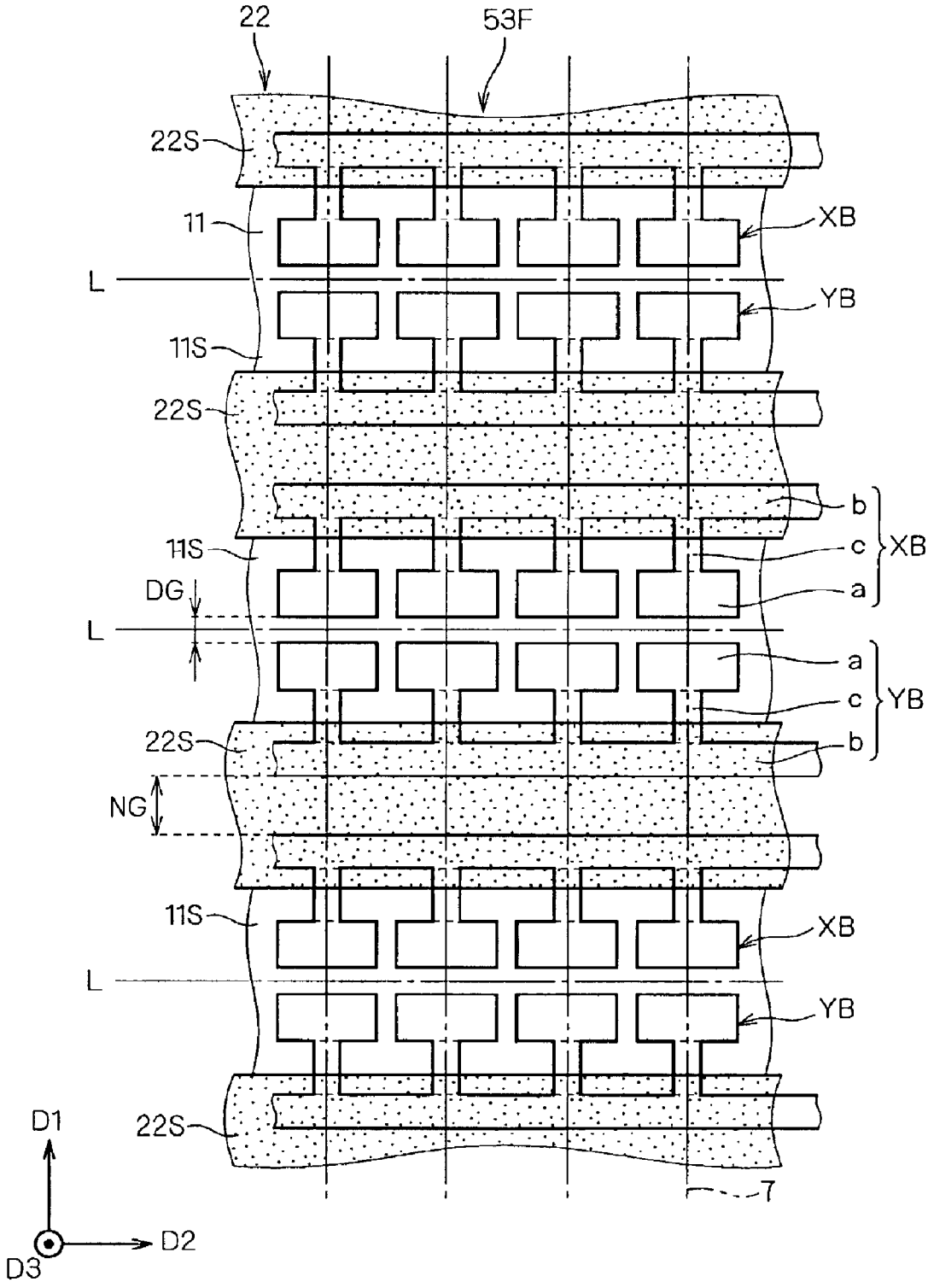
FIG. 8 is a plan view illustrating still another PDP including the first front substrate in accordance with the second preferred embodiment.

Similarly, as shown in FIG. 8, the front substrate 54F and the rear substrate 51R (see FIG. 23), i.e., the PDP 51 may be formed so that strip-like patterns of the barrier rib 7 and the bridge-building portions c of the sustain discharge electrodes XB and YB should be opposed to each other, and in other words, areas between a plurality of discharge gap adjoining portions a aligned in the second direction D2 should not be opposed to the strip-like patterns of the barrier rib 7. The PDP 51 having such a constitution corresponds to a structure where the discharge gap adjoining portion d of the PDP 51 of FIG. 7 is sectioned in the extension direction of the sustain discharge electrodes XC and YC (i.e., the second direction D2) between the strip-like patterns of the barrier rib 7 as two-dimensionally viewed.

In the PDP 51 of FIG. 8, a pattern area (or size) of the discharge gap adjoining portion in each discharge cell C is smaller as compared with the PDP of FIG. 7. A plasma generated in the discharge space 51S above the discharge gap adjoining portion a, however, extends to an area between adjacent discharge gap adjoining portions a (i.e., sectioned portion discussed above). For this reason, according to the PDP 51 of FIG. 8, it is possible to reduce the discharge current as compared with that in the PDP 51 of FIG. 7 and moreover make the amount of ultraviolet rays emitted from the plasma almost equal to that in the PDP 51 of FIG. 7. In other words, it is possible to increase the amount of ultraviolet rays emitted from the plasma relative to the discharge current. Therefore, the luminous efficiency can be improved. In particular, this effect can be produced also without the discharge inert film 22.

Figure 9:
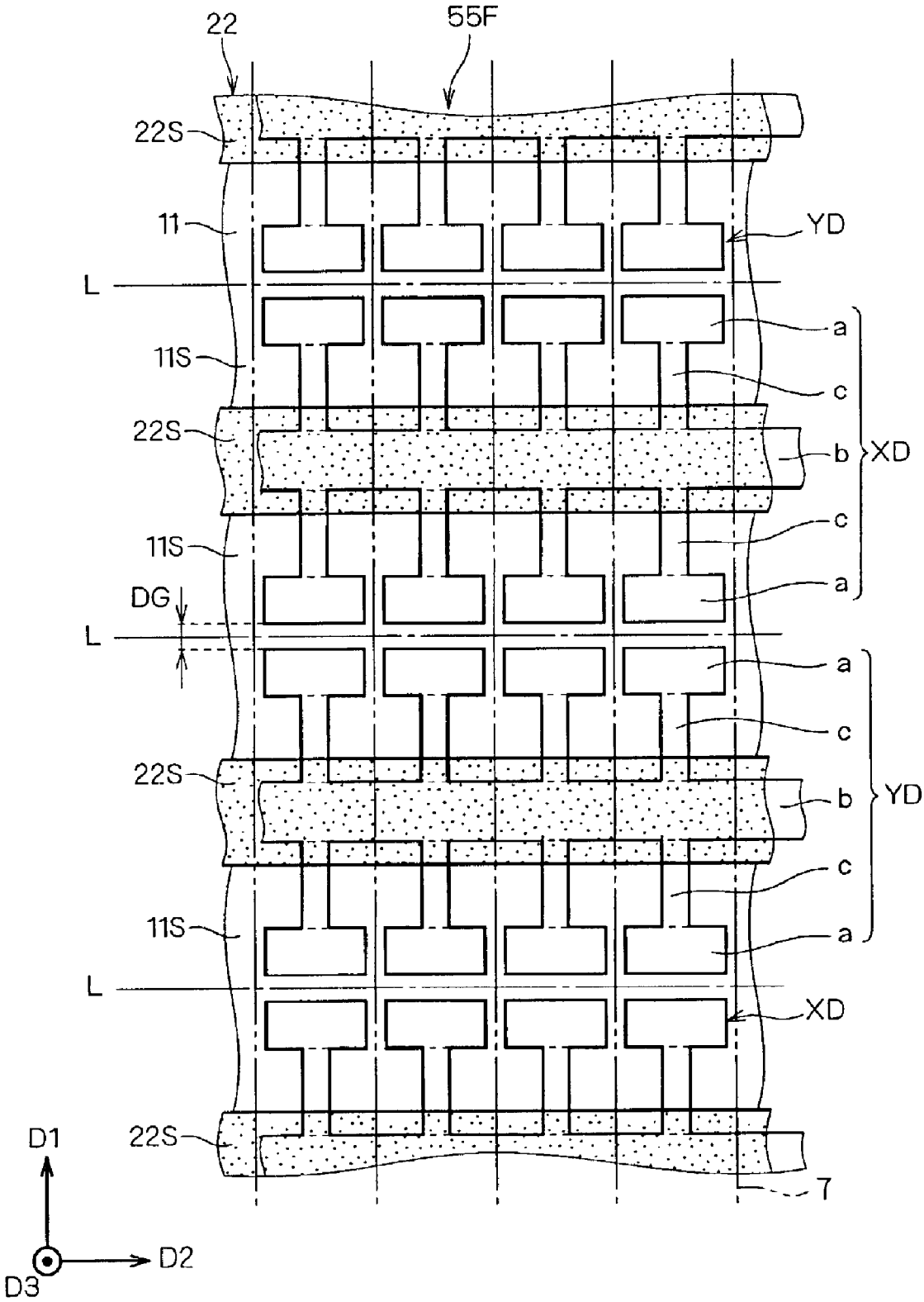
FIG. 9 is a plan view illustrating a third front substrate and a PDP including the front substrate in accordance with the second preferred embodiment.

FIG. 9 is a plan view illustrating a third front substrate 55F and a PDP 51 including the front substrate 55F in accordance with the second preferred embodiment. Sustain discharge electrodes XD and YD of the front substrate 55F each have a plane pattern in which two sustain discharge electrodes XB and YB between adjacent display lines L in the front substrate 53F of FIG. 4, more specifically two bus portions b, are united in one (made continuous). For this reason, the adjacent display lines L share one sustain discharge electrode XC or YD. Conversely, each of the sustain discharge electrodes XD and YD defines both the adjacent display lines L.

In the front substrate 55F, no adjoining sustain discharge electrode pair gap portion NG (see FIG. 4) is provided and a plurality of gap portions between a plurality of sustain discharge electrodes X and Y all correspond to the discharge gap portions DG. In each of sustain discharge electrodes XD and YD, one bus portion b is disposed between adjacent display lines L or adjacent discharge gap portions DG, and a plurality of bridge-building portions c are provided separately on both sides (upper and lower in FIG. 9) of one bus portion b and the bridge-building portions c on either side extend towards their adjacent display line L. The bridge-building portions c of the sustain discharge electrodes XD and YD are connected to the discharge gap adjoining portions a, respectively. The width of the bus portion b (size in the first direction D1) is appropriately determined. Other constituents of the front substrate 55F are the same as those of the front substrate 53F of FIG. 4, and the front substrate 55F produces the same effect as the front substrate 53F of FIG. 4.

Figure 10:
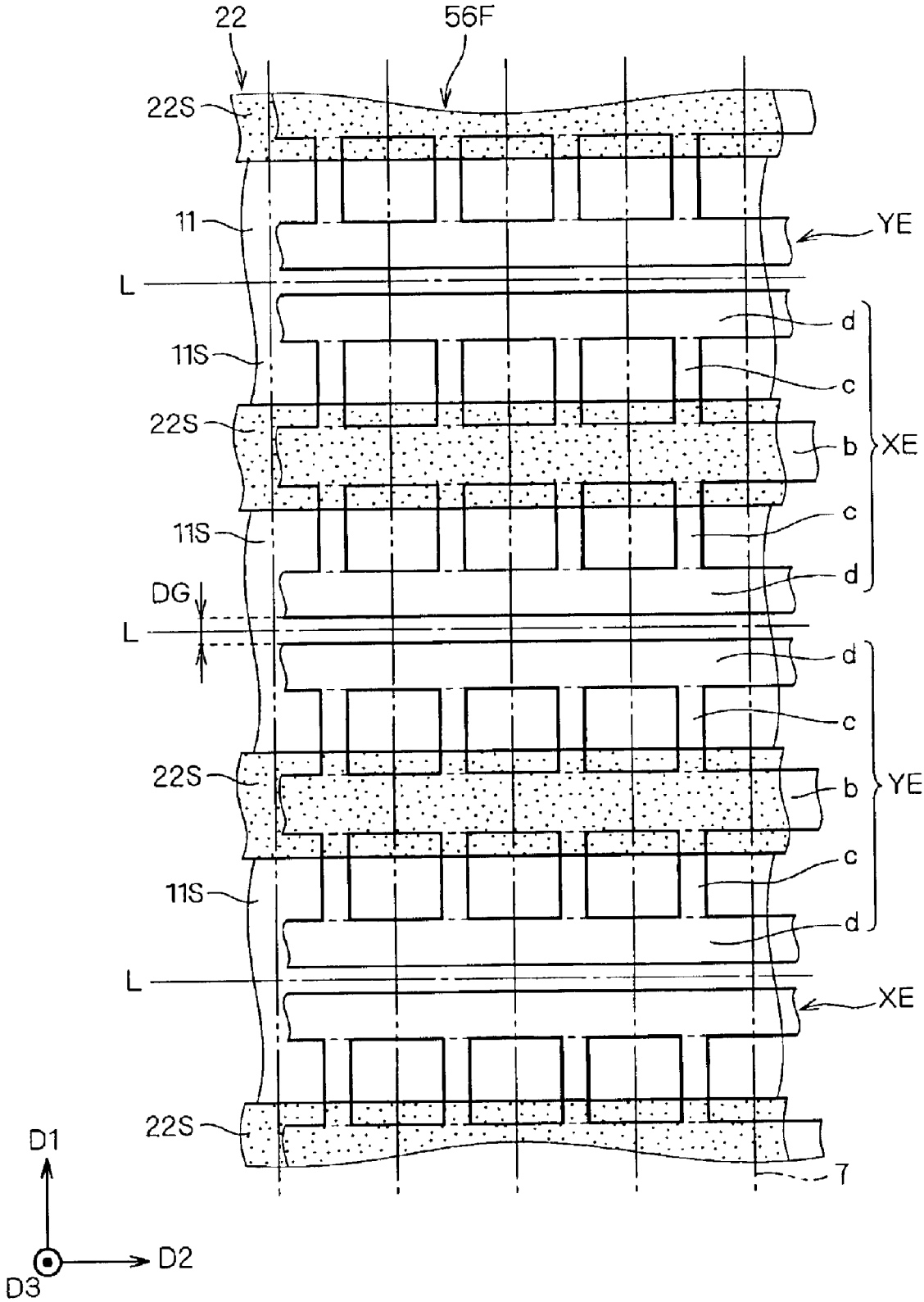
FIG. 10 is a plan view illustrating a fourth front substrate and a PDP including the front substrate in accordance with the second preferred embodiment.

FIG. 10 is a plan view illustrating a fourth front substrate 56F and a PDP 51 including the front substrate 56F in accordance with the second preferred embodiment. Sustain discharge electrodes XE and YE of the front substrate 56F each have a plane pattern in which two sustain discharge electrodes XC and YC between adjacent display lines L in the front substrate 54F of FIG. 6, more specifically two bus portions b, are united in one (made continuous).

Each of the sustain discharge electrodes XE and YE includes a bus portion b and a plurality of bridge-building portions c like those in the sustain discharge electrode XD or YD of FIG. 9 and further includes two discharge gap adjoining portions d. One discharge gap adjoining portion d is connected in common to some of the bridge-building portions c (specifically, a plurality of bridge-building portions c aligned in the second direction D2 on one side of the bus portion b), and similarly the other discharge gap adjoining portion d is connected in common to the others of the bridge-building portions c (specifically, a plurality of bridge-building portions c aligned in the second direction D2 on the other side of the bus portion b). The width of the bus portion b (size in the first direction D1) is appropriately determined. Other constituents of the front substrate 56F are the same as those of the front substrate 54F of FIG. 6, and the front substrate 56F produces the same effect as the front substrate 54F of FIG. 6.

Figure 11:
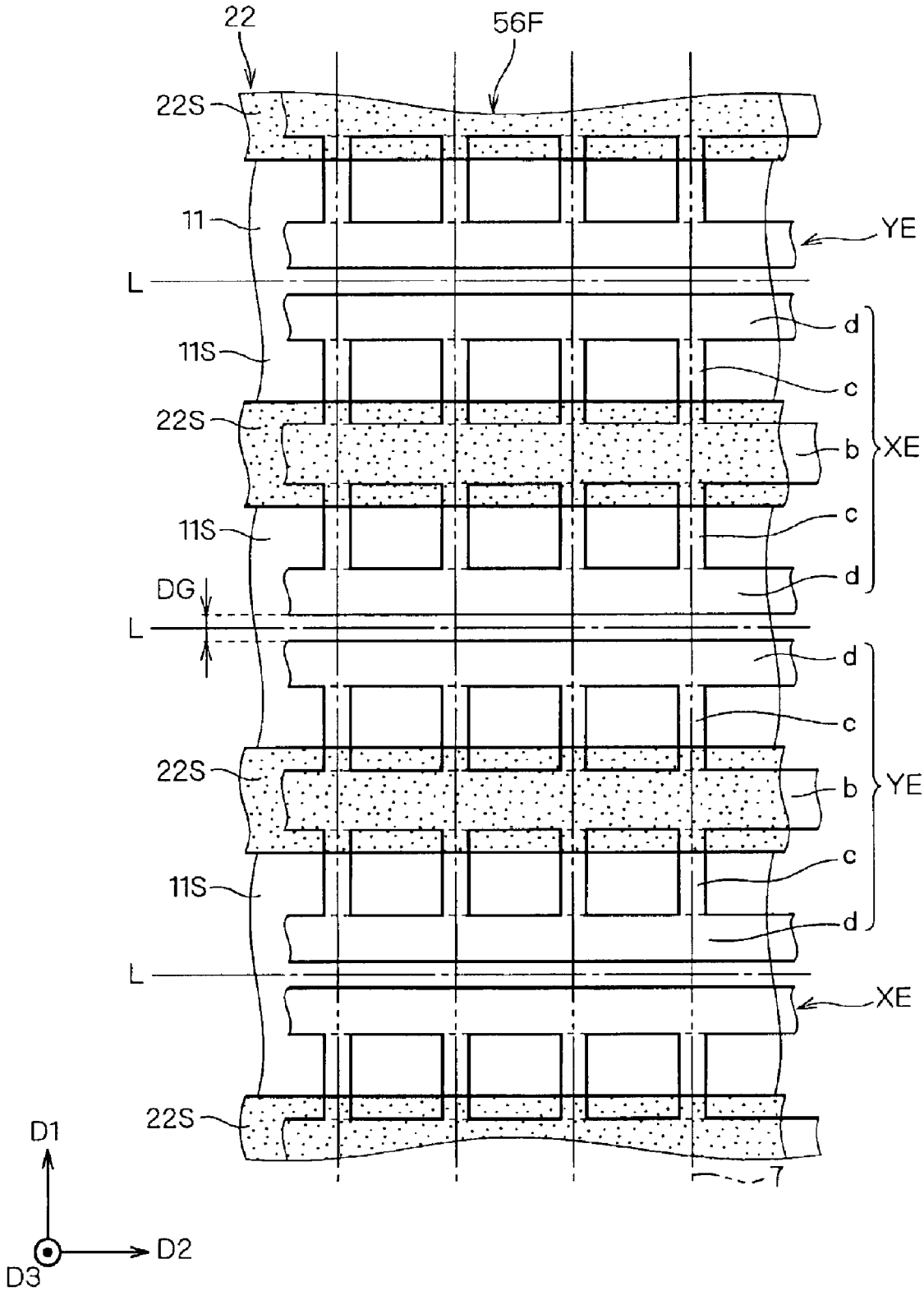
FIG. 11 is a plan view illustrating another PDP including the fourth front substrate in accordance with the second preferred embodiment.

Like in the PDP 51 of FIG. 7, the front substrate 56F and the rear substrate 51R (see FIG. 23) may be formed so that strip-like patterns of the barrier rib 7 and the bridge-building portions c of the sustain discharge electrodes XE and YE should be opposed to each other (see FIG. 11). Further, like in the PDP 51 of FIG. 8, the front substrate 55F and the rear substrate 51R (see FIG. 23) may be formed so that strip-like patterns of the barrier rib 7 and the bridge-building portions c of the sustain discharge electrodes XD and YD should be opposed to each other, and in other words, areas between a plurality of discharge gap adjoining portions a aligned in the second direction D2 should not be opposed to the strip-like patterns of the barrier rib 7 (see FIG. 12). The PDPs 51 shown in FIGS. 11 and 12 produce the same effect as the PDPs of FIGS. 7 and 8, respectively.

The Third Preferred Embodiment

Figure 13:
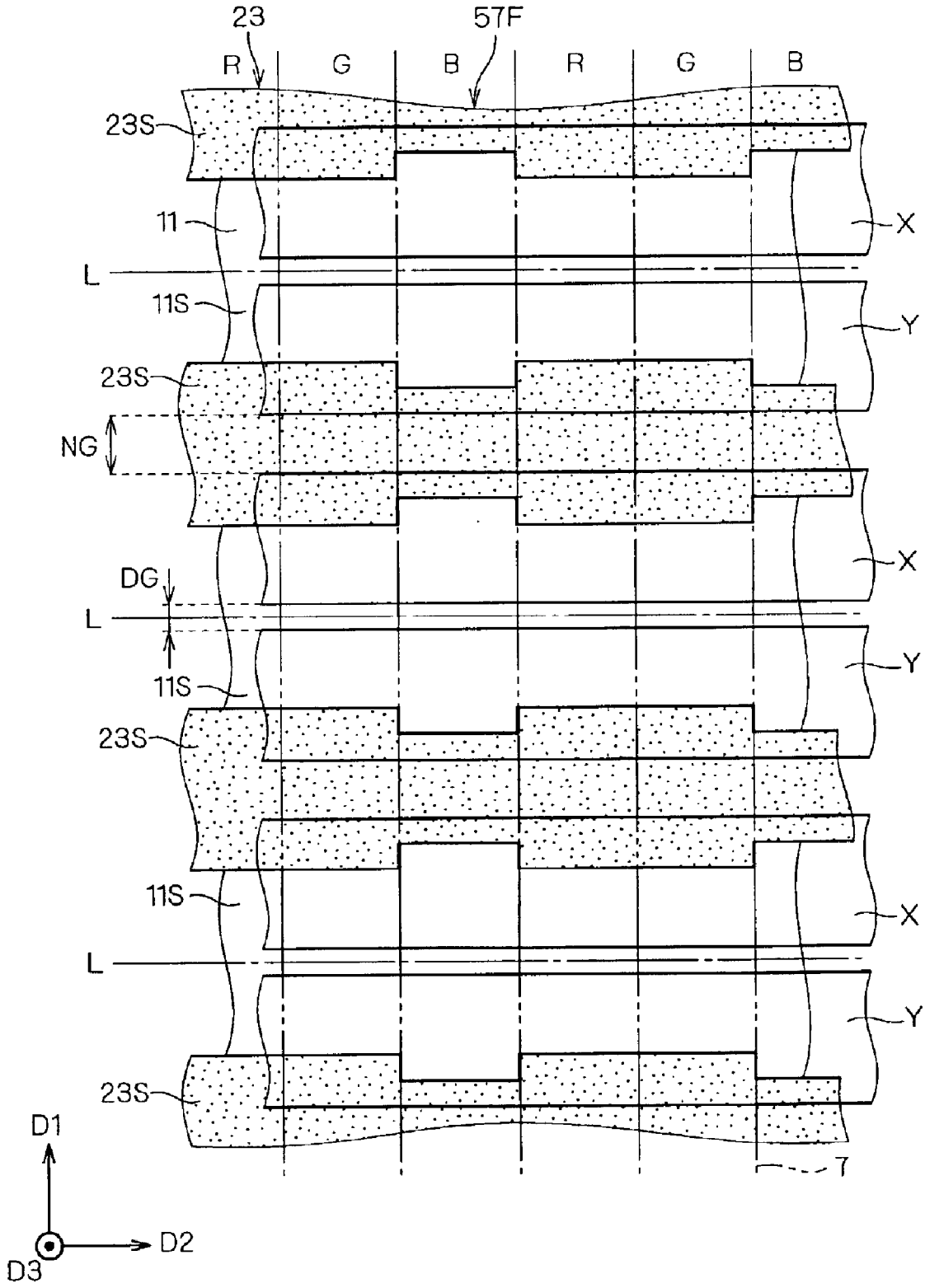
FIG. 13 is a plan view illustrating a front substrate and a PDP including the front substrate in accordance with a third preferred embodiment of the present invention.

FIG. 13 is a plan view illustrating a front substrate 57F and a PDP 51 including the front substrate 57F in accordance with the third preferred embodiment. Signs R, G and B in FIG. 13 represent luminescent colors (red, green and blue, respectively) from each group of discharge cells which are aligned in the first direction D1 or from each phosphor 8 contact with discharge space 51S which extends along the first direction D1.

The front substrate 57F includes a discharge inert film 23 which corresponds to the earlier-discussed discharge inert film 21 (see FIG. 2) and other constituents thereof are the same as those of the front substrate 51F (see FIG. 2). The discharge inert film 23 of the front substrate 57F has exposed surfaces 23S forming a plane pattern different from that of the discharge inert film 21 of FIG. 2.

In more detail, the pattern width (size in the first direction D1) of a portion in the discharge inert film 23 which is opposed to one of the phosphors 8 which is used for blue light emission is narrower than other portion. Correspondingly to this, in the front substrate 57F, the pattern width (size in the first direction D1) of a portion in the exposed surfaces 11S of the cathode film 11 which is opposed to one of the phosphors 8 which is used for blue light emission is wider than other portion. Therefore, the exposed surface 11S of the cathode film 11 in a blue light emission cell C is wider than that of a red light emission cell C and a green light emission cell C. With this structure, it is possible to make the surface discharge 50 generated on the front substrate 57F in the discharge cell C and the discharge current larger in the blue light emission cell C than those in the red light emission cell C and the green light emission cell C. Therefore, according to the PDP 51 including the front substrate 57F, it is possible to ensure higher color temperature in white display since blue light is emitted with higher intensity than red and green lights.

Further, it is possible, for example, to further reduce displacement in white display from blackbody radiation locus by controlling the pattern shape of the exposed surfaces 23S and 11S of the discharge inert film 23 and the cathode film 11 so that the surface discharge 50 in the green light emission cell C should be smaller than that in the red light emission cell C and the blue light emission cell C.

Thus, since the exposed surfaces 23S and 11S of the discharge inert film 23 and the cathode film 11 are patterned so that the magnitude of the surface discharge 50 generated on the front substrate 57F should depend on the luminescent color of each of a plurality of discharge cells C, the front substrate 57F and the PDP 51 including the front substrate 57F can adjust the luminescence intensity for each luminescent color. This allows improvement in color balance of display.

Though FIG. 13 shows the case where the pattern edge of the discharge inert film 23 is angulate as two-dimensionally viewed at a portion where the pattern width is changed, the pattern edge may be (smoothly) rounded to change the pattern width. Further, the discharge inert film 23 can be patterned by the screen printing method (the same method for the earlier-discussed discharge inert film 21), the vapor deposition lift-off method or the like.

Combination of the discharge inert film 23 in the third preferred embodiment and the earlier-discussed sustain discharge electrodes XA to XE and YA to YE can also produce the same effect.

The Fourth Preferred Embodiment

Figure 14:
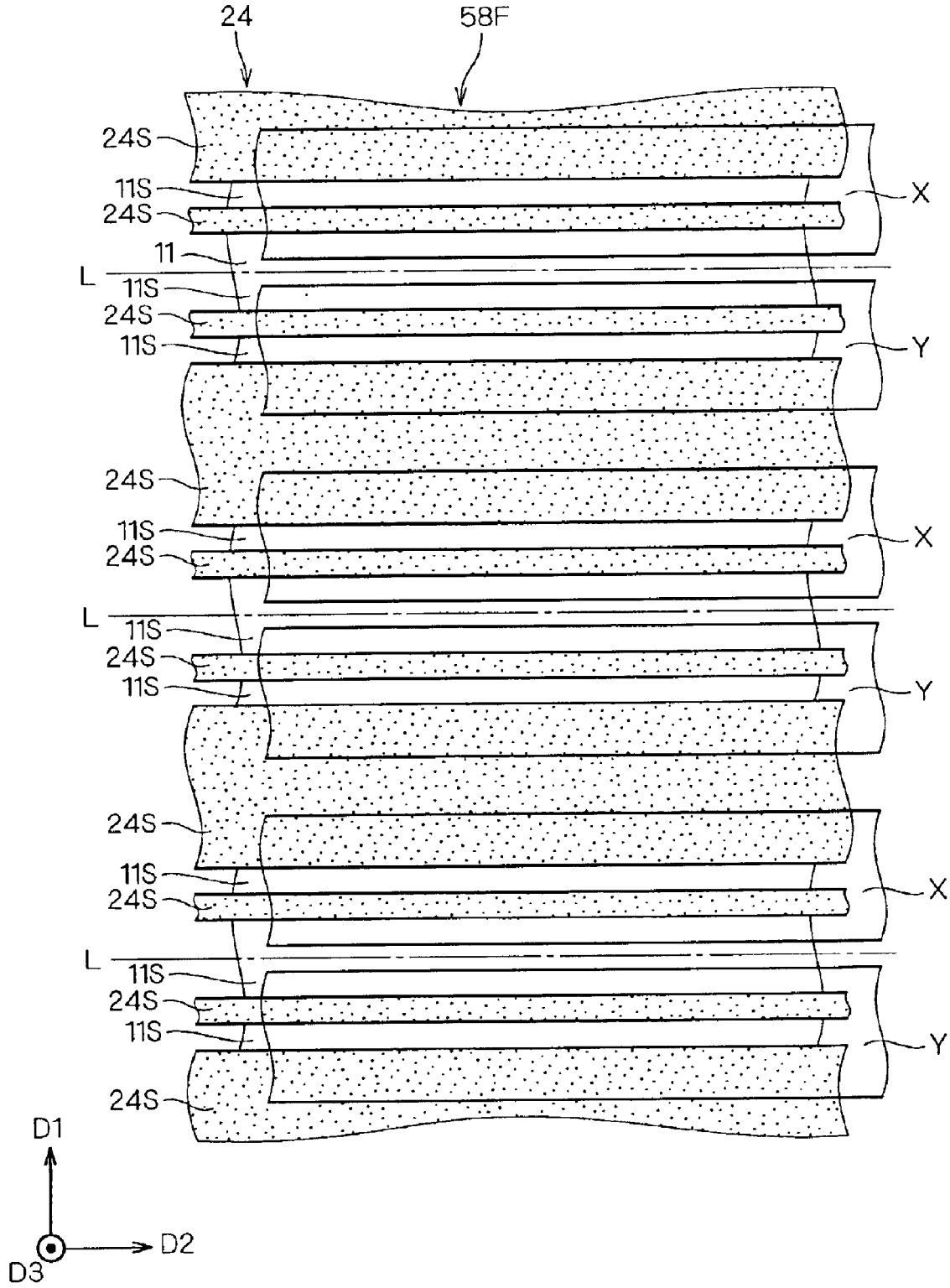
FIG. 14 is a plan view illustrating a front substrate in accordance with a fourth preferred embodiment of the present invention.

FIG. 14 is a plan view illustrating a front substrate 58F in accordance with the fourth preferred embodiment. The front substrate 58F includes a discharge inert film 24 which corresponds to the earlier-discussed discharge inert film 21 (see FIG. 2) and other constituents thereof are the same as those of the front substrate 51F (see FIG. 2). The discharge inert film 24 of the front substrate 58F is made of a plurality of strip-like patterns like the exposed surfaces 21S of the discharge inert film 21 (see FIG. 2) and a plurality of another strip-like patterns.

In more detail, a plurality of another strip-like patterns of the discharge inert film 24 are so disposed as to be opposed to the sustain discharge electrodes X and Y as the front substrate 58F is two-dimensionally viewed and moreover so disposed as to section each of the sustain discharge electrodes X and Y (into two herein) in the alignment direction of the sustain discharge electrodes X and Y, i.e., the first direction D1 as two-dimensionally viewed. In other words, the discharge inert film 24 has exposed surfaces 24S in areas corresponding to the areas between a plurality of display lines L and areas that section each of a plurality of sustain discharge electrode X and Y in the first direction D1 as two-dimensionally viewed. Further, the discharge inert film 24 can be patterned by the screen printing method (the same method for the earlier-discussed discharge inert film 21), the vapor deposition lift-off method or the like.

Correspondingly to this, (the exposed surfaces 11S of) the cathode film 11 of the front substrate 58F has a pattern in which the exposed surfaces 11S of the front substrate 51F are sectioned by a plurality of another strip-like patterns discussed above. Therefore, the surface discharge 50 in each discharge cell C (see FIG. 23) extends step by step from the exposed surface 11S near the discharge gap portion DG (or on the discharge gap portion DG) to the exposed surface 11S away from the discharge gap portion DG. For this reason, in the front substrate 5 8F, the discharge on the exposed surface 11S away from the discharge gap portion DG is not yet actively generated while the discharge is actively generated on the exposed surface 11S near the discharge gap portion DG, and the discharge on the exposed surface 11S near the discharge gap portion DG almost comes to an end when the discharge on the exposed surface 11S away from the discharge gap portion DG is actively generated.

Since such a mode of discharge can reduce a momentary peak current of the discharge, the peak load of the driving device 91 of FIG. 1 can be reduced. As a result, it is possible to reduce the cost for the driving device 91.

Though the momentary peak amount of discharges (plasmas) generated on the exposed surface 11S of the cathode film 11 in the PDP 51 including the front substrate 58F is smaller than that in the PDP 51 including the front substrate 51F, the momentary amounts of generated ultraviolet rays in these PDPs are almost equal since the plasma extends to almost the same degree. In other words, since the efficiency of ultraviolet ray generation relative to energy thrown for the discharge is improved, the luminous efficiency of display is improved.

Japanese Patent Application Laid Open Gazette No. 10-149774 discloses a PDP in which no discharge inert film is provided and a pattern of sustain discharge electrodes is sectioned in an alignment direction of the sustain discharge electrodes. In contrast to this, the pattern of the sustain discharge electrodes X and Y themselves below portions of the discharge inert film 24 which are provided to section the sustain discharge electrodes X and Y is not sectioned in the front substrate 58F. Therefore, the PDP 51 including the front substrate 58F has an advantage in that the firing voltage is low since a stronger electric field can be applied in the discharge space 51S.

Combination of the discharge inert film 24 in the fourth preferred embodiment and the earlier-discussed sustain discharge electrodes XA and YA of the front substrate 52F of FIG. 3 can also produce the same effect.

The Fifth Preferred Embodiment

Figure 25:
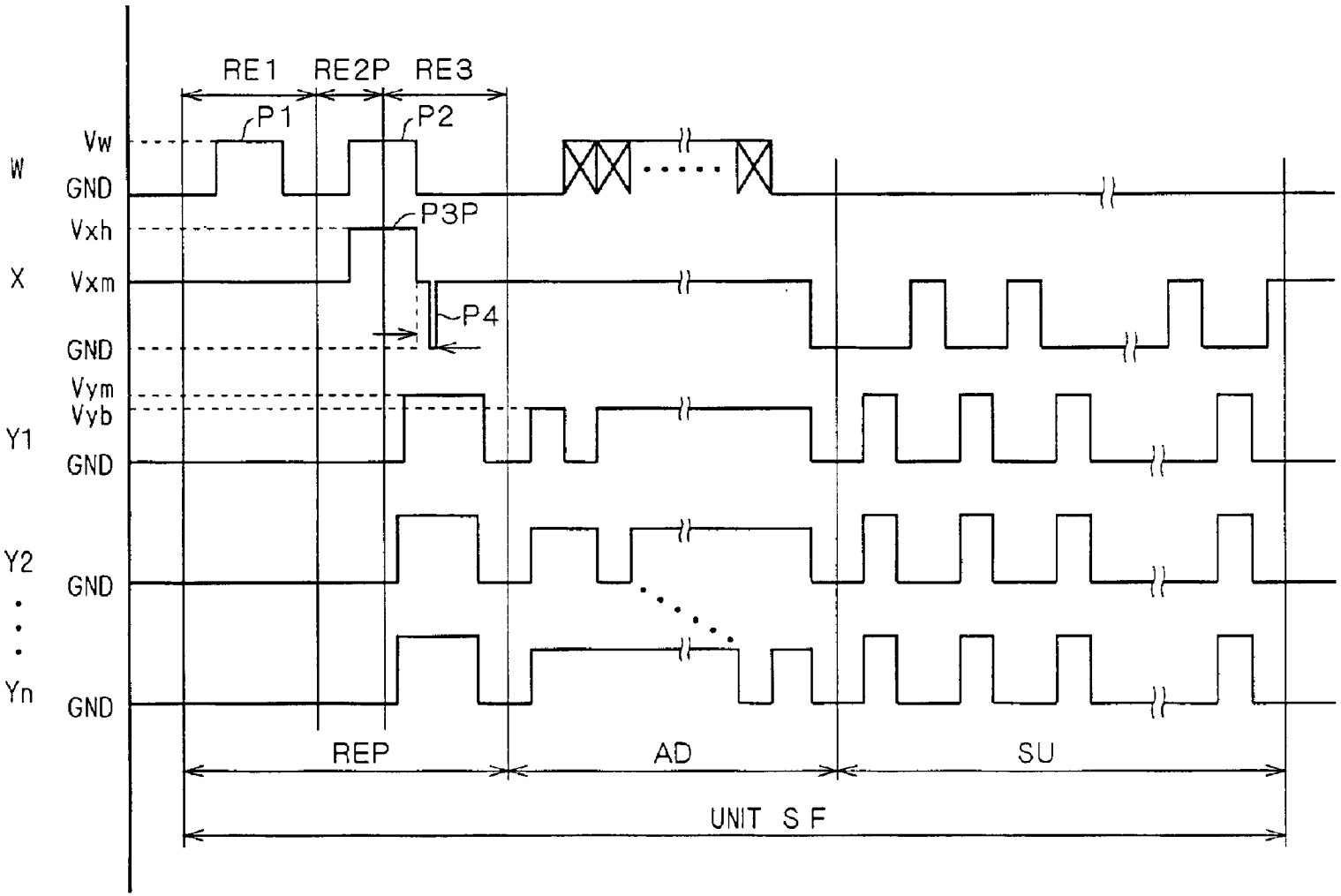
FIG. 25 (PRIOR ART)
FIG. 25 is a timing chart used for explaining a method of driving a PDP in the background art.

As early discussed, from the examination by the inventor of the present invention, it is found that applying the driving method of FIG. 25 to the PDP 51P including the discharge inert film 21P formed by the above-discussed vapor deposition lift-off method causes a problem that sustain discharge is not generated well enough during the discharge sustain period SU even in the cell selected in the writing period (or addressing period) AD. Empirically, in most cases, such a problem is caused by unstable initialization of wall charges in the reset period REP ahead of the writing period AD. On the basis of this, it is presumed that the mechanism of this problem should be as follows.

With the sustain pulse voltage (around 150 to 200 V) in the discharge sustain period SU, the surface discharge 50 is generated only in portions of the sustain discharge electrodes X and Y which are not covered with the discharge inert film 21P. In the second period RE2P of the reset period REP shown in FIG. 25, however, a voltage (around 250 to 400 V) higher than the sustain pulse voltage is applied across the sustain discharge electrodes X and Y with a sharp switching in order to generate a sufficiently strong priming discharge in all the cells. With this, a priming discharge is probabilistically generated also in portions of the sustain discharge electrodes X and Y which are covered with the discharge inert film 21P and the wall charges are accumulated on a surface of the discharge inert film 21P above the portions. In the following third period RE3, however, since the voltage applied across the sustain discharge electrodes X and Y is almost equal to the sustain pulse voltage (around 150 to 200 V), an erase discharge for initialize the wall charges is hard to generate in the portions of the sustain discharge electrodes X and Y which are covered with the discharge inert film 21P. Therefore, when the probabilistic priming discharge is generated, the writing period AD starts with the wall charges which are accumulated in the discharge inert film 21P and not initialized, and as a result, a writing discharge becomes unstable to cause the above problem.

Then, the fifth preferred embodiment provides a PDP and a plasma display device which can solve the above problem.

Figure 15:
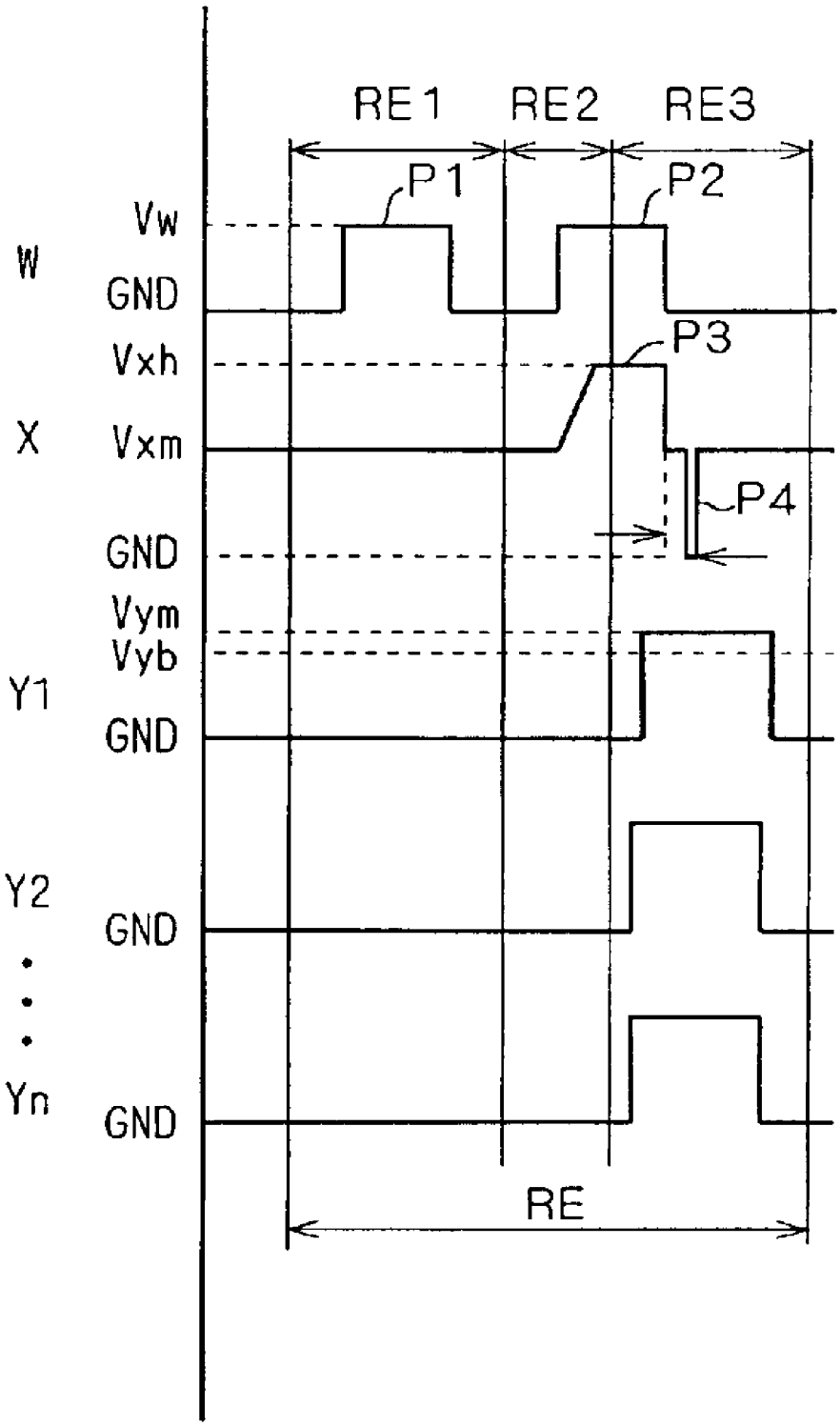
FIG. 15 is a timing chart used for explaining a method of driving a PDP in accordance with a fifth preferred embodiment of the present invention.

FIG. 15 is a timing chart (voltage waveform) used for explaining a driving method or driving sequence for a PDP in accordance with the fifth preferred embodiment. The driving device 91 of FIG. 1 drives the PDP 51 by supplying electrodes X, Y and W of the PDP 51 with predetermined potentials according to the timing chart. Though a case where the PDP 51 of the plasma display device 101 includes the front substrate 51 will be discussed herein, the present driving method can be also applied to the PDP 51 using the front substrate 52 (see FIG. 3) or the like.

A reset period RE of FIG. 15 is adopted instead of th reset period REP of FIG. 25. In particular, the reset period RE of the fifth preferred embodiment includes the second period RE2, instead of the second period RE2P of FIG. 25, and the first and third reset periods RE1 and RE3 like those in the timing chart of FIG. 25. Specifically, while a sharp transition of the voltage applied to the sustain discharge electrodes X for generation of the priming discharge in all the cells takes place from an intermediate potential Vxm to the maximum potential Vxh (see a rise of a pulse P3P) in the second period RE2P of FIG. 25, the driving device 91 gradually increases the potential of the sustain discharge electrodes X to cause the above potential transition in the driving method of the fifth preferred embodiment (see a rise of a pulse P3 which replaces the pulse P3P). This gradually increases the difference in potential between adjacent sustain discharge electrodes X and Y Though FIG. 15 shows a case where the pulse P3 linearly increases (i.e., ramp waveform), a pulse which gradually increases in a curve may be used as the pulse P3.

According to this driving method, the strength of the electric field in the discharge space 51S reaches a level required to start a discharge at a timing until the potential of the sustain discharge electrode X reaches the maximum potential Vxh and the surface discharge 50 of the sustain discharge electrodes X and Y starts near the discharge gap portion DG. Since the discharge current of charged particles flows in the discharge space 51S when the discharge starts, electric charges are accumulated near the discharge gap portion DG on the exposed surface 11S of the cathode film 11 so that an electric field should be generated in the opposite direction to the voltage applied across the sustain discharge electrodes X and Y (accumulation of wall charges).

In particular, by making the pace of increase in potential difference between the sustain discharge electrodes X and Y sufficiently slow, the pace of accumulation of the wall charges can be made faster than the pace of increase in potential difference between the sustain discharge electrodes X and Y. In this case, with offset between the electric fields caused by the voltage applied across the sustain discharge electrodes X and Y and the wall charges, the electric field in the discharge space 51S becomes lower than a level required to keep the discharge soon after the discharge starts and once stops before the surface discharge 50 between the sustain discharge electrodes X and Y which is generated near the discharge gap DG sufficiently extends in the first direction D1. When the potential difference between the sustain discharge electrodes X and Y continues to gradually increase and the electric field in the discharge space 51S reaches the level required to start the discharge, the surface discharge 50 starts again. The further surface discharge 50, however, does not sufficiently extend due to the above mechanism. This phenomenon is also found in a surface discharge type AC-PDP having no discharge inert film disclosed in, e.g., Japanese Patent Application Laid Open Gazette No. 9-237580.

Therefore, by gradually increasing the potential difference between the sustain discharge electrodes X and Y in the reset period RE, it is possible to suppress extension of the surface discharge 50 as the priming discharge to the exposed surface 21S of the discharge inert film 21. Since this prevents probabilistic accumulation of wall charges in the discharge inert film 21 through the priming discharge, it is possible to stabilize initialization of the wall charges through the following third period RE3. As a result, the cell selectivity is ensured in the writing period AD and the sustain discharge can be surely generated in the selected discharge cell C during the discharge sustain period SU.

In the PDP 51 using the front substrate 53F or 54F (see FIGS. 4 to 8), it is possible to localize the priming discharge (surface discharge) generated at the discharge gap adjoining portion a or d in the reset period RE within a range of the discharge gap adjoining portion a or d or up to some midpoint of the bridge-building portion c, according to the above mechanism, also by sufficiently narrowing the width of the bridge-building portion c in the extension direction of the sustain discharge electrode (i.e., the second direction D2). This phenomenon is discussed in, e.g., Japanese Patent Application Laid Open Gazette No. 9-237580 and "Proceedings of the 5th International Display Workshops (IDW '98)", pp. 531–534, on a surface discharge type AC-PDP having no discharge inert film.

Therefore, by so arranging the pattern of the discharge inert film 22 in the front substrate 53F or 54F (see FIGS. 4 to 8) as not to cover the discharge gap adjoining portion a or d as two-dimensionally viewed and preferably as to be sufficiently away from the discharge gap adjoining portion a or d, it is possible to suppress extension of the priming discharge (surface discharge) generated between the sustain discharge electrodes in the reset period RE up to the exposed surface 22S of the discharge inert film 22. Further, as discussed above, combination of the PDP 51 using the front substrate 53F or 54F and the driving method of FIG. 15 may be adopted.

Also in the PDP using the discharge inert film in the structure where adjacent display lines share one sustain discharge electrode, it is possible to suppress extension of the priming discharge up to the exposed surface of the discharge inert film by using the above driving method and structure and produce the same effect. Further, the above PDPs using the discharge inert film in the structure where adjacent display lines share one sustain discharge electrode include, e.g., the PDP 51 including the front substrate 52F of FIG. 3 or the front substrate 55F or 56F of FIGS. 9 to 12 and PDPs disclosed in the Japanese Patent Application Laid Open Gazette Nos. 2000-39866 and 2001-147660. Furthermore, by driving these PDPs in a sequence where a period corresponding to the reset period in the driving sequence disclosed in, e.g., the Japanese Patent Application Laid Open Gazette Nos. 2000-39866 and 2001-147660 is replaced by, e.g., the reset period RE of FIG. 15, it is possible to prevent the priming discharge from reaching the discharge inert film. As a result, it is possible to surely generate the sustain discharge during the discharge sustain period in the discharge cell selected during the writing period AD. Since the priming discharge can be generated by gradually increasing the voltage applied across the sustain discharge electrodes X and Y in a driving sequence disclosed in FIGS. 8 and 10 of Japanese Patent Application Laid Open Gazette No. 2001-15034, that disclosed in FIGS. 4 and 5 of "Proceedings of The 21st International Display Research Conference in conjunction with The 8th International Display Workshops (Asia Display/IDW '01", pp. 869–872 and that disclosed in FIGS. 3 and 4 of the same document, pp. 1757–1758, application of these driving sequences can produce the same effect.

Variations Common to The First to Fifth Preferred Embodiments

Figure 16:
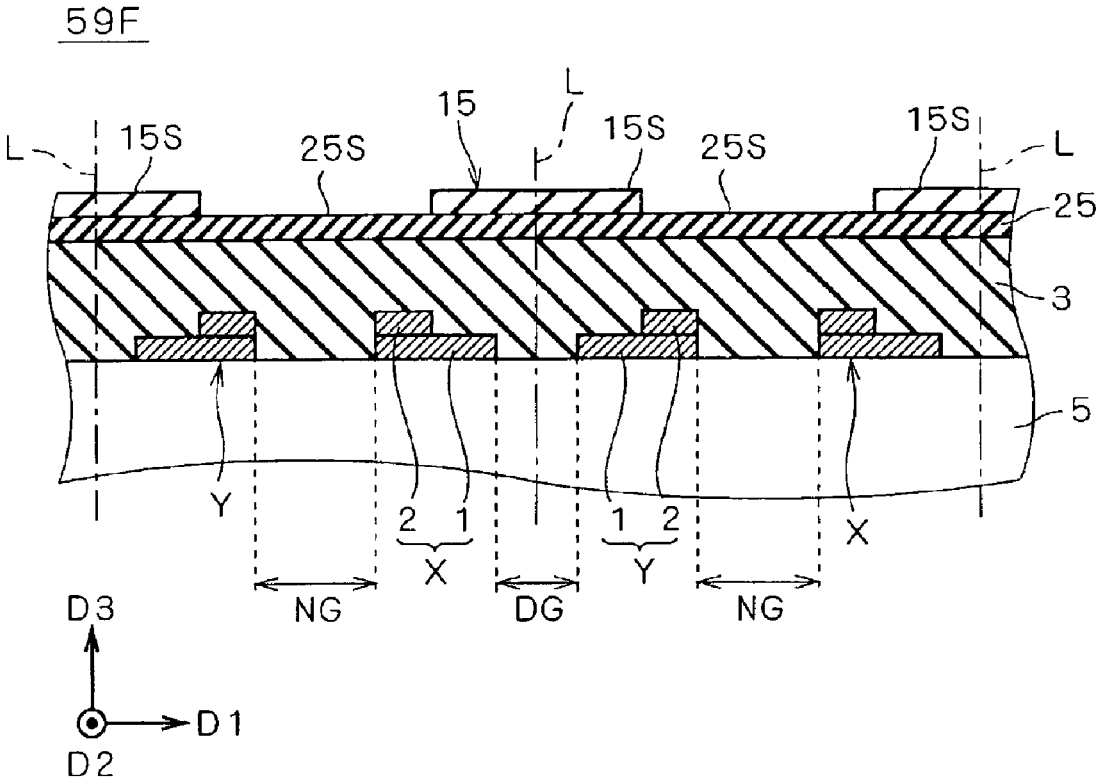
FIG. 16 is a cross section illustrating a first front substrate in a variation common to the first to fifth preferred embodiments.
Figure 17:
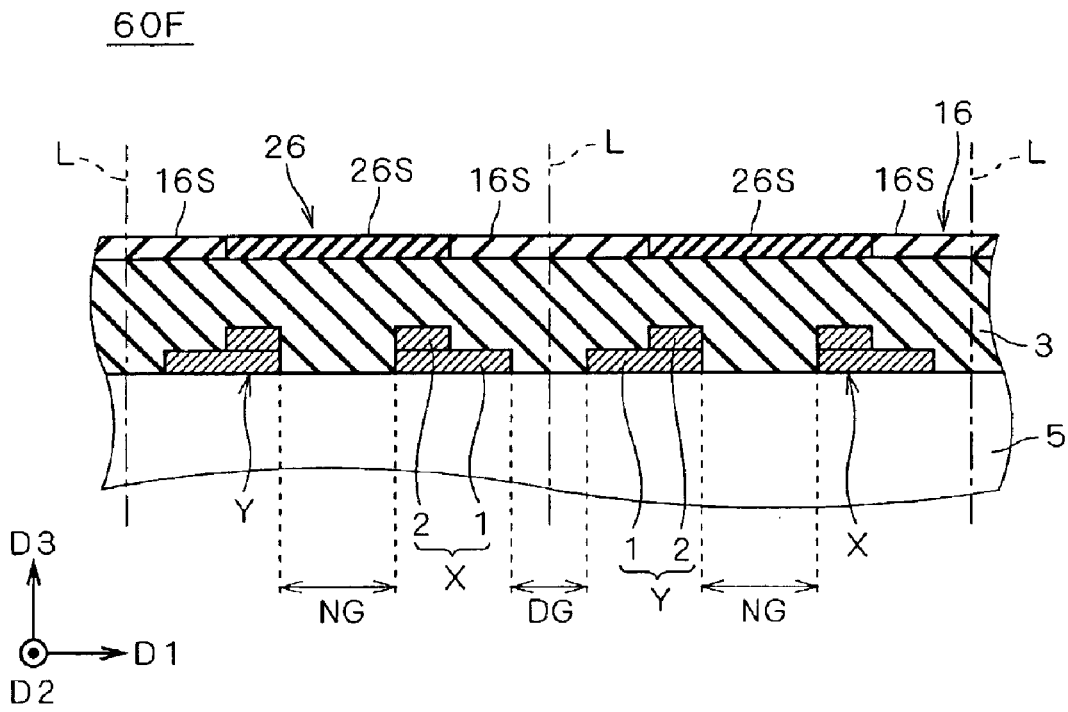
FIG. 17 is a cross section illustrating a second front substrate in the variation common to the first to fifth preferred embodiments.

Though the discharge inert film 21 is disposed on the cathode film 11 in the above front substrate 51, for example, the cathode film and the discharge inert film may be disposed like those in front substrates 59F and 60F shown in the cross sections of FIGS. 16 and 17. In more detail, in the front substrate 59F of FIG. 16, the dielectric layer 3, a discharge inert film 25 and a cathode film 15 are disposed in this order. The discharge inert film 25 is formed entirely on the dielectric layer 3, covering the sustain discharge electrodes X and Y, like the earlier-discussed cathode film 11 (see FIG. 2). The cathode film 15 consists of a plurality of strip-like patterns, like the earlier-discussed discharge inert film 21 (see FIG. 2). The cathode film 15 is patterned so that exposed surfaces 25S and 15S of the discharge inert film 25 and the cathode film 15, respectively, should be disposed like the exposed surfaces 21S and 11S of the discharge inert film 21 and the cathode film 11, respectively, as the front substrate 59F is two-dimensionally viewed.

In the front substrate 60F of FIG. 17, both a discharge inert film 26 and a cathode film 16 are disposed on the dielectric layer 3. The discharge inert film 26 and the cathode film 16 are patterned so that exposed surfaces 26S and 16S of the discharge inert film 26 and the cathode film 16, respectively, should be disposed like the exposed surfaces 21S and 11S of the discharge inert film 21 and the cathode film 11, respectively, as the front substrate 60F is two-dimensionally viewed.

It goes without saying that the arrangement relation (layout) of the cathode film 15 and the discharge inert film 25 and that of the cathode film 16 and the discharge inert film 26 may be applied to other earlier-discussed front substrate 52F and the like.

Further, though the barrier rib 7 is provided on the rear substrate 51R in the PDP 51, there may be an arrangement where the barrier rib 7 is formed on the front substrate 51F prior to the cathode film. Though the barrier rib 7 has a strip-like pattern extending along the first direction D1 in the PDP 51, the barrier rib 7 may be formed to have a grating pattern in which an additional component extending along the second direction D2 is provided in a position corresponding to the area between the display lines L.

In the PDP 51, a display light can be taken out from not only the side of the front substrate 51F but also the side of the rear substrate 51R.

In the plasma display device 101, though the case has been discussed where the sustain discharge electrodes Y, accordingly the display lines L, are sequentially selected (scanned) during the addressing period AD, the address electrode W can be driven as a scan electrode.

The Sixth Preferred Embodiment

Figure 18:
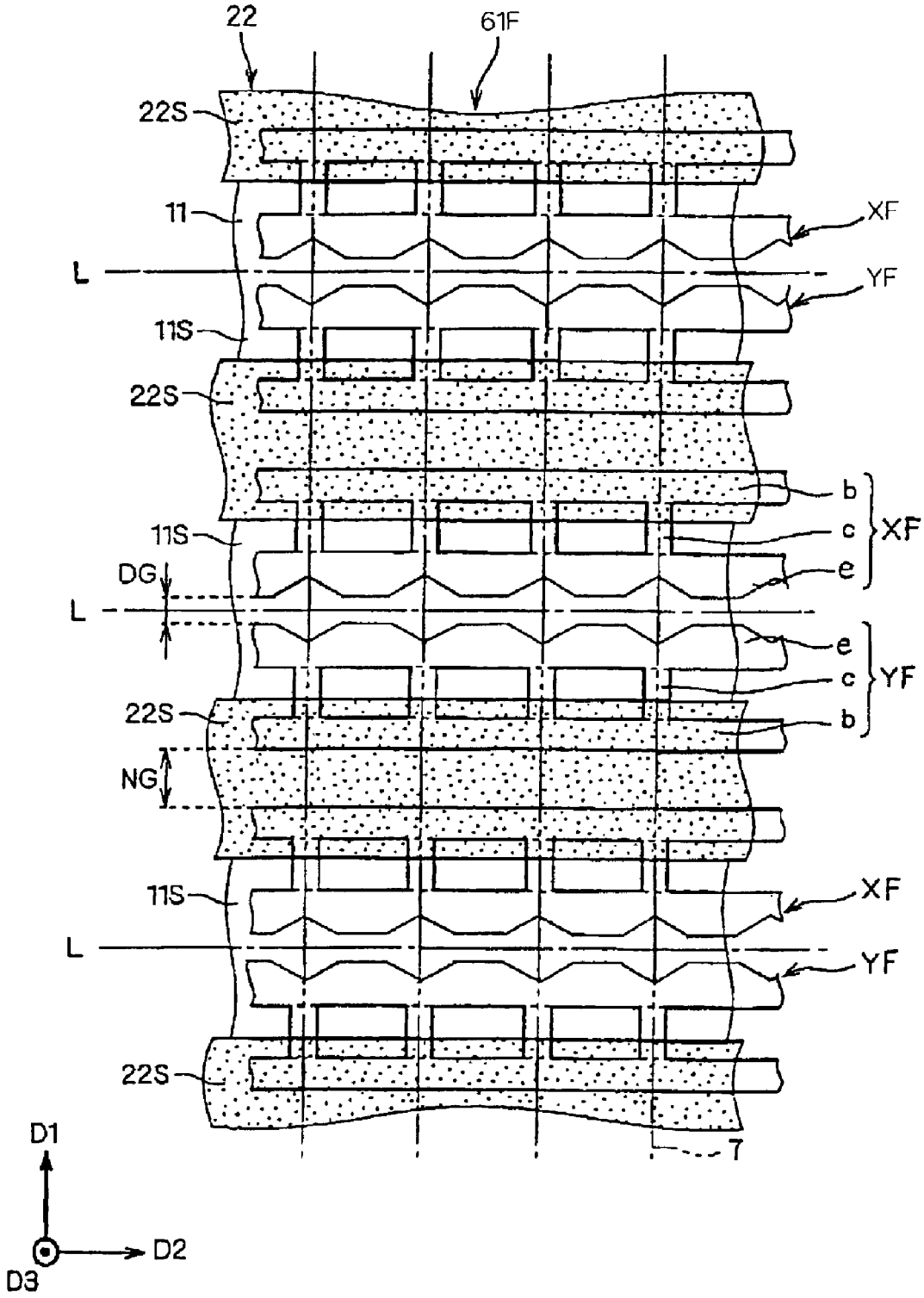
FIG. 18 is a plan view illustrating a first front substrate and a PDP including the front substrate in accordance with a sixth preferred embodiment of the present invention.

FIG. 18 is a plan view (layout view) illustrating a first front substrate 61F and a PDP 51 including the front substrate 61F in accordance with the sixth preferred embodiment. The front substrate 61F has a structure where the sustain discharge electrodes XC and YC of the front substrate 54F shown in FIG. 7 are replaced by sustain discharge electrodes XF and YF, and other constituents of the front substrate 61 F are basically the same as those of the front substrate 54F. The sustain discharge electrodes XF and YF of the front substrate 61F each include the bus portion b and the bridge-building portions c like those in the front substrate 54F and further include a discharge gap adjoining portion e.

The discharge gap adjoining portion e has such a shape as to make the size in the first direction D1 of the discharge gap portion DG adjoining the discharge gap adjoining portion e wider at a portion near the strip-like pattern of the barrier rib 7 in an area defined by adjacent strip-like patterns (or a first component) of the barrier rib 7 than at a center (central portion) in the second direction D2 in the area, as two-dimensionally viewed. In other words, an outline (or pattern edge) of the discharge gap adjoining portion e on the side of the discharge gap portion DG is designed so that the size of the discharge gap portion DG in the first direction D1 should be as above. Specifically, in the front substrate 61F of FIG. 18, the discharge gap adjoining portion e has a pattern in which a plurality of discharge gap adjoining portions (which correspond to a plurality of discharge gap adjoining portions a but each have a shape of trapezoid as two-dimensionally viewed) adjoining one another in the second direction D2 are connected to one another, being united in one (a pattern continuous across a plurality of bridge-building portions c adjoining along the second direction D2). Further, in the front substrate 61F of FIG. 18, an outline (or pattern edge) of the discharge gap adjoining portion e on the side of the bus portion b is linearly formed.

According to the discharge gap adjoining portion e having such a shape as shown in FIG. 18, the strength of the electric field which is generated in the discharge space above the discharge gap portion DG when a voltage is applied across the sustain discharge electrodes XF and YF which sandwich the discharge gap portion DG is made stronger at the central portion away from the barrier rib 7 than at a portion near the barrier rib 7. This allows the surface discharge between the sustain discharge electrodes XF and YF to extend from the central portion as a starting point. Therefore, since the portion near the barrier rib 7 hardly ever become a starting point of the surface discharge, it is possible to increase the energy of the plasma which remains until the charged particles in the plasma collide against the barrier rib 7 or the phosphor 8 covering a side wall surface of the barrier rib 7 to lose the energy. Moreover, since the size in the first direction D1 of the portion of the discharge gap portion DG near the barrier rib 7 becomes large, an extension area of the plasma is made larger as compared with the area of the portion in the sustain discharge electrodes where the sustain discharge is actually generated. For these reasons, since the amount of ultraviolet rays emitted from the plasma can be increased relatively to the sustain discharge current, an effect of improving the luminous efficiency can be produced.

Figure 19:
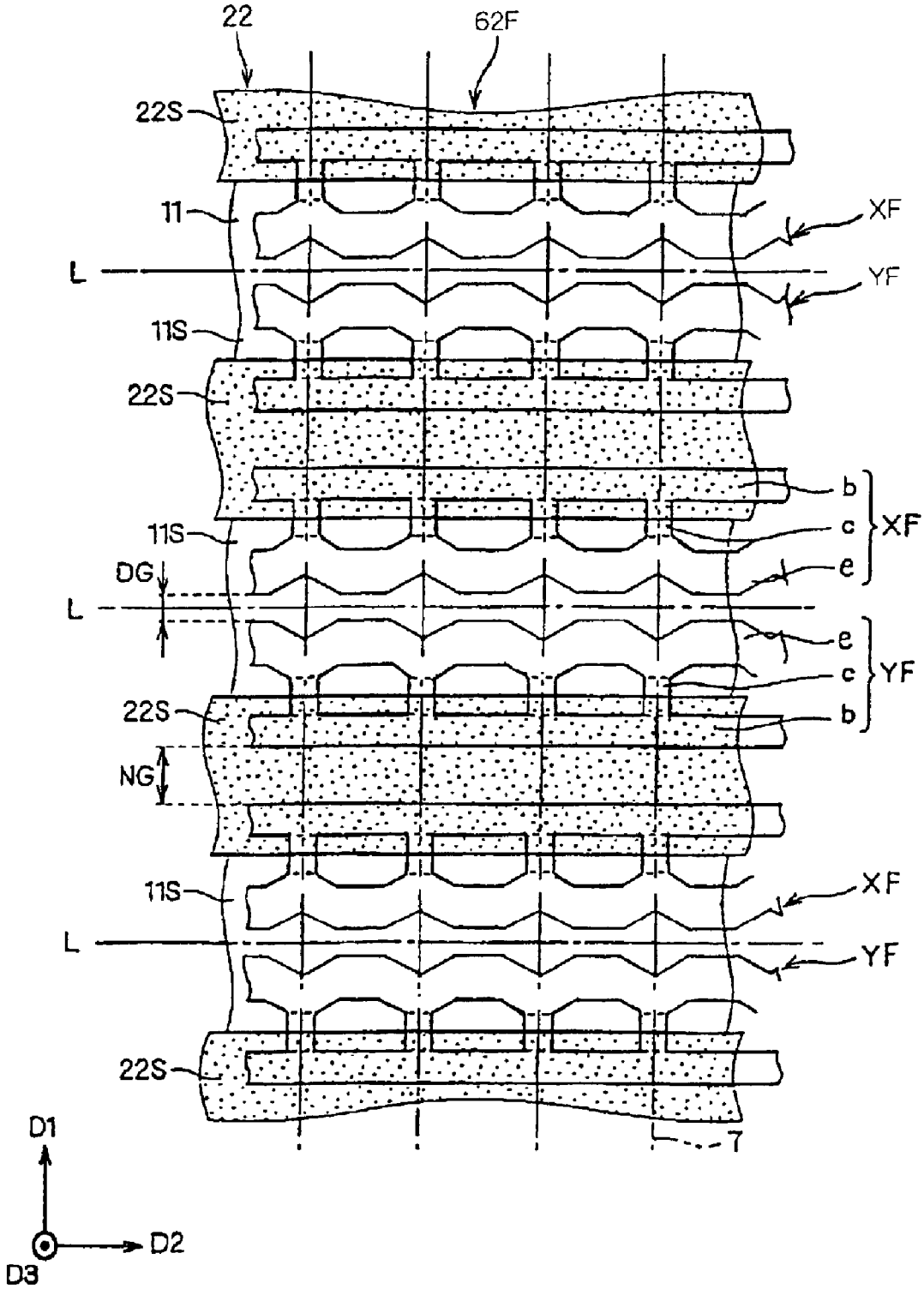
FIG. 19 is a plan view illustrating a second front substrate and a PDP including the front substrate in accordance with the sixth preferred embodiment.

The discharge gap adjoining portion e of the front substrate 61F shown in FIG. 18 corresponds to the discharge gap adjoining portion d of FIG. 7 with its outline changed on the side facing the discharge gap portion DG, and the outline on the side opposite to the discharge gap portion DG (i.e., the side of the bus portion b) can be also freely changed near the barrier rib 7, like in a second front substrate 62F of the sixth preferred embodiment shown in FIG. 19. In the front substrate 62F of FIG. 19, the size of the discharge gap adjoining portion e in the first direction D1 at a portion near the barrier rib 7 is equal, as two-dimensionally viewed, to that at the central portion 7 in the second direction D2 of the discharge space 51S defined by adjacent barrier ribs. Therefore, since the sustain discharge current becomes larger than that in the front substrate 61F of FIG. 18, the luminance is enhanced.

Figure 20:
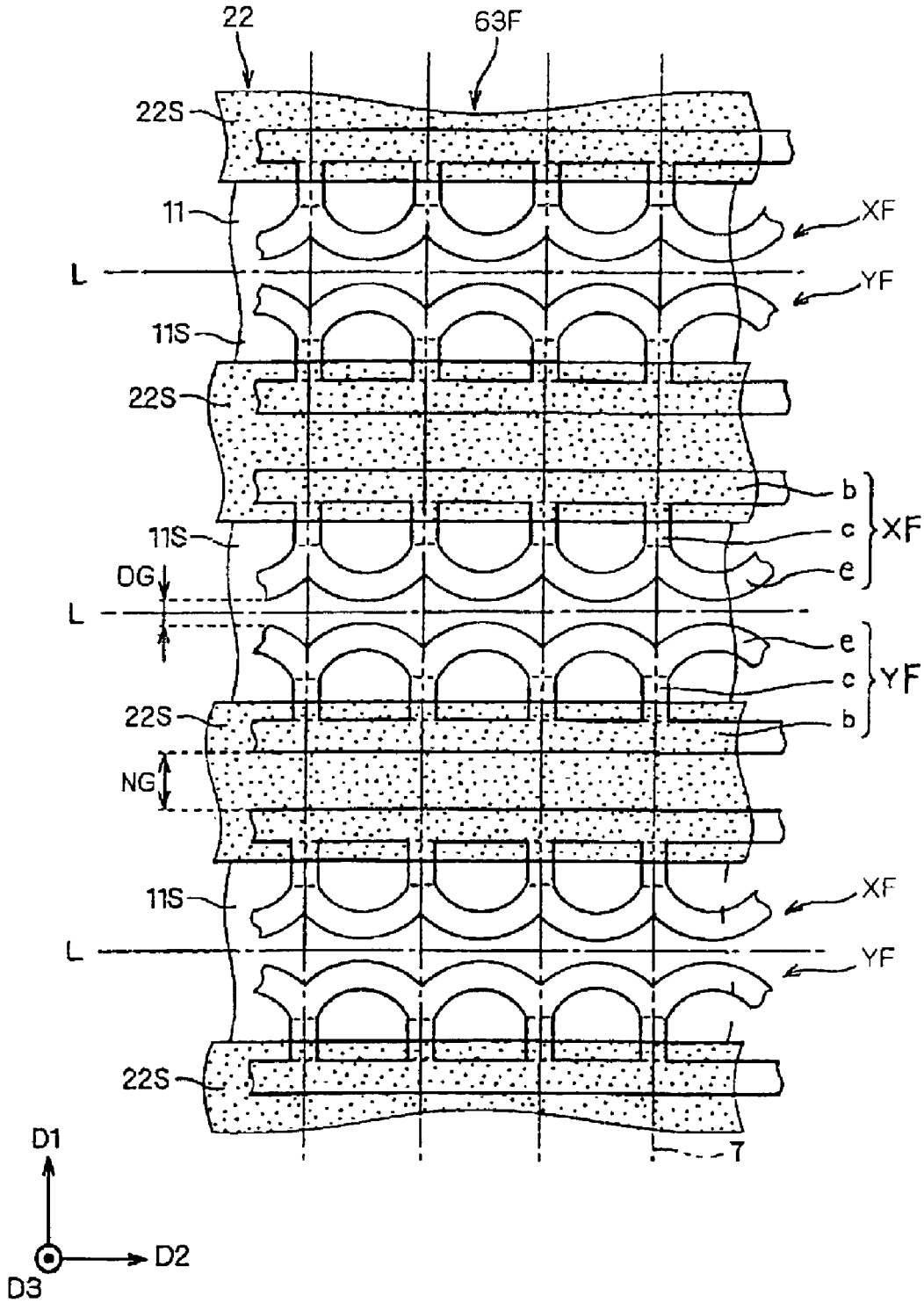
FIG. 20 is a plan view illustrating a third front substrate and a PDP including the front substrate in accordance with the sixth preferred embodiment.

Further, if the discharge gap adjoining portion e in the discharge space 51S per unit (one discharge cell or one area defined by adjacent two strip-like patterns of the barrier rib 7) may have an arch-like shape protruding towards the discharge gap portion DG, like in a third front substrate 63F of the sixth preferred embodiment shown in FIG. 20, the same effect can be produced.

The exemplary cases where the size of the discharge gap portion DG in the first direction D1 is made wider at a portion near the barrier rib 7 than at the central portion in the second direction D2 of the discharge space 51S defined by adjacent barrier ribs 7 are disclosed in FIGS. 11 to 15 of Japanese Patent Application Laid Open Gazette No. 2001-160361 and FIG. 1 of DIGEST of the international symposium conference 2001 (SID 01) of Society for Information Display, pp. 1328–1331.

In the Japanese Patent Application Laid Open Gazette No. 2001-160361, however, a sustain discharge is generated also on the bus portion (base portion). In this case, if the interval between bus lines facing the border between adjacent display lines (or two bus lines between adjacent display lines) is not considerably wide, there arises a problem that a wrong discharge is easily caused by interference between the surface discharges on the display lines. When the interval between the bus lines is made wide, however, since the bus line having a light-blocking characteristic becomes closer to the center of light emission in a cell, the luminous efficiency is lowered. Further, even when the discharge is generated on the bus portion, since the bus line has a light-blocking characteristic, the luminance does not increase so much though the power consumption increases due to the discharge and therefore the luminous efficiency is further lowered.

In contrast to this, in the front substrates 61F, 62F and 63F of FIGS. 18 to 20 in accordance with the present invention, since the discharge inert film 22 according to the earlier-discussed first and second preferred embodiments is formed for the bus portion b, it is possible to prevent generation of discharge on the bus portion b. Therefore, since there is no need to consider the above problem of wrong discharge, the interval between the bus portions b facing the border between adjacent display lines L can be made narrow. This produces an effect of improving the luminous efficiency.

Further, since each of the sustain discharge electrodes X and Y disclosed in the Japanese Patent Application Laid Open Gazette No. 2001-160361 on the whole, including the discharge gap adjoining portion, includes no transparent electrode and is formed of only metal electrode, the light emitted from the phosphor is blocked by the discharge gap adjoining portion. In contrast to this, since it is possible to prevent the discharge gap adjoining portion from blocking the light emitted from the phosphor by forming the discharge gap adjoining portion of the transparent electrode (transparent portion), the luminous efficiency can be increased.

On the other hand, in the structure shown in FIG. 1 of SID 01 DIGEST, pp. 1328–1331, the barrier rib has a meander pattern, the bus electrode also has a meander pattern, and the bus electrode which is a bus portion overlaps the barrier rib 7 except part of it exists in a portion of a discharge gas space which become constricted by the meander-shaped rib, to prevent generation of discharge at the bus portion. In general, however, the pattern width of the barrier rib is made narrow up to the limitation of machine-processing accuracy (about 50 μm in a large area display) in order to ensure the discharge space as wide as possible for high luminance. Therefore, there is a need to make the pattern width of the bus electrode not wider than about 50 μm, but this is accompanied by problems that the conductive resistance becomes high and the voltage drop and the power loss increase when a current flows in the bus electrode and that a pattern break is easily caused in forming the pattern of the bus electrode. Further, if the positional relation between the meander pattern of the barrier rib and meander pattern of the bus electrode is even slightly out of the state shown in FIG. 1 of the above SID 01 DIGEST, pp. 1328–1331, part of the bus electrode gets to face the wide discharge space where the discharge is easily generated. Moreover, since a connecting portion between the arch-like transparent electrode where a discharge is generated and the bus electrode gets to face the above wide discharge space, it becomes difficult to suppress extension of the discharge to a portion of the bus electrode which adjoins the connecting portion. This raises a problem that the above slight misalignment lowers the luminous efficiency of a cell and the discharge current of the cell is not a little changed. Since it is very difficult, practically, to make the misalignment between the meander pattern of the barrier rib and meander pattern of the bus electrode negligible in terms of performance in all the display area of a large-area plasma display panel, it seems difficult to maximize the luminous efficiency of a panel and excellently uniformize the discharge and luminescence characteristics of cells in a plane.

In contrast to this, in FIGS. 18 to 20 of the present invention, the discharge inert film 22 covers the bus portion b including the bus electrode 2. Even if part of the bus portion b is slightly out a little of the discharge inert film 22 due to misalignment in forming the pattern of the discharge inert film 22 or the like, since the discharge gap adjoining portion e and the bus portion b are away from each other in the first direction D1, it is possible to prevent the sustain discharge which starts at the discharge gap adjoining portion e from extending to the bus portion b. In other words, in the structures of FIGS. 18 to 20 in accordance with the present invention, by disposing the discharge gap adjoining portion e where the sustain discharge starts and the bus portion b which is a main line for carrying a current away from each other (disposing them with the bridge-building portions c interposed therebetween), the sustain discharge is prevented from extending to the bus portion b. This is very advantageous in achieving a large area panel.

If the misalignment between the bridge-building portion c and the barrier rib 7 in the second direction D2 increases in the structures of FIGS. 18 to 20, part of the bridge-building portion c which is out of the barrier rib 7 and gets to face the discharge space 51S increases and the sustain discharge sometimes extends to the bridge-building portion c. In this case, if the discharge inert film 22 is considerably misaligned and the bus portion is out of the discharge inert film 22, there is possibility that the sustain discharge sequentially extends from the discharge gap adjoining portion e to the bridge-building portion c and further to the bus portion b. In order to suppress this phenomenon, it is necessary to make the discharge at the bridge-building portion c weak enough not to extend to the bus portion b or zero by making the pattern width of the bridge-building portion c in the second direction D2 sufficiently narrow as discussed on the structure of the second preferred embodiment shown in FIG. 4. In other words, it is necessary to appropriately reduce the strength of the electric field extending to the discharge space 51S through the dielectric layer 3 and the cathode film 11 which cover the bridge-building portion c, and the suitable pattern width of the bridge-building portion c in the second direction D2 should be about twice the covering thickness of the dielectric layer 3 and the cathode film 11 which cover the bridge-building portion c (size in the third direction D3) or less at the maximum, preferably almost equal thereto or less. According to the PDP having the bridge-building portion c, since the discharge in the bridge-building portion c can be suppressed, requirement for alignment between the barrier rib 7 and the bridge-building portion c is eased. This is advantageous in achieving a large area panel. Usually, the thickness of the dielectric layer 3 covering the sustain discharge electrodes ranges from 25 to 50 μm for ensuring the dielectric strength and suppressing the firing voltage. On the other hand, the thickness of the cathode film 11 is 1 μm level at the most. Therefore, the pattern width of the bridge-building portion c in the second direction D2 is required to be about 50 μm or less. Though a break is easily caused in patterning the bridge-building portion c with such a narrow pattern width, since the discharge gap adjoining portion e is a continuous pattern across a plurality of bridge-building portions c in the structures of FIGS. 18 to 20, if one bridge-building portion c is broken and the other bridge-building portions c are not broken, it is sufficiently possible to feed a current to the discharge gap adjoining portion e near the broken bridge-building portion c. This is advantageous in achieving good manufacturing yield. Further, since the maximum current flowing in the bridge-building portion c is extremely smaller than that flowing in the bus portion b, even if the bridge-building portion c is made of a transparent electrode which has conductivity incommensurably lower than that of a metal electrode, deterioration in conductivity of the bridge-building portion c due to narrowing of the pattern width scarcely ever becomes a problem in terms of performance. Therefore, such narrowing of the bridge-building portion c as above is practical in the structures of the present invention shown in FIGS. 18 to 20. This applies to the structures of FIGS. 6, 7, 10 and 11 where the discharge gap adjoining portion d is a continuous pattern across a plurality of bridge-building portions c. On the other hand, in the structures of FIGS. 4, 8, 9 and 12 where the discharge gap adjoining portion a is a pattern sectioned by a unit of one bridge-building portion c, when a bridge-building portion c is broken, it becomes impossible to feed a current to the discharge gap adjoining portion a adjoining (connected to) the broken bridge-building portion c. The display defect in this case, however, is a point defect and does not remarkably deteriorate the display quality as compared with a continuous line defect in a case where the bus electrode 2 or the bus portion b which is a main line for a current is broken.

Though FIGS. 18 to 20 show variations in which the discharge gap adjoining portion d has a shape where the size of the discharge gap portion DG in the first direction D1 is wider at a portion near the barrier rib 7 than at the central portion in the second direction D2 of the discharge space 51S defined by adjacent barrier ribs 7 in the structure of FIG. 7, if the shapes of the discharge gap adjoining portion a or d of FIGS. 4, 6, 9, 10 and 11 are changed like the above, the same effect can be produced. Further, also when the discharge gap adjoining portion e is applied to the earlier-discussed third and fifth preferred embodiments or their common variation, the same effect can be produced.

A PDP disclosed in Japanese Patent Application Laid Open Gazette No. 10-233171 includes electrodes each having a bus electrode (which corresponds to the bus portion b), a connection portion (which corresponds to the bridge-building portion c) and a portion which corresponds to the discharge gap adjoining portion a or d. The gazette shows a case where the connection portion is so formed as to be opposed to the barrier rib (formed between data lines (which correspond to address electrodes 6) in parallel to the data lines) and a case where the connection portion is formed on a center line of a cell, but does not show a structure in which the barrier rib is opposed to the bus electrode (bus portion), in other words, a structure in which the barrier rib has a component in a direction corresponding to the second direction D2. Further, the gazette discloses that the width of the connection portion ranges from 10 to 80 μm (preferably, about 40 μm) and the thickness of the dielectric layer is about 25 μm. The gazette further discloses a structure in which adjacent electrodes are connected to each other. Furthermore, in these PDPs disclosed in the gazette, the discharge on the bus portion is prevented by forming an insulating layer on the bus electrode. The insulating layer, however, which is covered with MgO and not directly exposed to the discharge space, is different from the discharge inert film of the present invention. Further, the insulating layer seems to have a structure in which part or the whole of the dielectric layer covering the bus electrode is made porous, and it is not the barrier rib.

Further, though a structure in which the width of the bridge-building portion is 40 μm is shown in FIG. 2 of pp. 623–626 in "Proceedings of The 7th International Display Workshops (IDW '00)", the second component of the barrier rib or the discharge inert film for preventing the discharge on the bus portion (bus electrode) is not provided.

The Seventh Preferred Embodiment

Figure 21:
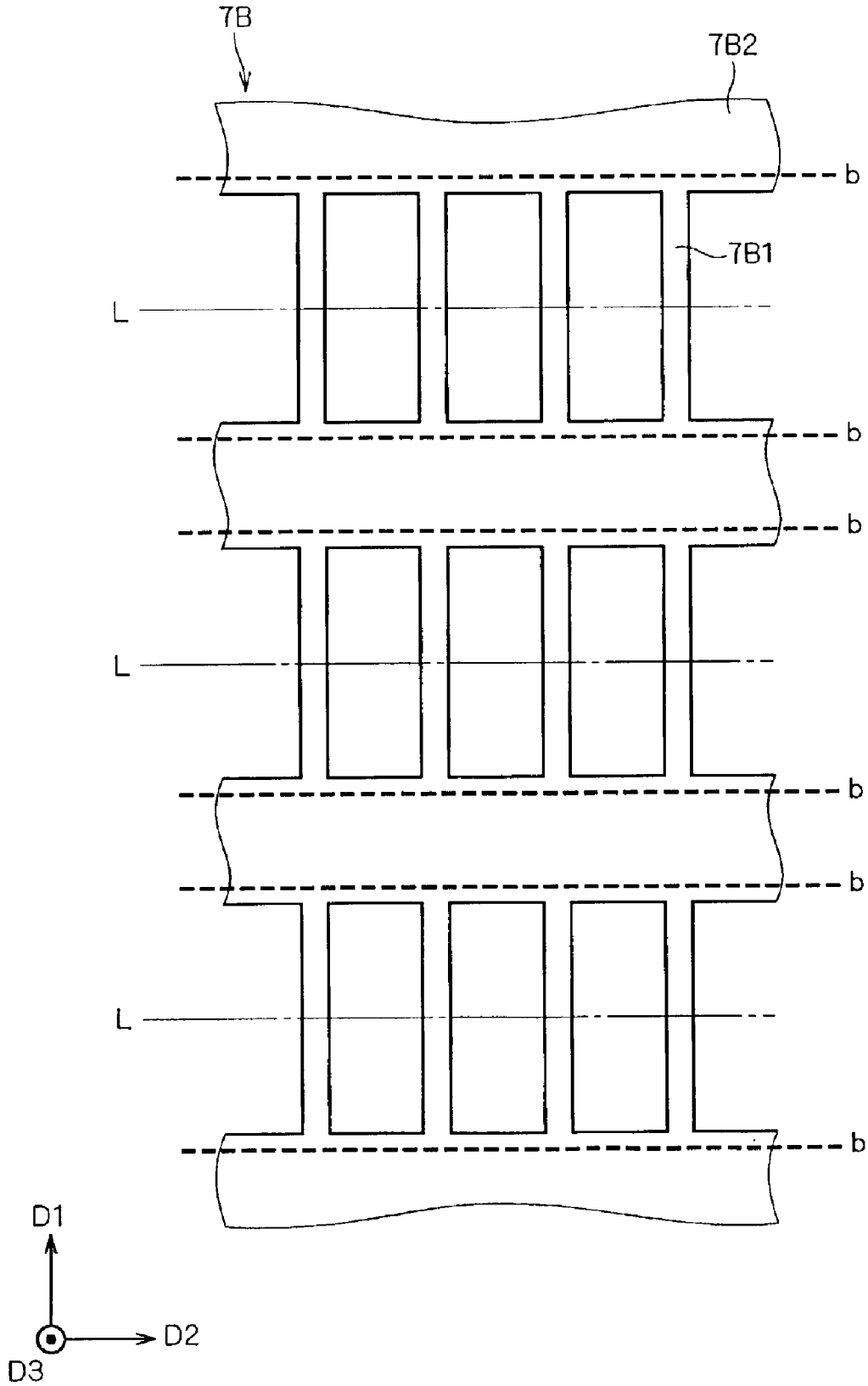
FIG. 21 is a plan view illustrating a barrier rib in accordance with a seventh preferred embodiment of the present invention.
Figure 22:
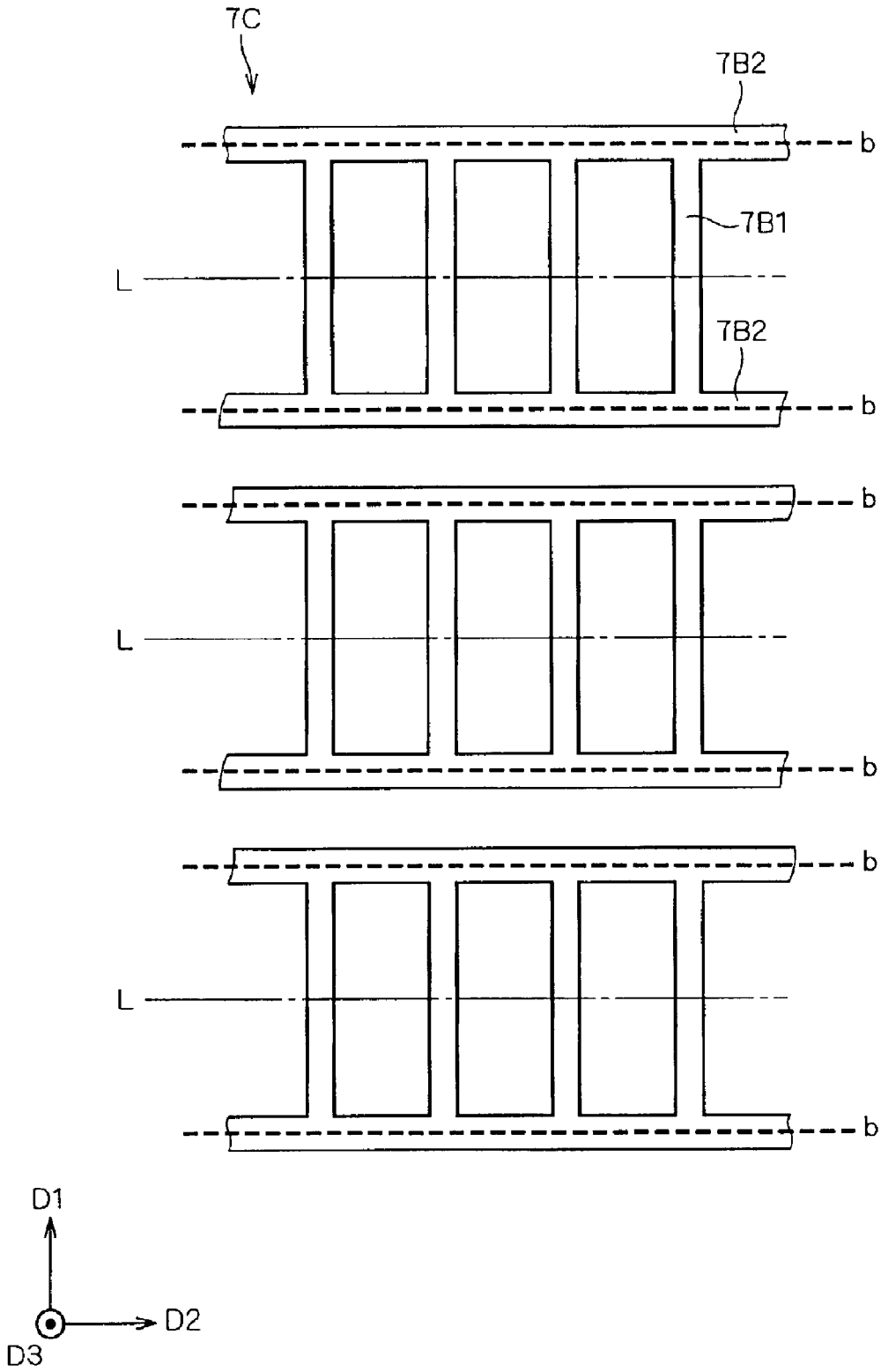
FIG. 22 is a plan view illustrating a second barrier rib in accordance with the seventh preferred embodiment.

Though the sustain discharge is prevented from extending to the bus portion b by covering the bus portion b or the bus electrode 2 with the discharge inert film 22 in the above-discussed second and sixth preferred embodiments, instead of using the discharge inert film 22, transforming the barrier rib 7 into grating or waffle-like pattern produces the same effect. In the PDP shown in the plan view of FIG. 21, a barrier rib 7B having a grating pattern includes a plurality of first components 7B1 extending along the first direction D1 (which correspond to a plurality of strip-like patterns of the earlier-discussed barrier rib 7) and a plurality of second components 7B2 extending along the second direction D2 and positioned to face the bus portion b in the third direction D3, as the PDP is two-dimensionally viewed. For simple illustration, only the barrier rib 7B, the bus portion b (schematically indicated by a broken line) and the display line L are shown in FIG. 21. In this case, in order to ensure a discharge space as wide as possible for high luminance, it is desirable that a pattern edge of the second component 7B2 of the barrier rib 7B on the side facing the center of the discharge cell in the first direction D1 should be positioned away from the center of the discharge cell as far as possible. In such a case, however, since an even slight misalignment between the bus portion b and the barrier rib 7B in the first direction D1 causes the bus portion b to face the discharge space surrounding the center of the discharge cell, it is desirable to suppress extension of the sustain discharge to the bus portion b by narrowing the pattern width of the bridge-building portion c in the second direction D2 to prevent the sustain discharge from extending to the bridge-building portion c as discussed in the sixth preferred embodiment. Though FIG. 21 shows a case where two bus portions b are present between adjacent display lines L, the barrier rib 7B can be also applied to a case where one bus portion b is present between adjacent display lines L like, e.g., the structure of FIG. 9. Further, though the second component 7B2 of the barrier rib 7B is formed across two bus portions b between adjacent display lines L, the second component 7B2 may be provided for each of the two bus portions b (see a barrier rib 7C having a waffle-like pattern in FIG. 22).

According to the PDP 51 including the grating barrier rib 7B of FIG. 21 and the sustain discharge electrodes XF and YF of FIGS. 18 to 20, the strength of the electric field generated in the discharge space above the discharge gap portion DG is made stronger at the central portion of the discharge cell away from the first component 7B1 of the barrier rib 7B than at a portion near the first component 7B1. Since this allows the surface discharge between the sustain discharge electrodes XF and YF to extend from the central portion as a starting point and the portion near the first component 7B1 of the barrier rib 7 hardly ever becomes a starting point, the rate of loss in energy of the plasma is reduced. Moreover, since an extension area of the plasma at the portion near the first component 7B1 of the barrier rib 7B is made larger relatively to the area of the sustain discharge electrodes XF and YF in which the sustain discharge is actually generated, the luminous efficiency can be improved. Further, since the second component 7B2 of the barrier rib 7B suppress the discharge on the bus portion b to prevent generation of a wrong discharge even if the bus portions b are made closer to each other between adjacent display lines L, the luminous efficiency can be improved. Such an effect can be similarly produced in the PDP 51 including the barrier rib 7C having the waffle-like pattern shown in FIG. 22.

Figure 12:
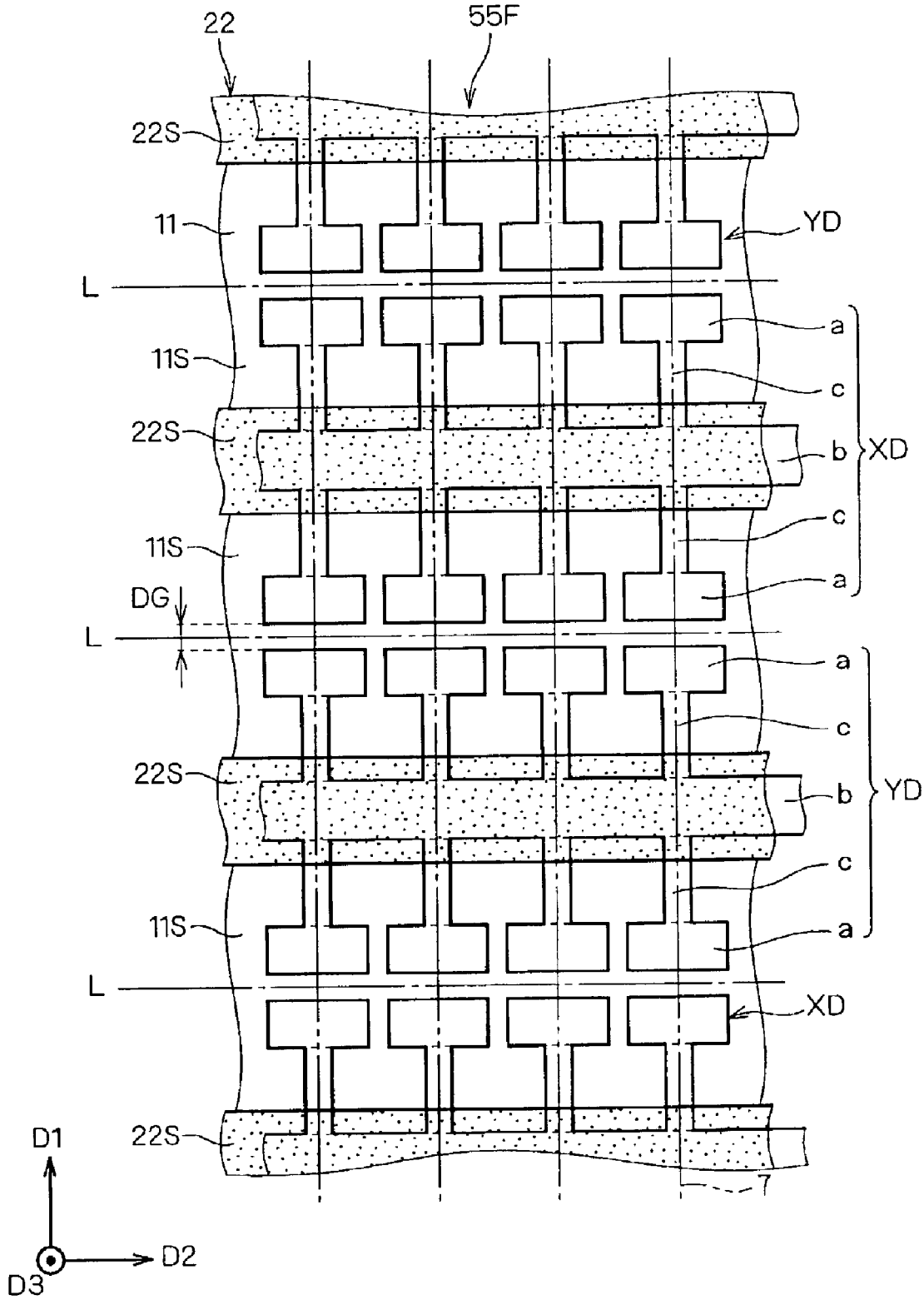
FIG. 12 is a plan view illustrating another PDP including the third front substrate in accordance with the second preferred embodiment.

Exemplary cases where a barrier rib having a component extending along the second direction D2 serves to prevent generation of discharge on the bus portion (bus electrode) are disclosed in FIG. 12 of the Japanese Patent Application Laid Open Gazette No. 2000-39866, the Japanese Patent Application Laid Open Gazette Nos. 2000-195431 and 2000-311612 and FIG. 1 of pp. 869–872 or FIG. 1 of pp. 1757–1758 in "Proceedings of The 21st International Display Research Conference in conjunction with The 8th International Display Workshops (Asia Display/IDW '01)". In these cases, however, no portion which corresponds to the bridge-building portion c is present or it is not intended to suppress the discharge on the bridge-building portion c. Therefore, these cases are different from the seventh preferred embodiment in that it is difficult to suppress the discharge on the bus portion when an even slight misalignment between the bus portion and the barrier rib in the first direction D1 causes the bus portion to face the discharge space surrounding the center of the discharge cell.

Notes on The First to Seventh Preferred Embodiments

In the first to seventh preferred embodiments, by preventing generation of discharge on the bus portion b or the bus electrode 2 which is a constituent of the sustain discharge electrode X, Y or the like (hereinafter, the sustain discharge electrodes X and Y are representative) and positioned farthest away from the discharge gap portion DG in the first direction D1, it is possible to produce an effect of easy generation of selective writing discharge (addressing discharge) between the sustain discharge electrodes X and Y during the writing period (addressing period) AD. This is because the writing discharge consists of (A) an opposite discharge which is first generated between an address electrode W to which an ON-voltage is inputted and the sustain discharge electrode Y being selected and scanned and (B) a writing surface discharge which is then generated between the sustain discharge electrodes X and Y in the discharge cell with the opposite discharge between the electrodes W and Y as a trigger, and therefore the opposite discharge between the electrodes W and Y generated nearer the discharge gap portion DG easily causes the writing surface discharge between the electrodes X and Y from a portion near the discharge gap portion DG as the starting point. In other words, in the first to seventh preferred embodiments, this is because the discharge is prevented from being generated on the bus portion b or the bus electrode 2 which is a constituent of the sustain discharge electrode X or Y and positioned farthest away from the discharge gap portion DG in the first direction D1 and therefore the opposite discharge between the electrodes W and Y during the writing period AD is generated not in the above portion but in a portion nearer the discharge gap portion DG than the above portion.

In general, the opposite discharge between the electrodes W and Y is established by using the address electrode W as an anode and the sustain discharge electrode Y as a cathode, and the strength in the first direction D1 of the electric field between the electrodes W and Y is partially offset on the side near the discharge gap portion DG by an effect of the electrode X to which a positive voltage is applied with respect to the electrode Y. Therefore, the strength of the electric field between the electrodes W and Y is stronger at a portion farther away from the discharge gap portion DG. Moreover, since the bus electrode 2 which serves as a main line for a current needs to appropriately reduce its conductive resistance and accordingly has a thickness (size in the third direction D3) ranging from several $\mu$m to 10 $\mu$m and the thickness of the dielectric layer on the bus electrode 2 is smaller than that of the transparent portion formed only of the transparent electrode 1 having a thickness of sub $\mu$m, the electric field in the discharge space 51S facing the bus electrode 2 becomes stronger. Therefore, in a general-type cell structure where the bus electrode 2 is positioned farthest away from the discharge gap portion DG to form the sustain discharge electrode X or Y, since the opposite discharge between the electrodes W and Y during the writing period AD is generated at a portion farthest away from the discharge gap portion DG as far as no particular procedure is executed for making it hard to generate the discharge near the bus electrode 2, it is difficult to induce the writing surface discharge between the sustain discharge electrodes X and Y from a portion near the discharge gap portion DG as the starting point is.

In contrast to this, according to the structures of the first to seventh preferred embodiments and earlier-discussed well-known structures disclosed in FIG. 12 of the Japanese Patent Application Laid Open Gazette No. 2000-39866, the Japanese Patent Application Laid Open Gazette Nos. 2000-195431, 2000-311612 and 2001-176400 and FIG. 1 of pp. 869–872 or FIG. 1 of pp. 1757–1758 in "Proceedings of Asia Display/IDW '01", the discharge on the bus portion b including the bus electrode 2 which is positioned farthest away from the discharge gap portion DG can be suppressed by so providing the discharge inert film or the component of the barrier rib extending along the second direction D2 as to be opposed to the bus portion b. Therefore, since the opposite discharge between the electrodes W and Y can be generated at the portion near the discharge gap portion DG and this easily induces the writing surface discharge between the electrodes X and Y from the portion near the discharge gap portion DG as the starting point, the response in writing (addressing operation) can be improved. Further, though the response in writing is sometime deteriorated by increasing the pressure or the Xe concentration of discharge gas filling the discharge space 51S in order to improve the luminous efficiency, the above structures are effective to deal with such a case.

In the structures of the second, sixth and seventh preferred embodiments and the variation of the second preferred embodiment and the structures disclosed in the Japanese Patent Application Laid Open Gazette Nos. 2000-195431, 2000-311612 and 2001-176400, the proportion of portions near the discharge gap portion DG in each of the sustain discharge electrodes X and Y except the bus portion b is made larger than that in other cases, by providing the bridge-building portion c which is smaller in size in the second direction D2 than the discharge gap adjoining portion a, d or e. Therefore, since the possibility that the opposite discharge between the electrodes W and Y should be generated at the portion near the discharge gap portion DG rises, the response in writing is improved.

In the structures of the second and sixth preferred embodiments and the structure disclosed in the gazette 2001-176400 among the above structures, since the discharge inert film 22 is provided on bus portion b, it is possible to suppress generation of the discharge on the bus portion b even if the barrier rib 7 does not have the component extending along the second direction D2. Therefore, since the discharge space 51S is regarded as a space which is continuous (extending) in the first direction D1, priming particles in the discharge space which aid start of the discharge diffuse beyond the range of one discharge cell and aid generation of the discharge in the discharge cell, thereby further improving the response in writing.

Further, if the discharge on the bridge-building portion c is made hard to generate by sufficiently narrowing the pattern width of the bridge-building portion c as discussed in the second, sixth and seventh preferred embodiments or so providing the bridge-building portion c as to face the barrier rib 7 extending along the first direction D1 as shown in FIGS. 7, 11 and 12, the opposite discharge between the electrodes W and Y during the writing period AD is generated only on the discharge gap adjoining portion a, d or e. In other words, according to the structures of the present invention, the response in writing can be improved as compared with the structures disclosed in the Japanese Patent Application Laid Open Gazette Nos. 2000-195431, 2000-311612 and 2001-176400 where there is possibility of generating the opposite discharge between the electrodes W and Y on the bridge-building portion c.

Though a write addressing system where the required wall charges are given to the discharge cell in which the sustain discharge is generated on the basis of an image signal during the addressing period prior to the discharge sustain period has been discussed above, also in an erase addressing system where the wall charges required for starting the sustain discharge are given to all the discharge cells in advance and a discharge for selectively erasing the wall charges is generated on the basis of the image signal during the subsequent addressing period to prepare the following discharge sustain period, the response in selective erase discharge is improved.

Application

It goes without saying that a number of applications may be used by various combinations of the discharge inert film 21 or the like, the sustain discharge electrodes X and Y or the like and the barrier rib 7 or the like as discussed above (also in terms of shape, size, layout, material and manufacturing method).

Further, though the arrangement of the sustain discharge electrodes X and Y in the first direction D1 is X, Y, X, Y, X, Y, X, Y, . . . in FIGS. 1, 2, 4, 6 to 8, 13, 14 and 16 to 20, an arrangement X, Y, Y, X, X, X, Y, Y, X, . . . may be adopted. In the latter arrangement, since the sustain discharge electrodes which are provided adjacently to each other with the adjoining sustain discharge electrode pair gap portion NG interposed therebetween are the same type of sustain discharge electrodes X and X or Y and Y, the static capacitance between the group of electrodes X and the group of electrodes Y becomes relatively smaller. This produces an effect of reducing the power consumption by the capacitance elements during the discharge sustain period SU where an AC voltage is applied across the groups of electrodes.

While the invention has been shown and described in detail, the foregoing description is in all aspects illustrative and not restrictive. It is therefore understood that numerous modifications and variations can be devised without departing from the scope of the invention.

What is claimed is:

1. A plasma display panel comprising:

a first substrate, a second substrate opposed to said first substrate; and a barrier rib disposed between said first substrate and said second substrate, wherein said first substrate comprises a substrate; and a plurality of first electrodes arranged on said substrate along a first direction, extending along a second direction intersecting said first direction, for defining a plurality of display lines extending along said second direction, wherein a plurality of gap portions provided between said plurality of first electrodes include at least a plurality of discharge gap portions corresponding to said plurality of display lines, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to areas between said plurality of display lines, whose secondary electron emission characteristic is lower than that of said cathode film, wherein said exposed surfaces of said discharge inert film and those of said cathode film are adjacent to one another as two-dimensionally viewed, and said discharge inert film is made of an aggregate of fine particles which does not substantially contain any inorganic binder.

2. The plasma display panel according to claim 1, wherein said fine particles include at least one kind of fine particles of $Al_2O_3$, $TiO_2$ and $SiO_2$.

3. The plasma display panel according to claim 1, wherein the average diameter of said fine particles is about 1 $\mu$m or less.

4. The plasma display panel according to claim 1, wherein said discharge inert film has a thickness equal to or larger than the average diameter of said fine particles and has a thickness not larger than about 10 $\mu$m.

5. The plasma display panel according to claim 1, wherein said barrier rib includes a pattern extending along a predetermined direction, and assuming that h represents a height of said pattern of said barrier rib which is size thereof in a layering direction of said first substrate and said second substrate and w represents an average pattern width thereof which is obtained by averaging pattern widths in said layering direction, which are sizes thereof in a direction perpendicular to both said layering direction and said predetermined direction, a relation $h/w \geqq 2$ is satisfied.

6. The plasma display panel according to claim 5, wherein said barrier rib is a stripe-shaped barrier rib.

7. The plasma display panel according to claim 1, wherein each of said plurality of first electrodes includes a bus portion extending along said second direction;

a plurality of bridge-building portions extending from said bus portion towards at least one of said plurality of discharge gap portions which said bus portion adjoins; and at least one discharge gap adjoining portion electrically connected to said bus portion through at least one of said plurality of bridge-building portions and disposed adjacently to said at least one discharge gap portion, and said at least one discharge gap adjoining portion forms a pattern continuing across adjacent ones of said plurality of bridge-building portions along said second direction.

8. The plasma display panel according to claim 7, wherein said discharge inert film is so formed on said cathode film to have a thickness not larger than about 10 $\mu$m as to have said exposed surfaces in areas thereof corresponding to said bus portions.

9. A plasma display device comprising:

said plasma display panel as defined in claim 1; and a driving device for driving said plasma display panel, wherein said second substrate includes a plurality of second electrodes extending along a direction intersecting said plurality of first electrodes, and an opposite discharge between said each of said first electrodes and each of said second electrodes is generated at a portion of said first electrode near said discharge gap portion as two-dimensionally viewed in an addressing operation by said driving device.

10. A plasma display panel comprising:

a first substrate, a second substrate opposed to said first substrate; and a barrier rib disposed between said first substrate and said second substrate, wherein said first substrate comprises a substrate; and a plurality of first electrodes arranged on said substrate along a first direction, extending along a second direction intersecting said first direction, for defining a plurality of display lines extending along said second direction, wherein a plurality of gap portions provided between said plurality of first electrodes include at least a plurality of discharge gap portions corresponding to said plurality of display lines, and each of said plurality of first electrodes includes a bus portion extending along said second direction;

a plurality of bridge-building portions extending from said bus portion towards at least one of said plurality of discharge gap portions which said bus portion adjoins; and at least one discharge gap adjoining portion electrically connected to said bus portion through at least one of said plurality of bridge-building portions and disposed adjacently to said at least one discharge gap portion, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to areas between said plurality of display lines, whose secondary electron emission characteristic is lower than that of said cathode film, wherein said exposed surfaces of said discharge inert film and those of said cathode film are adjacent to one another as two-dimensionally viewed, and said discharge inert film is formed by printing and firing a paste-like material, and has a pattern edge at a position away from said at least one discharge gap adjoining portion by about 50 $\mu$m or more as two-dimensionally viewed.

11. A plasma display panel comprising:

a first substrate, a second substrate opposed to said first substrate; and a barrier rib disposed between said first substrate and said second substrate, wherein said first substrate comprises a substrate; and a plurality of first electrodes arranged on said substrate along a first direction, extending along a second direction intersecting said first direction, for defining a plurality of display lines extending along said second direction, wherein a plurality of gap portions provided between said plurality of first electrodes include at least a plurality of discharge gap portions corresponding to said plurality of display lines, and each of said plurality of first electrodes includes a bus portion extending along said second direction;

a plurality of bridge-building portions extending from said bus portion towards at least one of said plurality of discharge gap portions which said bus portion adjoins; and at least one discharge gap adjoining portion electrically connected to said bus portion through at least one of said plurality of bridge-building portions and disposed adjacently to said at least one discharge gap portion, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to areas between said plurality of display lines, whose secondary electron emission characteristic is lower than that of said cathode film, wherein said exposed surfaces of said discharge inert film and those of said cathode film are adjacent to one another as two-dimensionally viewed, and said discharge inert film has a pattern edge at a position where a distance from said at least one discharge gap adjoining portion is longer than that from said bus portion as two-dimensionally viewed.

12. A plasma display panel comprising:

a first substrate, a second substrate opposed to said first substrate; and a barrier rib disposed between said first substrate and said second substrate, wherein said first substrate comprises a substrate; and a plurality of first electrodes arranged on said substrate along a first direction, extending along a second direction intersecting said first direction, for defining a plurality of display lines extending along said second direction, wherein a plurality of gap portions provided between said plurality of first electrodes include at least a plurality of discharge gap portions corresponding to said plurality of display lines, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, whose secondary electron emission characteristic is lower than that of said cathode film, wherein said exposed surfaces of said discharge inert film and those of said cathode film are adjacent to one another as two-dimensionally viewed, and said discharge inert film has exposed surfaces in areas thereof corresponding to areas between said plurality of display lines and areas thereof which part said plurality of first electrodes along said first direction as two-dimensionally viewed.

13. A plasma display panel comprising:

first and second substrates opposed to each other; and a barrier rib disposed between said first and second substrates, wherein said first substrate comprises a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, each of said plurality of first electrodes includes a bus portion extending along said second direction;

a plurality of bridge-building portions extending from said bus portion towards at least one of said plurality of discharge gap portions which said bus portion adjoins; and a plurality of discharge gap adjoining portions electrically connected to said bus portion through said plurality of bridge-building portions and disposed adjacently to said at least one discharge gap portion, and areas between ones of said plurality of discharge gap adjoining portions which are arranged along said second direction are not opposed to said barrier rib as two-dimensionally viewed.

14. A plasma display panel comprising:

first and second substrates opposed to each other, wherein said first substrate comprises a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to areas between said plurality of display lines, whose secondary electron emission characteristic is lower than that of said cathode film, and said exposed surfaces of said discharge inert film and those of said cathode film are adjacent to one another as two-dimensionally viewed, said plasma display panel further comprising:

a plurality of discharge cells arranged on said plurality of display lines, wherein said exposed surfaces of said discharge inert film and those of said cathode film are patterned so that the size of surface discharge generated oh said first substrate in each of said plurality of discharge cells depends on the luminescent color of said each of plurality of discharge cells.

15. A plasma display panel comprising:

first and second substrates opposed to each other; and a barrier rib disposed between said first and second substrates, wherein said first substrate includes a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, each of said plurality of first electrodes includes a bus portion extending along said second direction;

a plurality of bridge-building portions extending from said bus portion towards at least one of said plurality of discharge gap portions which said bus portion adjoins; and a plurality of discharge gap adjoining portions electrically connected to said bus portion through said plurality of bridge-building portions and disposed adjacently to said at least one discharge gap portion, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to said bus portions, whose secondary electron emission characteristic is lower than that of said cathode film, said exposed surfaces of said discharge inert film and those of said cathode film are adjacent to one another as two-dimensionally viewed, said barrier rib includes at least a plurality of first components extending along said first direction as two-dimensionally viewed, and at least one of said plurality of discharge gap adjoining portions has such a shape as to make the size in said first direction of said discharge gap portion adjacent to said discharge gap adjoining portion wider at a portion of an area defined by adjacent ones of said plurality of first components of said barrier rib, which is near said first components, than at a center portion in said second direction of said area.

16. A plasma display panel comprising:

first and second substrates opposed to each other; and a barrier rib disposed between said first and second substrates, wherein said first substrate includes a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, each of said plurality of first electrodes includes a bus portion extending along said second direction;

a plurality of bridge-building portions extending from said bus portion towards at least one of said plurality of discharge gap portions which said bus portion adjoins; and a plurality of discharge gap adjoining portions electrically connected to said bus portion through said plurality of bridge-building portions and disposed adjacently to said at least one discharge gap portion, said plurality of discharge gap adjoining portions each include a transparent electrode, said first substrate further comprises a dielectric layer disposed on said substrate, covering said plurality of first electrodes; and a cathode film opposed to said substrate with said dielectric layer interposed therebetween, having exposed surfaces in areas thereof corresponding to said discharge gap adjoining portions, said barrier rib includes at least a plurality of first components extending along said first direction and a plurality of second components extending along said second direction and opposed to said bus portions as two-dimensionally viewed, and at least one of said plurality of discharge gap adjoining portions has such a shape as to make the size in said first direction of said discharge gap portion adjacent to said discharge gap adjoining portion wider at a portion of an area defined by adjacent ones of said plurality of first components of said barrier rib, which is near said first components, than at a center portion in said second direction of said area.

17. A plasma display panel comprising:

a first substrate;

a second substrate opposed to said first substrate; and a barrier rib disposed between said first and second substrates, including at least a plurality of first components extending along said first direction, wherein said first substrate comprises a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, each of said plurality of first electrodes includes a bus portion extending along said second direction;

a plurality of bridge-building portions extending from said bus portion towards at least one of said plurality of discharge gap portions which said bus portion adjoins; and at least one discharge gap adjoining portion electrically connected to said bus portion through at least one of said plurality of bridge-building portions and disposed adjacently to said at least one discharge gap portion, said first substrate further comprises a dielectric layer disposed on said substrate, covering said plurality of first electrodes;

a cathode film opposed to said substrate with said dielectric layer interposed therebetween; and a discharge inert film opposed to said substrate with said dielectric layer interposed therebetween, having exposed surfaces in areas thereof corresponding to said bus portions, whose secondary electron emission characteristic is lower than that of said cathode film, and the size of said bridge-building portions in said second direction is not larger than about twice a covering thickness of said dielectric layer and said cathode film which cover said bridge-building portions.

18. A plasma display device comprising:

A plasma display panel comprising first and second substrates opposed to each other; and a driving device for driving said plasma display panel, wherein said first substrate comprises a substrate; and a plurality of first electrodes arranged on said substrate along a first direction, extending along a second direction intersecting said first direction, for defining a plurality of display lines extending along said second direction, a plurality of gap portions provided between said plurality of first electrodes include at least a plurality of discharge gap portions corresponding to said plurality of display lines, said first substrate further comprises a dielectric layer disposed on said substrate, covering said plurality of first electrodes;

a cathode film opposed to said substrate with said dielectric layer interposed therebetween, having exposed surfaces in areas thereof corresponding to said plurality of display lines; and a discharge inert film opposed to said substrate with said dielectric layer interposed therebetween, having exposed surfaces in areas thereof corresponding to areas between said plurality of display lines, whose secondary electron emission characteristic is lower than that of said cathode film, and said exposed surfaces of said discharge inert film and those of said cathode film are adjacent to one another as two-dimensionally viewed, and said driving device gives a predetermined potential difference across adjacent ones of said plurality of first electrodes during a reset period, said plasma display device having a constitution to suppress extension of a surface discharge to said exposed surfaces of said discharge inert film, said surface discharge being generated on said first substrate by supplying said predetermined potential difference during said reset period.

19. The plasma display device according to claim 18, wherein said constitution to suppress extension of said surface discharge generated during said reset period to said exposed surfaces of said discharge inert film includes a constitution to allow said driving device to gradually increase said predetermined potential difference.

20. The plasma display device according to claim 18, wherein each of said plurality of first electrodes includes a bus portion extending along said second direction;

a plurality of bridge-building portions extending from said bus portion towards at least one of said plurality of discharge gap portions which said bus portion adjoins; and at least one discharge gap adjoining portion electrically connected to said bus portion through at least one of said plurality of bridge-building portions and disposed adjacently to said at least one discharge gap portion, and said constitution to suppress extension of said surface discharge generated during said reset period to said exposed surfaces of said discharge inert film includes a constitution in which said exposed surfaces of said discharge inert film are so disposed as not to cover said at least one discharge gap adjoining portion.

* * * * *